US008564472B2

(12) United States Patent
Okamura et al.

(10) Patent No.: US 8,564,472 B2
(45) Date of Patent: Oct. 22, 2013

(54) SHEET MEMBER FOR IMPROVING COMMUNICATION, AND ANTENNA DEVICE AND ELECTRONIC INFORMATION TRANSMITTING APPARATUS PROVIDED THEREWITH

(75) Inventors: Haruhide Okamura, Yamatokoriyama (JP); Takahiko Yoshida, Yamatokoriyama (JP); Masato Matsushita, Yamatokoriyama (JP); Yoshiharu Kiyohara, Yamatokoriyama (JP); Shinichi Sato, Yamatokoriyama (JP); Ryota Yoshihara, Yamatokoriyama (JP); Kazuhisa Morita, Yamatokoriyama (JP); Hiroaki Kogure, Tokyo (JP)

(73) Assignee: Nitta Corporation, Osaka (JP)

( * ) Notice: Subject to any disclaimer, the term of this patent is extended or adjusted under 35 U.S.C. 154(b) by 789 days.

(21) Appl. No.: 12/226,607

(22) PCT Filed: Oct. 23, 2006

(86) PCT No.: PCT/JP2006/321087
§ 371 (c)(1),
(2), (4) Date: Aug. 4, 2009

(87) PCT Pub. No.: WO2007/046527
PCT Pub. Date: Apr. 26, 2007

(65) Prior Publication Data

US 2010/0052992 A1 Mar. 4, 2010

(30) Foreign Application Priority Data

Oct. 21, 2005 (JP) ..... P2005-307325

(51) Int. Cl.
*H01Q 17/00* (2006.01)
*H01Q 21/00* (2006.01)

(52) U.S. Cl.
USPC ..... 342/1; 342/2; 342/3; 342/4; 343/853; 343/700 MS

(58) Field of Classification Search
None
See application file for complete search history.

(56) References Cited

U.S. PATENT DOCUMENTS 5,576,710 A * 11/1996 Broderick et al. ..... 342/1
6,075,485 A * 6/2000 Lilly et al. ..... 343/700 MS (Continued)

FOREIGN PATENT DOCUMENTS

EP 0 468 887 1/1992
EP 0 677 888 10/1995

(Continued)

OTHER PUBLICATIONS

International Search Report. PCT/JP2006/321087; Jan. 16, 2007, 2 pages.

(Continued)

*Primary Examiner* — Trinh Dinh
(74) *Attorney, Agent, or Firm* — Harness, Dickey & Pierce, P.L.C.

(57) ABSTRACT

In one embodiment of the present invention, a conductive pattern portion formed in a pattern layer functions as an antenna, and, when electromagnetic waves at a predetermined frequency arrive, resonance occurs, and an electromagnetic wave of a specific frequency is introduced into a sheet member. As to the sheet member having the pattern layer, even in a small and thin sheet member, the phase of reflected waves from the reflection area can be adjusted, and thus an area having high electric field intensity due to interference between reflected waves from the reflection area and arriving electromagnetic waves can be set in the vicinity of the antenna element. When the sheet member is disposed between an antenna element and a communication jamming member, an electromagnetic field is generated around the conductive pattern portion, and an electromagnetic energy is supplied from the conductive pattern portion to the antenna element, and therefore receiving power of the antenna element can be increased. Accordingly, wireless communication can be suitably performed.

20 Claims, 44 Drawing Sheets

(56) References Cited

U.S. PATENT DOCUMENTS

| | | | | |
|---|---|---|---|---|
| 6,371,380 | B1 * | 4/2002 | Tanimura | 235/492 |
| 7,495,181 | B2 * | 2/2009 | Matsushita et al. | 174/377 |
| 7,777,664 | B2 * | 8/2010 | Masuda et al. | 342/1 |
| 7,804,439 | B2 * | 9/2010 | Yoshida et al. | 342/4 |
| 7,864,095 | B2 * | 1/2011 | Masuda et al. | 342/1 |
| 2004/0200821 | A1 | 10/2004 | Voeltzel | |

FOREIGN PATENT DOCUMENTS

| | | | |
|---|---|---|---|
| GB | 814 310 | | 6/1959 |
| JP | 01-149503 | | 6/1989 |
| JP | 11-204984 | * | 7/1999 |
| JP | 2000-68676 | | 3/2000 |
| JP | 2000-114132 | | 4/2000 |
| JP | 2000-236214 | | 8/2000 |
| JP | 2002-076670 | * | 3/2002 |
| JP | 2002-230507 | | 8/2002 |
| JP | 2003-60430 | | 2/2003 |
| JP | 2003 243876 | * | 8/2003 |
| JP | 2005-109638 | | 4/2005 |
| JP | 3647446 | | 5/2005 |
| JP | 2005-159337 | | 6/2005 |
| JP | 2002-314284 | | 7/2005 |
| JP | 2005-184012 | * | 7/2005 |
| TW | 195105 | | 11/1992 |
| WO | WO 94/24724 | A1 | 10/1994 |
| WO | WO 2004/093497 | | 10/2004 |

OTHER PUBLICATIONS

Notification of Reason For Refusal dated Oct. 20, 2009, with regard to the corresponding Taiwanese Patent Application No. 095139078.
Joseph A. Milenkevich et al., "Pattern Coated Microwave Field Modifier of Discrete Electrically Conductive Elements". English Specification corresponding to TW 195105.
Extended European Search Report dated Sep. 29, 2010, for corresponding European Patent Application No. 06812147.4.
European Office Action dated Mar. 19, 2013, for corresponding European Application No. 06812147.4-1812.
Abstract of JP 2005-327939, Nov. 24, 2005.

* cited by examiner

SHEET MEMBER FOR IMPROVING COMMUNICATION, AND ANTENNA DEVICE AND ELECTRONIC INFORMATION TRANSMITTING APPARATUS PROVIDED THEREWITH

PRIORITY PARAGRAPH

This application is the national phase under 35 U.S.C. §371 of PCT International Application No. PCT/JP2006/321087 which has an International filing date of Oct. 23, 2006, which designated the United States of America, and which claims priority on Japanese patent application number 2005-307325 filed Oct. 21, 2005, the entire contents of each of which are hereby incorporated herein by reference.

TECHNICAL FIELD

The present invention relates to a sheet member for improving communication, used for performing wireless communication using an antenna element in the vicinity of a communication jamming member, and an antenna device and an electronic information transmitting apparatus provided therewith.

BACKGROUND ART

FIG. 51 is a simplified cross-sectional view showing a tag 1 according to a conventional technique. FIG. 51 shows the case of wireless communication using an electromagnetic induction system typically used for a 13.56 MHz band. An RFID (radio frequency identification) system is a system used for automatically recognizing a solid matter, and basically is provided with a reader and a transponder. As the transponder of this RFID system, the tag 1 is used. The tag 1 has a coil antenna 2 that is a magnetic field-type antenna detecting lines of magnetic force, and an integrated circuit (IC) 3 that is used for performing wireless communication using the coil antenna 2. In the tag 1, at the time when a request signal from the reader is received, information stored in the IC 3 is sent, that is, the reader is allowed to read information held in the tag 1. For example, the tag 1 is attached to a product, and used for management of products such as prevention of product theft or recognition of inventory status.

When a communication jamming member 4 (a conductive material in this example) is present in the vicinity of the antenna 2, for example, when the tag 1 is attached to a metal product in use, lines of magnetic force of a magnetic field that is formed by electromagnetic wave signals sent and received by the antenna 2 pass through points in the vicinity of the surface of the communication jamming member 4. In this case, an eddy current is formed at the communication jamming member 4, and electromagnetic wave energy is converted into thermal energy and absorbed. When the energy is absorbed in this manner, electromagnetic wave signals are significantly attenuated, which makes it impossible for the tag 1 to perform wireless communication. Furthermore, when the induced eddy current generates a magnetic field (diamagnetic field) in the orientation opposite to the magnetic field for communication of the tag, a phenomenon occurs in which the magnetic field is cancelled. This phenomenon also makes it impossible for the tag 1 to perform wireless communication. Furthermore, due to the influence of the communication jamming member 4, a phenomenon occurs in which the resonance frequency of the antenna 2 is shifted. Accordingly, the tag 1 cannot be used in the vicinity of the communication jamming member 4.

FIG. 52 is a simplified cross-sectional view showing a tag 1A according to another conventional technique. The tag 1A shown in FIG. 52 is similar to the tag 1 in FIG. 51, and thus the corresponding constituent elements are denoted by the same numerals, and only different constituent elements in the configuration will be described. In order to solve the problem of the tag 1 in FIG. 51, the tag 1A in FIG. 52 is configured to include a magnetic wave absorbing plate 7 disposed between the antenna 2 and the member 4 that is a product to which the tag 1A is attached. The magnetic wave absorbing plate 7, which is a sheet having a complex relative magnetic permeability, is made of a highly magnetically permeable material such as sendust, ferrite, or carbonyl iron, that is, a material having a high complex relative magnetic permeability.

The complex relative magnetic permeability has a real number part and an imaginary number part. When the real number part becomes high, the complex relative magnetic permeability becomes high. In other words, a material having a high complex relative magnetic permeability has a high real number part in the complex relative magnetic permeability. In a case where a material having a high real number part in the complex relative magnetic permeability is present in the magnetic field, lines of magnetic force concentratedly pass through the material. In the tag 1A that uses the magnetic field-type antenna 2 detecting lines of magnetic force, leakage of the magnetic field to the communication jamming member 4 is prevented by arranging the magnetic wave absorbing plate 7. Thus, even in the vicinity of the communication jamming member 4, the tag 1A can perform wireless communication while suppressing attenuation of magnetic field energy. This sort of tag 1A has been disclosed in, for example, Japanese Unexamined Patent Publication JP-A 2000-114132.

In another conventional technique, a sheet member is attached via an adhesive or the like to a non-contact wireless data carrier that is disposed near a wall face made of a metal or the like and that can send and receive predetermined radio waves, and thus this sheet member absorbs radio waves oriented toward the wall face or radio waves reflected by the wall face, thereby making it possible to send and receive data in the entire space in a radio wave area effective for the operation of the non-contact wireless data carrier. This example is for the RFID system in wireless communication using a radio wave method in a 2.4 GHz band. Furthermore, the non-contact wireless data carrier, a spacer that has a predetermined thickness and that does not absorb radio waves, and a radio wave reflecting member are attached to each other via an adhesive or the like, and the thickness of the spacer 8 is set so that the position of the non-contact wireless data carrier does not match a position away from the radio wave reflecting member by $\lambda/4$ ($\lambda$ denotes the wavelength) or a position away from that position by $n\lambda/2$ (the symbol n denotes a natural number), thereby making it possible to send and receive data in the entire space in a radio wave area effective for the operation of the non-contact wireless data carrier. A data carrier system using the non-contact wireless data carrier has been disclosed, for example, in Japanese Unexamined Patent Publication JP-A 2002-230507.

A communication jamming member in the invention refers to a member that may deteriorate communication properties of an antenna when the communication jamming member is present in the vicinity of the antenna, compared with the case of a free space. The communication jamming member corresponds to, for example, conductive materials such as metals, dielectric materials such as glass, paper, and a liquid, and magnetic materials having magnetic properties. In a case where a conductive material is present in the vicinity of an antenna element, the input impedance of the antenna element is significantly lowered, and thus wireless communication becomes difficult. Moreover, a dielectric material such as cardboard, a resin, glass, or a liquid jams wireless communication because the dielectric constant of the dielectric material lowers the resonance frequency of the antenna. Furthermore, a magnetic material also jams wireless communication because the magnetic permeability of the magnetic material lowers the resonance frequency of the antenna.

In a case where the magnetic field-type antenna 2 such as a coil antenna is used as in the tag 1A shown in FIG. 52, leakage of a magnetic field is prevented, and thus wireless communication can be performed in the vicinity of the communication jamming member 4. However, this configuration has the problem that a sufficient communication distance cannot be typically secured with a magnetic field-type antenna. Furthermore, it is considered that this sort of configuration for preventing leakage of a magnetic field is not effective for a case in which an electric field-type antenna detecting lines of electric force is used, and the application thereof has not been investigated.

In JP-A 2002-230507, the radio wave reflecting member is overlaid via a sheet member or a spacer on the non-contact wireless data carrier, and thus the position of the data carrier is set so as not to match a position away from the radio wave reflecting member by $\lambda/4$ or a position away from that position by $n\lambda/2$ (n is a natural number). JP-A 2002-230507 describes that a point where data cannot be sent or received due to mutual cancellation of incident waves and reflected waves appears in each point away from the reflecting face by $\lambda/4$ and point away from that position by $\lambda/2$. However, as shown in FIG. 12 by the present inventors, the phase of radio waves is shifted by 180° when the radio waves are reflected by the radio wave reflecting face, and thus the position away from the radio wave reflecting face by $\lambda/4$ has the largest electric field intensity due to interference. At the same time, the magnetic field intensity at this position becomes zero. That is to say, although data cannot be received by a magnetic field-type antenna, data can be received optimally by a commonly used electric field-type antenna. Thus, in a case where this position is not included, there is the problem that a sufficient communication distance cannot be secured in the vicinity of the communication jamming member.

The problem in the shift of the resonance frequency is that since the shift varies depending on a material (material quality) that is present in the vicinity, the shift amount is not constant, and thus a measure for improving communication (modifying resonance frequency) is individually required.

DISCLOSURE OF INVENTION

It is an object of the invention to provide, instead of a radio wave absorbing member that attenuates electromagnetic energy, a sheet member for improving communication, capable of storing communication energy and enabling wireless communication to be suitably performed in the vicinity of a communication jamming member, and an antenna device and an electronic information transmitting apparatus provided therewith.

The invention is directed to a sheet member for improving communication used when performing wireless communication using an antenna element in a vicinity of a communication jamming member having a portion made of a conductive material, the sheet member being disposed between the antenna element and the communication jamming member, and comprising:

a pattern layer in which a conductive pattern portion is formed, the conductive pattern portion resonating with an electromagnetic wave used for wireless communication, storing electromagnetic energy, forming electromagnetic coupling with the antenna element, and transferring the stored electromagnetic energy to the antenna element; and a storage layer that is interposed between the pattern layer and the communication jamming member, that is made of a non-conductive dielectric layer and/or magnetic layer and that collects energy of electromagnetic waves used for wireless communication to pass therethrough, thereby improving a communication distance by wireless communication.

According to the invention, the conductive pattern portion of the pattern layer functions as an antenna, and resonance occurs when electromagnetic waves at a predetermined frequency arrive. In a case where an antenna element such as a dipole antenna is disposed in the vicinity of the pattern layer, electromagnetic coupling is formed between the conductive pattern layer and the antenna element, and electromagnetic energy stored in the pattern layer is transferred from the conductive pattern portion to the antenna element. When electromagnetic energy at the resonance frequency is supplied from the conductive pattern portion to the antenna element, receiving power of the antenna element can be increased compared with a case in which this pattern layer is not included. Accordingly, wireless communication can be suitably performed even in the vicinity of a communication jamming member, and a sufficient communication distance can be secured. When the sheet member includes the conductive pattern portion and independently has an antenna function in this manner, an effect of improving communication of antenna element can be obtained. The sheet member for improving communication of the invention is designed so that the sheet member itself is not affected by a communication jamming member and the sheet member itself does not negatively affect the antenna element. Furthermore, the sheet member has a structure in which electromagnetic energy used for communication is completed for the antenna element.

Furthermore, when the antenna element is disposed in the vicinity of a communication jamming member, since the storage layer that collects energy of electromagnetic waves used for wireless communication is disposed between the antenna element and the communication jamming member, conduction can be prevented, and reactance (L) components and capacitance (C) components can be increased. Furthermore, due to a real number part $\in'$ of the complex relative dielectric constant and/or a real number part $\mu''$ of the complex relative magnetic permeability, the propagation path of electromagnetic waves that have entered the sheet member can be bent. Moreover, due to a wavelength shortening effect, the conductive pattern portion and the sheet member can be made smaller and thinner. The storage layer is made of at least one of a non-conductive magnetic layer and dielectric layer.

Furthermore, when the antenna element is disposed in the vicinity of a communication jamming member, since the non-conductive storage layer is disposed between the antenna element and the communication jamming member, a decrease in the input impedance of the antenna element caused by the communication jamming member can be suppressed. When the input impedance becomes small, this impedance is deviated from the impedance of communication means for performing communication using the antenna element, and signals cannot be exchanged between the antenna element and the communication means. Since the sheet member can suppress a decrease in the input impedance of the antenna element when the antenna element is disposed in the vicinity of a communication jamming member, wireless communication can be suitably performed even in the vicinity of a communication jamming member.

Furthermore, in the invention, the sheet member for improving communication is used by attaching to a tag having the antenna element in an RFID system.

Furthermore, in the invention, it is preferable that the antenna element is an electric field-type antenna. Furthermore, in the invention, it is preferable that a reflection area forming layer that forms a reflection area reflecting electromagnetic waves used for wireless communication is disposed to have the storage layer interposed between the reflection area forming layer and the pattern layer, and to be spaced away from the pattern layer on the opposite side of the antenna element, in the vicinity of a position at which the electrical length from the pattern layer is $((2n-1)/4)\lambda$ (n is a positive integer) when the wavelength of electromagnetic waves used for wireless communication is taken as $\lambda$.

According to the invention, electromagnetic waves at a specific frequency are captured by the interior of the sheet member by resonance, and the phase of the captured electromagnetic waves is adjusted in the interior of the sheet member. Thus, when the wavelength of electromagnetic waves used for wireless communication is taken as $\lambda$, an area having high electric field intensity, formed at a position away from the reflection area by an electrical length of $((2n-1)/4)\lambda$ (n is a positive integer), can be formed at the position of the pattern layer. Since the phase of electromagnetic waves reflected at a reflection area that is formed by the reflection area forming layer is shifted by 180°, when arriving electromagnetic waves and electromagnetic waves reflected at the reflection area interfere each other, the electric field intensity is increased at a position away from the reflection area by an electrical length of $((2n-1)/4)$ times of the wavelength of electromagnetic waves. When the antenna element is disposed at a position where reflected electromagnetic waves and arriving electromagnetic waves reinforce each other for interference, that is, the pattern layer is disposed in the vicinity of the antenna element in an electrically insulated state, the intensity of an electric field that can be received by the antenna element can be prevented from being lowered, and wireless communication can be suitably performed even in the vicinity of a communication jamming member.

Furthermore, the reflection area may be the reflection area forming layer itself, or may be a position (virtual electromagnetic wave reflecting face) having an electric field of zero and virtually connecting a point near the center of the conductive pattern portion and the reflection area forming layer. In a case where the reflection area is a position (virtual electromagnetic wave reflecting face) having an electric field of zero and virtually connecting a point near the center of the conductive pattern portion and the reflection area forming layer, electromagnetic waves are reflected at that position, and electromagnetic waves move around the conductive pattern portion. Using these aspects, a longer electrical length from the conductive pattern portion to the reflection area can be obtained. As a result, the thickness of the sheet member can be made smaller than $((2n-1)/4)\lambda$ (n is a positive integer), and thus the sheet member can be made thinner.

Furthermore, in a case where the reflection area forming layer is disposed, the influence of the arrangement position of the sheet member, that is, the type of materials constituting the communication jamming member and presence of liquid such as water attached to the surface of the communication jamming member can be prevented from changing the resonance frequency of the conductive pattern portion. Thus, the optimum conditions of communication do not have to be readjusted for each different antenna element, and the communication conditions of the antenna element can be stabilized.

Furthermore, in the invention, it is preferable that a plurality of conductive pattern portions that are electrically insulated from each other are formed in the pattern layer.

According to the invention, with the pattern layer, electromagnetic waves corresponding to the size of each of the conductive pattern portions can be received to cause resonance. Depending on how the size of the conductive pattern portions is determined, electric power obtained by the antenna element from electromagnetic waves used for wireless communication can be increased. Herein, the number of pattern portions resonated with electromagnetic waves at a communication frequency may be one or may be plural. The pattern layer may be a single layer or may be multiple layers. The pattern layer may be formed in three dimensions.

Furthermore, in the invention, it is preferable that a plurality of types of conductive pattern portions in which at least one of size and shape is different therebetween are formed in the pattern layer.

According to the invention, a plurality of types of conductive pattern portions in which at least one of size and shape is different therebetween have respectively different resonance frequencies, and thus the pattern layer can receive electromagnetic waves at a plurality frequencies. Furthermore, the electric power obtained by the antenna element from electromagnetic waves used for wireless communication can be reliably increased.

Furthermore, in the invention, it is preferable that a conductive pattern portion that continuously extends over a wide range of the sheet member is formed in the pattern layer.

According to the invention, the pattern layer in which the conductive pattern portion continuously disposed in a wide range is formed can increase the gain over frequencies in a wide band. Thus, the sheet member provided therewith can receive electromagnetic waves at frequencies in a wide band. Furthermore, the electric power obtained by the antenna element from electromagnetic waves used for wireless communication can be reliably increased.

Furthermore, in the invention, it is preferable that the conductive pattern portion has a substantially polygonal outer shape in which at least one corner is curved.

The conductive pattern portion that receives electromagnetic waves has a substantially polygonal outer shape that is basically in the shape of a polygon, and at least one corner is curved. When the corner is rounded off, that is, curved, shift of the frequency at which the gain has a peak value according to the direction in which electromagnetic waves are polarized can be suppressed low, and good polarization properties can be obtained. Accordingly, an excellent sheet member for improving communication can be realized in which a peak value of the gain is high, and shift of the frequency at which the gain has a peak value according to the direction in which electromagnetic waves are polarized is small.

In the pattern layer, all conductive pattern portions may have curved corners. However, all conductive pattern portions do not have to have curved corners, and any configuration may be applied, as long as part of the conductive pattern portions has curved corners. In a case where part of the conductive pattern portions has curved corners, there is no limitation on presence or absence of curved corners in the other conductive pattern portions. Furthermore, in the conductive pattern portions that have curved corners, only part of the corners may be curved, or all corners may be curved. Furthermore, the conductive pattern portion may be in the shape of a substantially polygonal plane, or may be in the shape of a line forming a closed loop extending substantially in the shape of a polygon. Accordingly, the electric power obtained by the antenna element from electromagnetic waves used for wireless communication can be reliably increased.

Furthermore, in the invention, it is preferable that a plurality of conductive pattern portions are formed in the pattern layer, and the conductive pattern portions have different radiuses of curvature of corners and are formed in combination.

According to the invention, since the conductive pattern portions having different radiuses of curvature of the corners are formed, the frequency band of electromagnetic waves that are to be received (hereinafter, may be referred to as a 'reception band') can be changed without lowering a peak value of the gain, compared with a case in which only conductive pattern portions having the same radius of curvature of the corners are formed. Changing the reception band includes widening the reception band and changing the reception frequency. For example, in a case where the radius of curvature of the corners is slightly different between adjacent conductive pattern portions, the reception band can be widened without lowering a peak value of the gain. Furthermore, for example, in a case where the difference in the radius of curvature of the corners between adjacent conductive pattern portions is slightly larger, the frequency of electromagnetic waves that are to be received (hereinafter, may be referred to as a 'reception frequency') can be widened to the lower side without lowering a peak value of the gain.

Furthermore, in the invention, it is preferable that a plurality of conductive pattern portions are formed in the pattern layer, and a gap between two adjacent conductive pattern portions varies depending on the position.

According to the invention, the gain can be increased compared with a case in which the gap between two adjacent conductive pattern portions is constant.

Furthermore, in the invention, it is preferable that a frequency of electromagnetic waves used for wireless communication is included in the range of at least 300 MHz and not greater than 300 GHz.

According to the invention, wireless communication can be suitably performed using electromagnetic waves having a frequency of 300 MHz or higher and 300 GHz or lower. The range of 300 MHz or higher and 300 GHz or lower includes a UHF band (300 MHz to 3 GHz), an SHF band (3 GHz to 30 GHz) and an EHF band (30 GHz to 300 GHz).

Furthermore, in the invention, it is preferable that a total thickness is not greater than 50 mm.

According to the invention, the thickness of the sheet member for enabling wireless communication to be suitably performed using electromagnetic waves at a frequency in the range of 300 MHz or higher and 300 GHz or lower can be made as small as possible, and thus the sheet member can be made thinner.

Furthermore, in the invention, it is preferable that the frequency of electromagnetic waves used for wireless communication is included in any one of frequency bands (hereinafter, referred to as a high MHz band) in the range of at least 860 MHz band and less than 1,000 MHz band, and a total thickness is not greater than 15 mm.

According to the invention, the thickness of the sheet member for enabling wireless communication to be suitably performed using electromagnetic waves at a frequency included in a high MHz band can be made as small as possible, and thus the sheet member can be made thinner.

Furthermore, in the invention, it is preferable that the frequency of electromagnetic waves used for wireless communication is included in a 2.4 GHz band, and a total thickness is not greater than 8 mm.

According to the invention, the thickness of the sheet member for enabling wireless communication to be suitably performed using electromagnetic waves at a frequency included in a 2.4 GHz band can be made as small as possible, and thus the sheet member can be made thinner.

Furthermore, in the invention, it is preferable that the storage layer is made of a material in which one or a plurality of materials selected from the group consisting of ferrite, iron alloy, and iron particles are contained as a magnetic material in an amount blended of at least 1 part by weight and not greater than 1500 parts by weight, with respect to 100 parts by weight of an organic polymer.

According to the invention, the storage layer can be provided with a complex relative magnetic permeability ($\mu'$, $\mu''$), and thus a sheet member achieving the above-described effect can be suitably realized.

Furthermore, in the invention, it is preferable that the sheet member for improving communication is flame-resistant.

According to the invention, the sheet member can be flame-resistant. For example, an electronic information transmitting apparatus that performs wireless communication using an antenna element, such as tags, readers, and portable telephones may be required to be flame-resistant. The sheet member can be suitably used also for the application where flame resistance is required.

Furthermore, in the invention, it is preferable that at least one surface portion is glutinous or adhesive.

According to the invention, at least one surface portion is glutinous or adhesive. Thus, the sheet member can be attached to other articles such as the above-described communication jamming member. Accordingly, the sheet member can be easily used.

Moreover, the invention is directed to an antenna device, comprising:

an antenna element that has a resonance frequency matched to a frequency used for wireless communication; and the sheet member for improving communication mentioned above.

According to the invention, the sheet member is disposed between the antenna element and a communication jamming member. Thus, in a state where the antenna device is disposed in the vicinity of a communication jamming member, the antenna device can be used for suitably performing wireless communication using the antenna element, and for transmitting electronic information. In this manner, an antenna device that can be suitably used in the vicinity of a communication jamming member can be realized.

Moreover, the invention is directed to an electronic information transmitting apparatus comprising the antenna device mentioned above.

According to the invention, an electronic information transmitting apparatus can be realized that can suitably perform wireless communication using the antenna device including the antenna element even in a state where the electronic information transmitting apparatus is disposed in the vicinity of a communication jamming member.

Furthermore, the invention is directed to a method of improving communication, comprising:

when performing wireless communication using an antenna element in a vicinity of a communication jamming member having a portion made of a conductive material, providing a sheet member for improving communication comprising a pattern layer in which a conductive pattern portion is formed, the conductive pattern portion resonating with an electromagnetic wave used for wireless communication, storing electromagnetic energy, forming electromagnetic coupling with the antenna element, and transferring the stored electromagnetic energy to the antenna element; and a storage layer that is made of a non-conductive dielectric layer and/or magnetic layer and that collects energy of electromagnetic waves used for wireless communication to pass therethrough, thereby improving a communication distance by wireless communication, and disposing the sheet member between the antenna element and the communication jamming member so that the storage layer is interposed between the pattern layer and the communication jamming member.

BRIEF DESCRIPTION OF DRAWINGS

Other and further objects, features, and advantages of the invention will be more explicit from the following detailed description taken with reference to the drawings wherein.

BEST MODE FOR CARRYING OUT THE INVENTION

Figure 1:
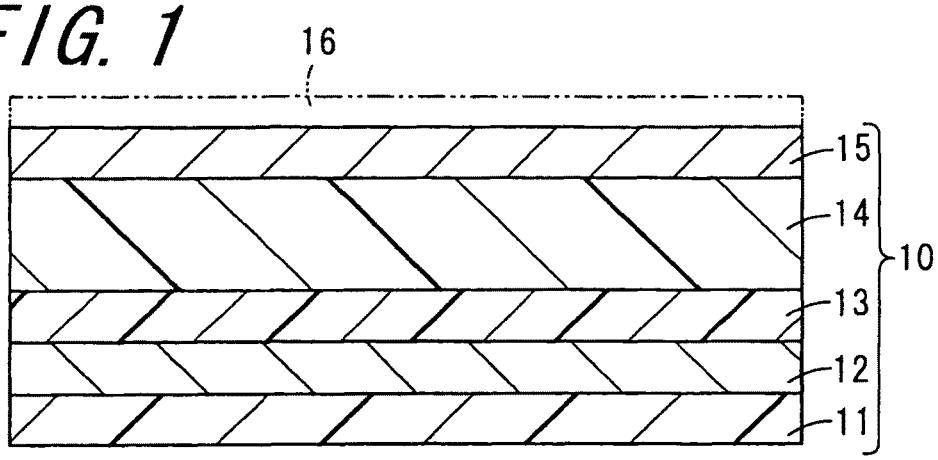
FIG. 1 is a cross-sectional view of a sheet member 10 according to an embodiment of the invention.

Now referring to the drawings, preferred embodiments of the invention are described below.

FIG. 1 is a cross-sectional view of a sheet member for improving communication (hereinafter, referred to as a sheet member) 10 according to an embodiment of the invention. The sheet member 10 is a sheet for suitably performing wireless communication using an antenna element in the vicinity of a communication jamming member, and is disposed between the antenna element and the communication jamming member.

The sheet member 10 is in the shape of a sheet, and has a pattern layer 15, a first storage layer 14, a reflection area forming layer 12, and an attachment layer 11. The sheet member 10 also has a second storage layer 13. The layers 11 to 15 are overlaid in the following order; the pattern layer 15, the first storage layer 14, the second storage layer 13, the reflection area forming layer 12, and then the attachment layer 11, from the electromagnetic wave incident side, which is one side in the thickness direction (overlaid direction) that is the upper side in FIG. 1. The sheet member 10 has this sort of layer configuration. On the electromagnetic wave incident side (the upper side in FIG. 1) of the pattern layer 15, a surface layer 16 that is not a layer reflecting electromagnetic waves, also may be formed. Hereinafter, for facilitating understanding, the storage layers 14 and 13 may be referred to as storage layers.

In this embodiment, essential constituent elements of the sheet member 10 are the pattern layer 15, the storage layers, and the reflection area forming layer 12. The reflection area forming layer 12 may not be included in the sheet member 10 when the sheet member 10 is used in contact with an electromagnetic wave reflecting plate (for example, a metal) having the function of the reflection area forming layer 12. In the pattern layer 15, conductive pattern portions 22 functioning as an antenna are formed. The storage layers are layers containing a non-conductive dielectric layer and/or magnetic layer. The layers have a real number part $\in'$ of the complex relative dielectric constant and/or a real number part $\mu'$ of the complex relative magnetic permeability, and are made of a material in which an imaginary number part $\in''$ of the complex relative dielectric constant and/or an imaginary number part $\mu''$ of the complex relative magnetic permeability, which are loss components of the real number parts, is suppressed to the lowest to the extent possible. The storage layers are positioned in the vicinity of the pattern layer 15. With the real number part $\in'$ of the complex relative dielectric constant and/or the real number part $\mu'$ of the complex relative magnetic permeability, a propagation path of electromagnetic waves that have entered the sheet member 10 can be bent. Furthermore, with a wavelength shortening effect, the conductive pattern portions 22 and the sheet member 10 can be made smaller and thinner. The range of the real number part $\in'$ of the complex relative dielectric constant of the sheet member 10 is 1 to 200 in a communication frequency band. The range of the real number part $\mu'$ of the complex relative magnetic permeability is 1 to 100 in a communication frequency band. Preferably, materials with high $\in'$ and/or high $\mu'$ are positioned close to the conductive pattern portions 22, which makes it easy to obtain a wavelength shortening effect. The storage layer may be either a single layer or multiple layers, and also may contain an air layer. For example, a foam, a resin, paper, an adhesive, a glue, or the like can be used as the storage layer (dielectric layer). For example, the sheet member 10 may have a configuration in which the pattern layer 15, an adhesive layer (high dielectric constant), a foam layer (low loss), and the reflection area forming layer 12 are overlaid in this order. In this configuration, an adhesive containing a dielectric material or the like is used because a wavelength shortening effect from the storage layers can be more easily provided as being closer to the pattern layer 15, and a dielectric material with low loss is used in order to secure the distance between the conductive pattern portions 22 and the reflection area forming layer 12. Thus, communication is improved while the weight is made lighter and the price is made lower. The adhesive layer and the foam layer correspond to the storage layers in the invention. It will be appreciated that the configuration is not limited to this, and various materials can be combined.

The configuration shown in FIG. 1 includes the first and the second storage layers 14 and 13 as the storage layers. The storage members include a member having a dielectric property made of a dielectric material (hereinafter, may be referred to as a 'dielectric member') and a magnetic member made of a magnetic material. The first and the second storage layers 14 and 13 are made of a material that is at least one of a magnetic member having the complex relative magnetic permeability ($\mu'$, $\mu''$) and a dielectric member having the complex relative dielectric constant ($\in'$, $\in''$). Both of the materials may be a magnetic member, both of the materials may be a dielectric member, or one of the materials may be a dielectric member and the other may be a magnetic member. The invention also encompasses the configuration in which the first storage layer 14 that may be either a dielectric member or a magnetic member is used and the second storage layer 13 is not included. In this embodiment, the first storage layer 14 is a magnetic member, and the second storage layer 13 is a dielectric member.

The reflection area forming layer 12 is configured as a conductive film that is formed throughout the entire surface of the second storage layer 13 on the opposite side of the electromagnetic wave incident side, and reflects electromagnetic waves used for wireless communication with a tag main body 54 (described later) that is overlaid on the sheet member 10. The attachment layer 11 is a layer that is glutinous or adhesive and that includes an attachment member for attaching the sheet member 10 to an article. The attachment member includes at least one of a glue and an adhesive, and has a bond strength based on glutinosity or adhesion property. The attachment layer 11 is not essential, and may be omitted. Any configuration may be applied, as long as the constituent elements can be formed into one piece.

Electromagnetic waves that are targeted by the sheet member 10 for suitably performing wireless communication via an antenna element are determined according to the application, but examples thereof include electromagnetic waves at a frequency contained in a high MHz band, more specifically, electromagnetic waves at a frequency in the range of 950 MHz or higher and 956 MHz or lower in Japan. The frequency of the target electromagnetic waves is shown as an example, and the invention also encompasses the configuration in which electromagnetic waves at frequencies other than the frequency shown in the example are targeted.

Furthermore, the sheet member 10 may be used for suitably performing wireless communication using electromagnetic waves at a frequency in a 2.4 GHz band. The 2.4 GHz band has the frequency range of 2400 MHz or higher and lower than 2500 MHz. The electromagnetic waves used in the RFID system are included in the range of 2400 MHz or higher and 2483.5 MHz or lower.

There is no specific limitation on the frequency of the target electromagnetic waves, but the frequency is in the range of 300 MHz or higher and 300 GHz or lower, and any single or multiple frequencies can be selected. The range of 300 MHz or higher and 300 GHz or lower includes a UHF band (300 MHz to 3 GHz), an SHF band (3 GHz to 30 GHz), and an EHF band (30 GHz to 300 GHz).

There is no specific limitation on the thickness of the layers 11 to 15 and the total thickness of the sheet member 10. However, for example, in this embodiment, the thickness of the pattern layer 15 is 100 Å ($1\times10^{-8}$ m) or more and 500 μm or less, the thickness of the first storage layer 14 is 1 μm or more and 5 mm or less, the thickness of the second storage layer 13 is 1 μm or more and 45 mm or less, the thickness of the reflection area forming layer 12 is 100 Å ($1\times10^{-8}$ m) or more and 500 μm or less, the thickness of the attachment layer 11 is 1 μm or more and 1 mm or less, and the total thickness of the sheet member 10 is 3 μm or more and 50 mm or less. The sheet member 10 is formed into a sheet in which the mass per unit area is 0.1 kg/m$^2$ or more and 40 kg/m$^2$ or less. The total thickness of the sheet member 10 is small as described above, and the layers 13 to 16 are made of the above-described materials and are flexible. Accordingly, the shape of the sheet member 10 can be freely changed.

When used for wireless communication in a high MHz band, the total thickness of the sheet member 10 is set to 0.1 mm or more and 15 mm or less, and when used for wireless communication in a 2.4 GHz band, the total thickness of the sheet member 10 is set to 0.1 mm or more and 8 mm or less. With this sort of configuration, the thickness of the sheet member 10 for enabling wireless communication to be suitably performed using electromagnetic waves at a frequency contained in a high MHz band or 2.4 GHz band can be made as small as possible, and thus the sheet member 10 can be made thinner.

In this embodiment, material property values including the complex relative magnetic permeability μ and the complex relative dielectric constant ∈ of the first storage layer 14 are selected, so that electromagnetic waves used for wireless communication are selected. As the real number part μ' of the complex relative magnetic permeability is larger, lines of magnetic force are allowed to more concentratedly pass through, and the propagation path of electromagnetic waves can be bent. As the imaginary number part μ" of the complex relative magnetic permeability and a magnetic permeability loss term tan δμ (=μ"/μ') are smaller, the loss of magnetic field energy becomes smaller. Accordingly, the real number part μ' of the complex relative magnetic permeability is preferably larger, and the imaginary number part μ" of the complex relative magnetic permeability and the magnetic permeability loss term tan δμ are preferably smaller. With a wavelength shortening effect obtained from the magnetic material, the size of the conductive pattern portions and the distance between the pattern layer and the reflection area forming layer are shortened. With a wavelength shortening effect obtained from the dielectric, and the path of electromagnetic waves along the pattern, the distance corresponding to λ/4 (approximately 3 cm, in the case of a 2.4 GHz) is shortened to approximately 1 mm to approximately 8 mm (in the case of a 2.4 GHz band). This case is substantially the same as the case of λ/4 in a space, and can be included in λ/4 in the invention. Furthermore, as the real number part ∈' of the complex relative dielectric constant is larger, lines of electric force are allowed to more concentratedly pass through, and the propagation path of electromagnetic waves can be bent. As the imaginary number part ∈" of the complex relative dielectric constant is smaller, the loss of electric field energy becomes smaller. Accordingly, the real number part ∈' of the complex relative dielectric constant is preferably larger, and the imaginary number part ∈" of the complex relative dielectric constant is preferably smaller. The storage layers are not intended to lose energy, but intended to concentratedly collect energy and allow the energy to pass through without being lost. The sheet member 10 of the invention is different from electromagnetic wave absorbing members in that the loss in the storage layers is preferably smaller.

Furthermore, in the invention, the values of the real number part μ' and the imaginary number part μ" of the complex relative magnetic permeability and the real number part ∈' and the imaginary number part ∈" of the complex relative dielectric constant are values corresponding to the frequency of electromagnetic waves used for wireless communication. As described above, the frequency of electromagnetic waves used for wireless communication may be in the range of 300 MHz or higher and 300 GHz or lower including a UHF band, an SHF band, and an EHF band, and may be in a high MHz band or 2.4 GHz band, for example.

Figure 2:
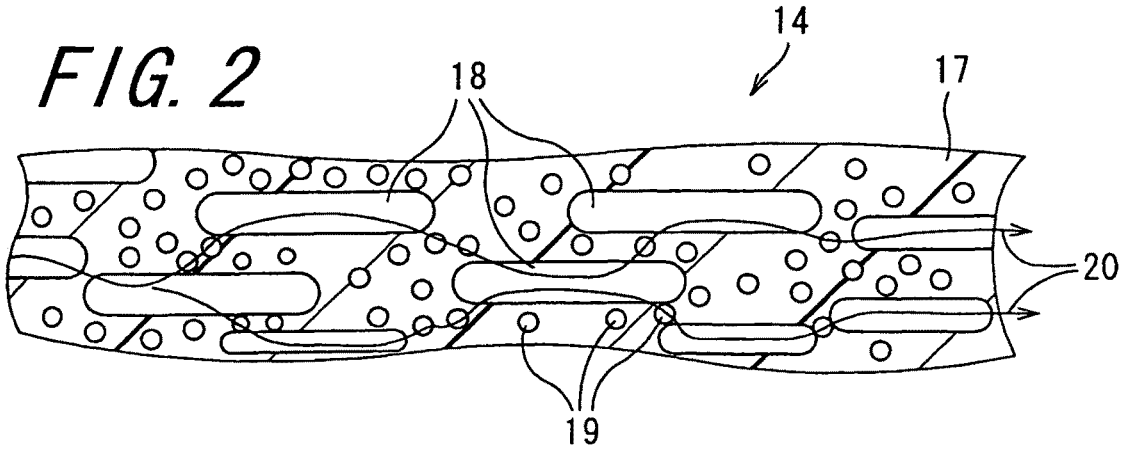
FIG. 2 is an enlarged cross-sectional view showing the internal structure of a first storage layer 14.

FIG. 2 is an enlarged cross-sectional view showing the internal structure of the first storage layer 14. In FIG. 2, for facilitating understanding, hatching of magnetic powders 18 and magnetic fine particles 19 is omitted. In order to obtain the above-described material property values, in the first storage layer 14, powders made of a magnetic material (hereinafter, referred to as 'magnetic powders') 18 and fine particles made of a magnetic material (hereinafter, referred to as 'magnetic fine particles') 19 are mixed in a binder 17. The first storage layer 14 contains the magnetic powders 18 and the magnetic fine particles 19 as magnetic materials. FIG. 2 is shown as an example, and there is no limitation to this. In this embodiment, the binder 17 is made of a polymer, for example, a non-halogen-based polymer, or a non-halogen-based mixture in which a non-halogen-based polymer and another polymer or the like are mixed.

As the binder 17, a halogen-based polymer also can be used. The binder 17 may be made of a material having any material quality, such as a polymer (resin, TPE, rubber) gel, an oligomer, or the like. The material may be either organic or inorganic, and the degree of polymerization or the like of the material does not matter. A non-halogen-based material can be preferably used in view of the environment. In order to form the binder 17 into a sheet, a polymer material is suitable. For example, materials shown below can be preferably used, but materials, blended materials, alloy materials, and the like not shown below also can be used, as long as the material can be formed into a sheet.

As the material of the binder 20, various organic polymer materials can be used, and examples thereof include polymer materials such as rubbers, thermoplastic elastomers, and various plastics. Examples of the rubbers include natural rubbers, as well as synthetic rubbers (used alone) such as a isoprene rubber, a butadiene rubber, a styrene-butadiene rubber, an ethylene-propylene rubber, an ethylene-vinyl acetate-based rubber, a butyl rubber, a chloroprene rubber, a nitrile rubber, an acrylic rubber, an ethylene acrylic rubber, an epichlorohydrin rubber, a fluorine rubber, a urethane rubber, a silicone rubber, a chlorinated polyethylene rubber, and a hydrogenated nitrile rubber (HNBR), derivatives thereof, and rubbers obtained by modifying these rubbers with various types of modification treatment.

These rubbers may be used alone or in combination of a plurality of types. Agents that have been conventionally added to rubbers, such as vulcanizing agents, vulcanization promoters, antioxidants, softeners, plasticizers, fillers, colorants, and the like can be added to these rubbers. In addition to the above, any additive also can be used. For example, in order to control dielectric constant and electrical conductivity, a predetermined amount of dielectric (carbon black, graphite, titanium oxide, etc.) may be added as a material design. Moreover, processing aids (lubricant, dispersant) also may be selectively added as appropriate.

Examples of the thermoplastic elastomers include chlorine-based (e.g., chlorinated polyethylene-based), ethylene copolymer-based, acrylic, ethylene acrylic copolymer-based, urethane-based, ester-based, silicone-based, styrene-based, amide-based, and other various thermoplastic elastomers, and derivatives thereof.

Examples of various plastics include polyethylene, polypropylene, AS resins, ABS resins, polystyrene, chlorine-based resins such as polyvinyl chloride and polyvinylidene chloride, polyvinyl acetate, ethylene-vinyl acetate copolymers, fluorine resins, silicone resins, acrylic resins, nylon, polycarbonate, polyethylene terephthalate, alkyd resins, unsaturated polyester, polysulfone, polyphenylene sulfide resins, liquid crystal polymers, polyamide imide resins, urethane resins, phenol resins, urea resins, epoxy resins, polyimide resins, and other thermoplastic resins or thermosetting resins, and derivatives thereof. As a binder thereof, low-molecular weight oligomer type-binders and liquid type-binders can be used. Any material can be selected, as long as the material can be formed into a sheet with heat, pressure, ultraviolet rays, a curing agent, or the like after molding. In addition to the above, any organic or inorganic material such as ceramics, paper, clay, and the like can be used.

The magnetic powders 18 are flat soft magnetic metal powders. The powders are dispersed so as not to be brought into contact with each other, and arranged so as to extend perpendicularly to the thickness direction of the first storage layer 14. The magnetic powders 18 are substantially in the shape of a disk in which the average thickness is 2 μm, and the average outer diameter in a direction perpendicular to the thickness direction is 55 μm. The magnetic fine particles 19 are fine particles in which the thickness and size are smaller than those of the metal powders. At least the entire outer surface portion of the magnetic fine particles are not conductive, and the electrical conductivity of the magnetic fine particles is low. The average outer diameter of the magnetic fine particles 19 is 1 μm.

As the binder 17 constituting the first storage layer 14, for example, HNBR, which is hydrogenated NBR rubber, is used. The magnetic powders 18 are made of, for example, sendust, which is an alloy of iron, silicon, and aluminum (Fe—Si—Al). Furthermore, the magnetic fine particles are made of, for example, iron oxide (magnetite) that overall suppresses electrical conductivity and has corrosion resistance. The size and the material are shown as an example, and there is no limitation to this.

There is no specific limitation on the material configuration of the first storage layer 14, as long as the complex relative magnetic permeability and the complex relative dielectric constant are appropriate. The binder 17 in which the soft magnetic powders 18 and/or the magnetic fine particles 19 are dispersed as in this example, or magnetic materials (metal oxide, ceramics, granular thin film, ferrite plating, etc.) without any treatment may be used as the first storage layer 14. Examples of soft magnetic powders used as the soft magnetic powders 18 and/or the magnetic fine particles 19 include sendust (Fe—Si—Al alloy), permalloy (Fe—Ni alloy), silicon steel (Fe—Cu—Si alloy), Fe—Si alloy, Fe—Si—B (—Cu—Nb) alloy, Fe—Ni—Cr—Si alloy, Fe—Cr—Si alloy, Fe—Al—Ni—Cr alloy, Fe—Ni—Cr alloy, Fe—Cr—Al—Si alloy, and the like. Furthermore, ferrite or pure iron particles also may be used. Examples of the ferrite include soft ferrite such as Mn—Zn ferrite, Ni—Zn ferrite, Mn—Mg ferrite, Mn ferrite, Cu—Zn ferrite, and Cu—Mg—Zn ferrite, and hard ferrite that is a permanent magnet material. Examples of the pure iron particles include carbonyliron and the like. Preferably, flat soft magnetic powders having high magnetic permeability are used. These magnetic materials may be used alone or in combination of a plurality of types. As the soft magnetic powders, flat soft magnetic powders and non-flat soft magnetic powders (e.g., needle-shaped, fibrous, spherical, or block-shaped powders) may be combined, but at least one of the powders in this combination is preferably flat. The particle size of the soft magnetic powders is 0.1 μm or more and 1000 μm or less, preferably 10 μm or more and 300 μm or less. The aspect ratio of the flat soft magnetic powders is 2 or more and 500 or less, preferably 10 or more and 100 or less. In order to improve corrosion resistance, the surface of the soft magnetic powders may have an oxide film. The surface of the magnetic powders is preferably subjected to surface treatment. The surface treatment may follow a commonly used treatment method in which a coupling agent, a surfactant, or the like is used as the surface treatment agent. Any means (resin coating, dispersant, etc.) can be used in order to improve the wettability between the magnetic powders and the binder.

The first storage layer 14 is made of, or contains, at least one of soft magnetic metal, soft magnetic metal oxide, magnetic metal, and magnetic metal oxide, as the magnetic member. The first storage layer 14 may have the configuration in which at least one of powders and fine particles made of at least one of soft magnetic metal, soft magnetic metal oxide, magnetic metal, and magnetic metal oxide is disposed in the binder 17 as described above, or may be formed into a film including a thin film made of at least one of soft magnetic metal, soft magnetic metal oxide, magnetic metal, and magnetic metal oxide. As the first storage layer 14, for example, magnetic ceramics (ferrite, etc.) may be used without any treatment.

The first storage layer 14 having the configuration in which the magnetic material is dispersed in the binder 17 is made of a material in which one or a plurality of materials selected from the group consisting of ferrite, iron alloy, and iron particles are contained as the magnetic material in an amount blended of 1 part by weight or more and 1500 parts by weight or less, with respect to 100 parts by weight of an organic polymer as the binder 17. The amount of the magnetic material blended with respect to 100 parts by weight of the organic polymer is preferably 10 parts by weight or more and 1000 parts by weight or less. In a case where the amount of the magnetic material blended with respect to 100 parts by weight of the organic polymer is less than 1 part by weight, sufficient magnetic permeability cannot be obtained. In a case where the amount blended is more than 1500 parts by weight, processability becomes poor, and thus the sheet member 10 cannot be produced, or the production become difficult.

In a case where the configuration of the first storage layer 14 is the same, the real number part μ' and the imaginary number part μ" of the complex relative magnetic permeability vary depending on the frequency of target electromagnetic waves, and tend to be smaller as the frequency of target electromagnetic waves becomes higher. In this embodiment, the target electromagnetic waves include electromagnetic waves in a high MHz band and 2.4 GHz band. The real number part μ' and the imaginary number part μ" of the complex relative magnetic permeability tend to be smaller as the frequency of target electromagnetic waves becomes higher. Accordingly, in order to allow electromagnetic waves including electromagnetic waves in a high MHz band and 2.4 GHz band to be collected and pass through, the real number part μ' and the imaginary number part μ" of the complex relative magnetic permeability, in particular, the real number part μ' overall becomes smaller compared with those in the configuration for allowing, for example, electromagnetic waves at low frequency in an approximately 1 to 10 MHz band to be collected and pass through.

In order to increase the real number part μ' of the complex relative magnetic permeability in the first storage layer 14, it is necessary to increase the amount of portion made of a magnetic material in the first storage layer 14. Furthermore, in order to reduce the imaginary number part μ" of the complex relative magnetic permeability, it is possible to reduce the amount of portion made of a non-magnetic material in paths 20 of lines of magnetic force. When the amount of the magnetic powders 18 blended in the first storage layer 14 is simply increased, the amount of portion made of a magnetic material becomes larger, and thus the amount of portion made of a non-magnetic material in the paths of lines of magnetic force can be made smaller. However, in a case where the amount of the magnetic powders 18 blended is increased so significantly that, for example, the conductive magnetic powders 18 are brought into contact with each other, the first storage layer 14 becomes conductive, and a current flows in the first storage layer 14. As a result, conduction is established between the conductive pattern portions and the reflection area forming layer, and thus the performance as an antenna that receives electromagnetic waves is impaired. Accordingly, it is not possible to simply increase the amount of the magnetic powders 18 blended.

In this embodiment, the magnetic fine particles 19 are mixed together with the magnetic powders 18, and thus the magnetic powders 18 are prevented from being brought into contact with each other. Furthermore, since the magnetic fine particles 19 are interposed between the magnetic powders 18, the amount of portion made of a magnetic material can be increased, and the amount of portion made of a non-magnetic material in the paths 25 of lines of magnetic force can be reduced. Accordingly, the above-described complex relative magnetic permeability μ can be obtained for electromagnetic waves in a high MHz band and 2.4 GHz band.

As the first storage layer 14 in another embodiment of the invention, in order to increase the ratio of the magnetic material filled, two types of differently-sized magnetic particles having an average particle size ratio of approximately 4:1 are mixed in the above-described binder 17, and the magnetic fine particles and soft magnetic metal fiber are mixed. Furthermore, in order to secure electric insulation, electrically insulating fine particles are mixed. The two types of magnetic particles are made of the same material as that of the magnetic powders 18, the average particle size of the larger particles is approximately 20 μm, and the average particle size of the smaller particles is approximately 5 μm. The magnetic fine particles and the soft magnetic metal fiber are made of iron-based materials, and the average particle size of the magnetic fine particles and the average fiber size of the soft magnetic metal fiber is approximately 1 μm. The electrically insulating fine particles are made of silicon oxide ($SiO_2$), and has an average particle size of approximately 10 nm. Furthermore, in order to reduce voids in the first storage layer 14 to the extent possible, the first storage layer 14 is designed and produced so that the measured specific gravity value is close to the theoretical specific gravity value based on the blend to the extent possible. Also when applying the above-described configuration instead of the configuration shown in FIG. 2, the resonance frequency at which the imaginary number part μ" of the complex relative magnetic permeability has a peak value is shifted toward the high frequency side. When the frequency is further increased to 5 GHz and to 10 GHz, the first storage layer 14 can be realized in which the real number part μ' of the complex relative magnetic permeability is large at 300 MHz or higher, in particular, in a high MHz band and 2.4 GHz band, and the imaginary number part μ" of the complex relative magnetic permeability is not too large.

The second storage layer 13 can be made of the same material as that of the first storage layer 14. According to the application, materials such as vinyl chloride resins, melamine resins, polyester resins, urethane resins, wood, plaster, cement, ceramics, nonwoven fabric, foam resins, foams, heat insulating materials, paper including flame retardant paper, glass fabrics, and the like can be used, as long as the material is a non-conductive dielectric material. It will be appreciated that dielectric members or magnetic members can be blended as appropriate. The real part ∈' of the complex relative dielectric constant of the second storage layer 13 is selected to be in the range of 1 or more and 50 or less. With this sort of configuration, the dielectric constant of the second storage layer 13 and the sheet member 10 can be freely controlled, and a contribution can be made to realization of smaller conductive pattern portions 22 and a thinner sheet member 10.

At least one surface portion of the sheet member 10 is glutinous or adhesive. In this embodiment, the attachment layer 11 is disposed as described above, and thus the surface portion on the other side in the thickness direction is glutinous or adhesive. With the bond strength due to the glutinosity or adhesion property of the attachment layer 11, the sheet member 10 can be attached to an article. Accordingly, the sheet member 10 can be attached, for example, to a communication jamming member 57, and thus the sheet member 10 can be easily disposed between an antenna element 51 and the communication jamming member 57. The sheet member 10 is disposed so that one side in the thickness direction is disposed on the side of the antenna element 51 and the other side in the thickness direction is disposed on the side of the communication jamming member 57. As the attachment member realizing the attachment layer 11, for example, No. 5000NS (manufactured by Nitto Denko Corporation) is used.

The reflection area forming layer 12 may be metals such as gold, platinum, silver, nickel, chromium, aluminum, copper, zinc, lead, tungsten, iron, or the like, a resin mixture in which powder of the above-mentioned metal or conductive carbon black is mixed in a resin, known conductive ink, or films made of a conductive resin. The above-mentioned metal or the like formed into a plate, a sheet, a film, a nonwoven fabric, a cloth, or the like also can be used. Conductive oxides such as ITO and ZnO also can be used. The configuration also can be applied in which metal foil and glass fabrics are combined. The configuration also can be applied in which a metal layer having a film thickness of, for example, 600 Å is formed on a synthetic resin film. The configuration also can be applied in which conductive ink (electrical conductivity is 5,000 S/m or more) is applied onto a substrate. It is also possible to apply a configuration having mesh or other patterns reflecting electromagnetic waves at a specific frequency.

Using the above-described material constituting the reflection area forming layer 12, the conductive pattern portions 22 of the pattern layer 15 can be formed. Each of the conductive pattern portions 22 is made of, for example, a metal such as silver, aluminum, or the like, and has an electrical conductivity of 5,000 S/m or more. A plate-shaped base 21 is made of, for example, polyethylene terephthalate, and the above-described metal is evaporated thereon, so that the conductive pattern portions 22 are formed. The storage layers 14 and 13 are arranged in the vicinity of the conductive pattern portions 22.

The size of the conductive pattern portions 22 is optimized according to the frequency of the target electromagnetic waves, and the size is determined to be the above-described size. Accordingly, the size is shown as an example, and is determined as appropriate based on the frequency of the target electromagnetic waves. Furthermore, the gap between the conductive pattern portions 22 is determined based on the frequency of the target electromagnetic waves so that the receiving efficiency becomes high. The properties of the storage layer, more specifically, the complex relative dielectric constant or the complex relative magnetic permeability based on the material quality, the thickness, and the like are determined based on the frequency of the target electromagnetic waves so that the receiving efficiency becomes high. In this manner, the size and the gap size of the conductive pattern portions 22 are determined, the storage layers are configured, and electromagnetic waves can be efficiently received.

As another embodiment of the invention, for example, a flame retardant or an auxiliary flame retardant is added to at least one of the pattern layer 15 and the storage layers, and thus the sheet member 10 is flame-resistant, semi-incombustible, or incombustible. For example, a flame retardant or an auxiliary flame retardant is added to the pattern layer 15 or the storage layers. Thus, the sheet member 10 is flame-resistant. Furthermore, at least part of the outer periphery of the sheet member 10 may be covered by a material that is flame-resistant or incombustible. For example, also in the case of electronics apparatuses such as portable telephones, the internal polymer material may be required to be flame-resistant.

There is no specific limitation on the flame retardant for obtaining such flame resistance, but, for example, phosphorus compounds, boron compounds, bromine-based flame retardants, zinc-based flame retardants, nitrogen-based flame retardants, hydroxide-based flame retardants, metal compound-based flame retardants or the like can be used as appropriate. Examples of the phosphorus compounds include phosphoric acid ester and titanium phosphate. Examples of the boron compounds include zinc borate. Examples of the bromine-based flame retardants include hexabromobenzene, hexabromocyclododecane, decabromobenzylphenylether, decabromobenzylphenyl oxide, tetrabromobisphenol, and ammonium bromide. Examples of the zinc-based flame retardants include zinc carbonate, zinc oxide, and zinc borate. Examples of the nitrogen-based flame retardants include triazine compounds, hindered amine compounds, and melamine-based compounds such as melamine cyanurate and melamine guanidine compounds. Examples of the hydroxide-based flame retardants include magnesium hydroxide and aluminum hydroxide. Examples of the metal compound-based flame retardants include antimony trioxide, molybdenum oxide, manganese oxide, chromium oxide, and iron oxide.

In this embodiment, taking the content of the binder as 100 in the weight ratio, when 20 of bromine-based flame retardant, 10 of antimony trioxide, and 14 of phosphoric acid ester are added, the flame resistance corresponding to V0 in UL94 nonflammability test can be obtained. The sheet member 10 preferably can be a material constituting an article, or can be attached to an article. For example, the sheet member 10 can be preferably used, for example, in a state where the sheet member 10 is attached to an article used in a space in which combustion or gas generation resulting from combustion are desired to be prevented, such as apparatuses inside aircrafts, watercrafts, and vehicles.

The sheet member 10 is electrically insulating. Specifically, in a case where each of the layers 14 and 13 is made of the above-described material, the surface resistivity (JIS K6911) of the sheet member 10 is $10^2\Omega/\square$ or more. The surface resistivity of the storage layers is preferably larger. Accordingly, the possible maximum value is the upper limit value of the surface resistivity. In this manner, the sheet member 10 has high surface resistivity, and is electrically insulating.

Furthermore, the sheet member 10 is heat-resistant. Specifically, the sheet member 10 can resist a temperature up to 150° C. in a case where a crosslinking agent is added to a rubber or resin material. The properties of the sheet member 10 do not change at least to a temperature exceeding 150° C. Regarding heat resistance, resistance against a temperature of 150° C. or higher can be provided also by coating at least part of a tag 54, the sheet member 10, the antenna element, and an IC chip with ceramics or a heat resisting resin (for example, a polyphenylene sulfide resin to which $SiO_2$ fillers have been added). In the case of ceramics coating, complete sintering or partial sintering may be performed, or sintering may not be performed.

In another embodiment of the invention, the configuration also may be applied in which the sheet member 10 in the embodiment shown in FIG. 1 does not include the reflection area forming layer 12. Even in the configuration in which the reflection area forming layer 12 is not included, a similar effect can be obtained by arranging the sheet member 10 on a face of an object that has a portion made of a conductive material. In the configuration in which the reflection area forming layer 12 is used, the influence of the arrangement position of the sheet member 10, that is, the type or the like of materials constituting a communication jamming member can be prevented from changing the resonance frequency of the conductive pattern portions 22 and changing the receiving properties of the sheet member 10. Thus, the communication conditions using the antenna element 51 can be prevented from being changed, and the communication conditions using the antenna element 51 can be stabilized. For example, even when the sheet member 10 is disposed inside interior materials of buildings, the receivable frequency can be prevented from being changed by the influence of the complex relative dielectric constant or the like of the interior materials.

As the conductive pattern portions used in the invention, conductive pattern portions may be non-continuously arranged, or slots (holes) may be formed in a conductive layer. There is no limitation on the shape of the pattern portions. Any shape can be applied such as a single or a plurality of circles, rectangles, lines, polygons, strings, irregular shapes, or a combination thereof, as long as the shape can realize the function as an antenna.

Figure 3:
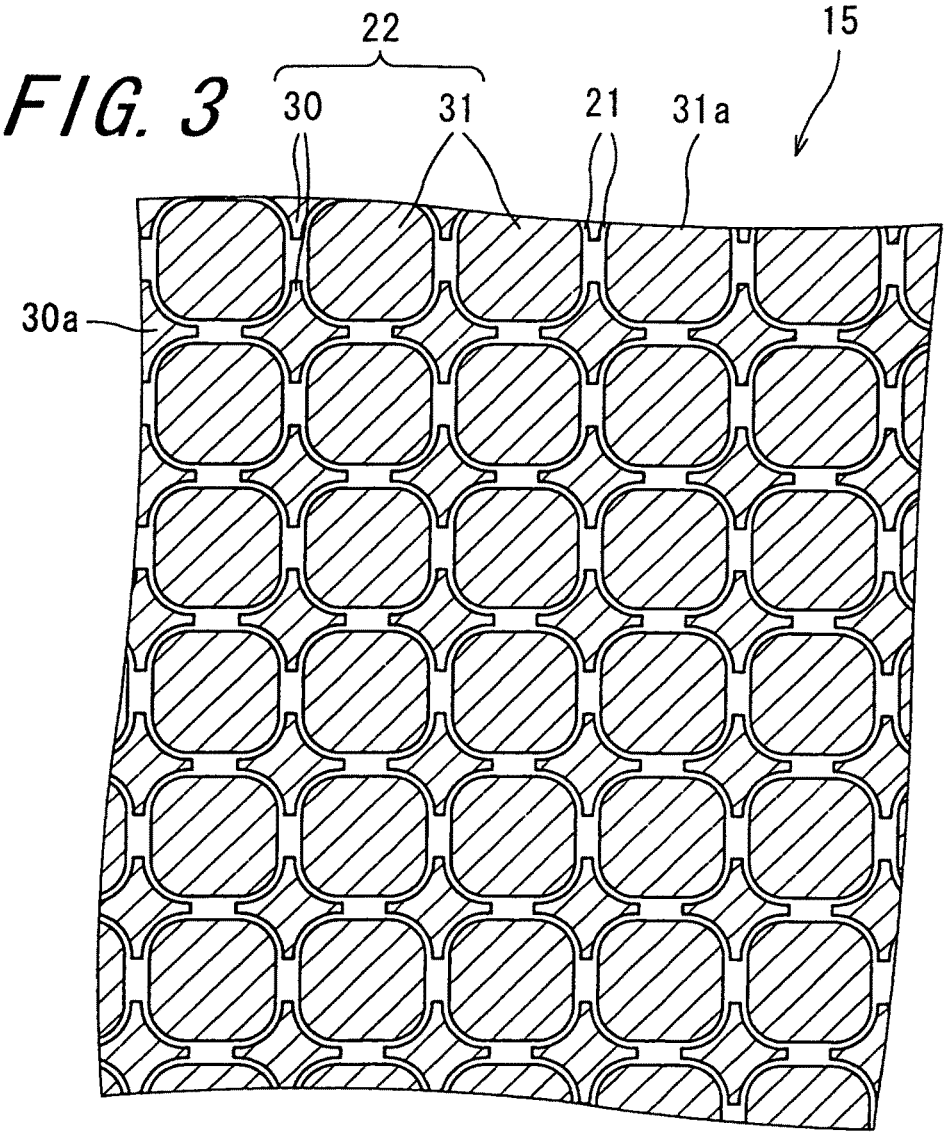
FIG. 3 is a front view showing a pattern layer 15 constituting the sheet member 10 according to an embodiment of the invention.
Figure 4:
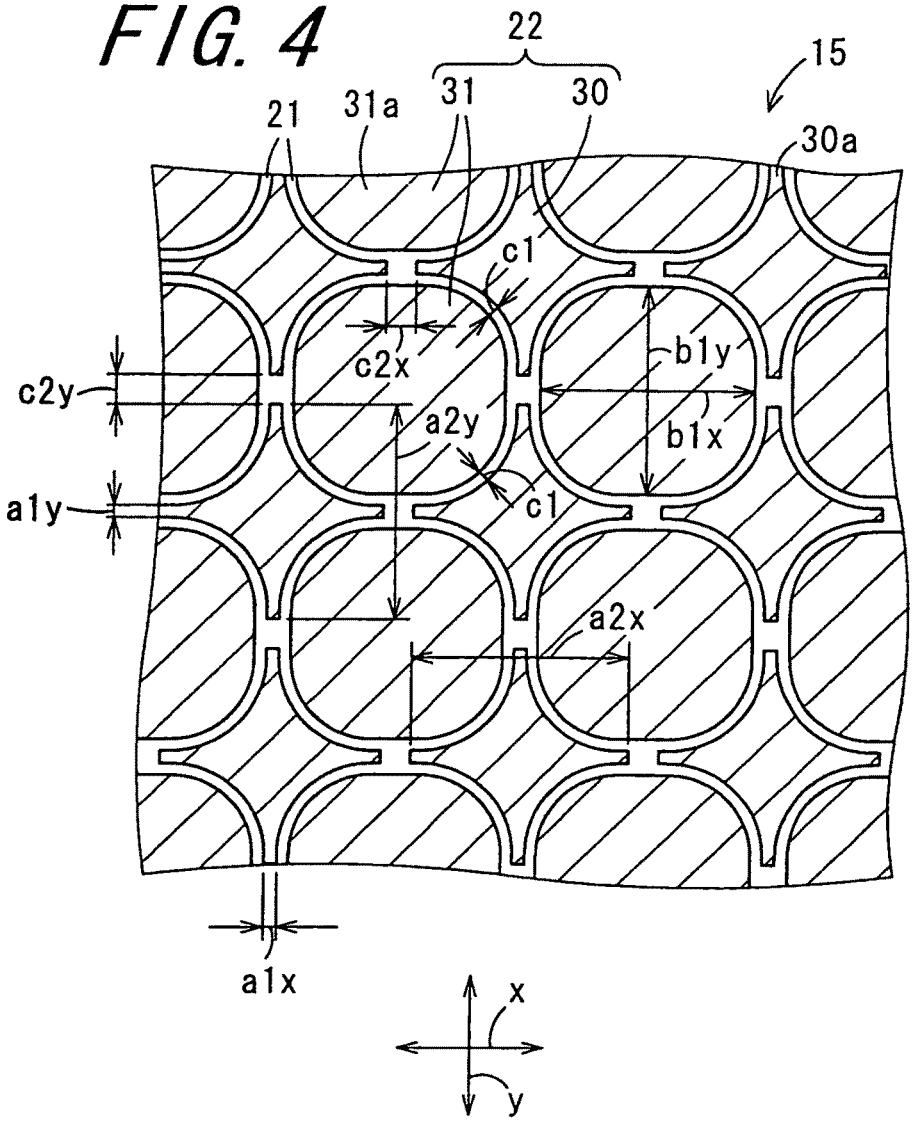
FIG. 4 is an enlarged front view of a part of the pattern layer 15 in the embodiment shown in FIG. 3.
Figure 5:
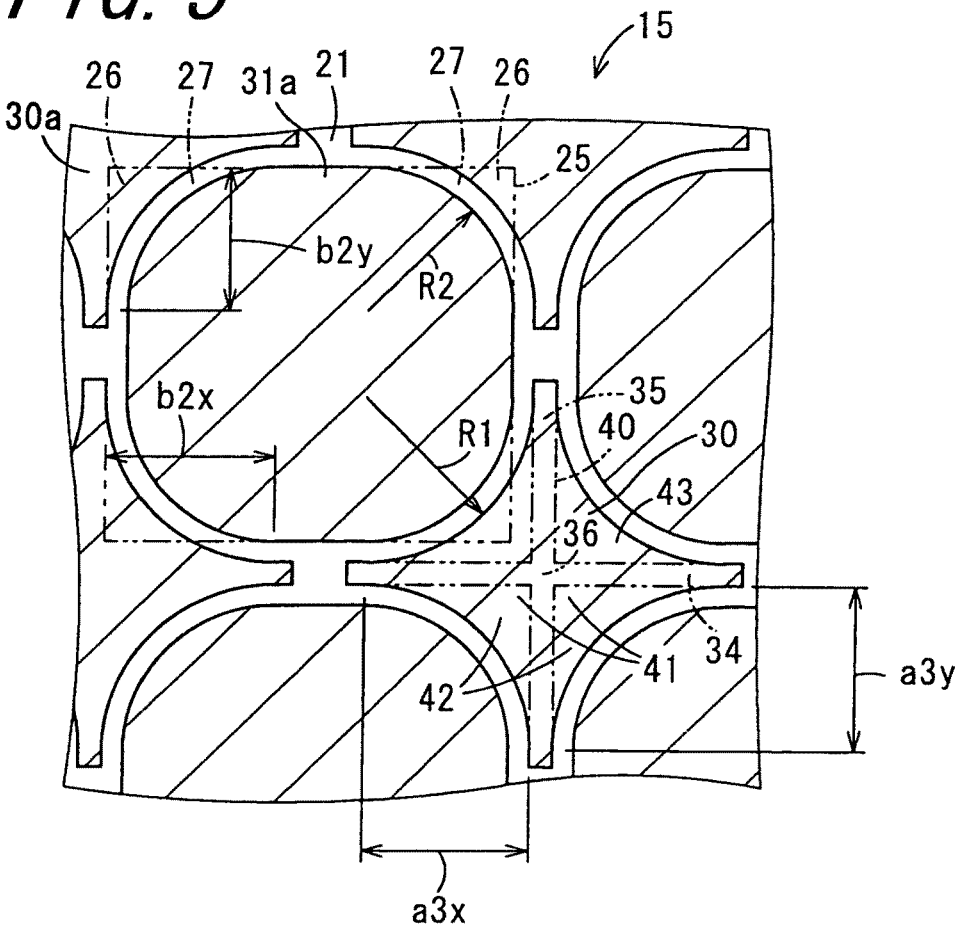
FIG. 5 is an enlarged front view of a part of the pattern layer 15 in the embodiment shown in FIG. 3.

FIG. 3 is a front view showing the pattern layer 15 constituting the sheet member 10 according to an embodiment of the invention. FIGS. 4 and 5 are enlarged front views of part of the pattern layer 15 in the embodiment shown in FIG. 3. In the pattern layer 15, the conductive pattern portions 22 are formed on the surface of the plate-shaped base 21 on the electromagnetic wave incident side. The plate-shaped base 21 is, for example, a dielectric made of a synthetic resin, and the plate-shaped base 21 also functions as a dielectric member. The conductive pattern portions 22 have radial pattern portions 30 and rectangular pattern portions 31. The plate-shaped base 21 electrically insulates the conductive pattern portions 22 from each other. In FIGS. 3, 4, and 5, for facilitating understanding, the conductive pattern portions 22 are hatched with diagonal lines.

The radial pattern portion 30 is formed into a radial shape, and a plurality of radial pattern shapes 30*a* are spaced away from each other by gaps (hereinafter, referred to as 'radial pattern gaps') c2*x* and c2*y*. More specifically, for example, in this embodiment, the radial pattern shapes 30*a* are formed in the shape of crosses radially extending in the x direction and the y direction that are perpendicular to each other, and regularly arranged in a matrix in which the radial pattern gap c2*x* is interposed in the x direction and the radial pattern gap c2*y* is interposed in the y direction.

The radial pattern shape 30*a* has a shape in which four corners 41 in an intersecting portion 36 are formed into curves, more specifically, arcs, based on a cross 40 indicated by the virtual line in FIG. 5. The cross 40 functioning as the base (hereinafter, referred to as a base cross) has a shape in which a rectangular shape portion 34 linearly extending in the x direction and a rectangular shape portion 35 linearly extending in the y direction intersect each other at right angles at the intersecting portion 36 so that the centroids of the shape portions 34 and 35 are overlapped. The shape portions 34 and 35 are displaced from each other by 90° about an axis perpendicular to the intersecting portion 36, and have the same shape. Four substantially triangular portions 42, that are right-angled isosceles triangles in which the oblique side opposing the right-angled corner is in the shape of an arc recessed toward the right-angled corner, are arranged on this base cross 40 so that the right-angled corners are accommodated in the respective corners 41 of the intersecting portion 36 in the base cross 40.

In a case where the frequency of the target electromagnetic waves is in a 2.4 GHz band, for example, the radial pattern shape 30*a* has a size in which widths a1*x* and a1*y* of the shape portions 34 and 35 are the same, for example, 1.0 mm, and lengths a2*x* and a2*y* of the shape portions 34 and 35 are the same, for example, 25.0 mm. The sizes of the arc at the arc-shaped corner, that is, the lengths of the sides excluding the oblique side of the substantially triangular portion 42, more specifically, a length a3*x* of the side in the x direction and a length a3*y* of the side in the y direction are the same, for example, 11.5 mm, and the radius of curvature R1 of the oblique side is 11.5 mm. Regarding the radial pattern gaps, the gap c2*x* in the x direction and the gap c2*y* in the y direction are the same, for example, 4.0 mm.

A rectangular pattern shape 31*a* is disposed in a region enclosed by the radial pattern shapes 30*a* so as to be spaced away from the radial pattern shapes 30*a* by a gap (hereinafter, referred to as a 'radial-rectangular portion gap') c1 so that the rectangular pattern shape 31*a* covers the region enclosed by the radial pattern shapes 30*a*. More specifically, the rectangular pattern shapes 31*a* are formed into a shape corresponding to the region enclosed by the radial pattern portions. More specifically, for example, in this embodiment, the radial pattern portion 30 is in the shape of a cross as described above, and the region enclosed by the radial pattern shapes 30*a* is substantially in the shape of a rectangle based on a rectangle. The shape corresponding thereto, that is, the radial-rectangular portion gap c1 has the same shape throughout the entire periphery. In a case where the shape portions 34 and 35 have the same shape as described above, the region enclosed by the radial pattern shapes 30*a* is substantially in the shape of a square based on a square, and the rectangular pattern shapes 31*a* are substantially in the shape of a square based on a square 25. The rectangular pattern shapes 31*a* are arranged so that the side portions of the square functioning as the base (hereinafter, referred to as a base square) 25 extend in either the x direction or the y direction.

The rectangular pattern shapes 31*a* are substantially in the shape of a rectangle in which four corners 26 are formed into curves, more specifically, arcs, based on the base square 25. More specifically, four substantially triangular portions 27, that are right-angled isosceles triangles in which the oblique side opposing the right-angled corner is in the shape of an arc recessed toward the right-angled corner, are removed from the base square 25 so that the right-angled corners are accommodated in the respective corners 26 of the square.

In a case where the frequency of the target electromagnetic waves is in a 2.4 GHz band, for example, the rectangular pattern shape 31*a* has a size in which a size b1*x* in the x direction and a size b1*y* in the y direction of the base square 25 are the same, for example, 25.0 mm. The sizes of the arc at the arc-shaped corner, that is, the lengths of the sides excluding the oblique side of the substantially triangular portion 27, more specifically, a length b2*x* of the side in the x direction and a length b2*y* of the side in the y direction are the same, for example, 10.0 mm, and the radius of curvature R2 of the corners is 10.0 mm. Regarding the radial-rectangular portion gap, a gap c1*x* in the x direction and a gap c1*y* in the y direction are the same, for example, 4.0 mm.

In this manner, the radial pattern shapes 30*a* and the rectangular pattern shapes 31*a* are conductive pattern portions substantially based on polygons, having a substantially polygonal outer shape in which at least one corner is curved. In this sort of pattern, a resonance current when receiving electromagnetic waves smoothly flows at the curved corners.

Furthermore, the radial pattern shapes 30*a* and the rectangular pattern shapes 31*a* are not in the shape of a strip (belt) forming a closed loop extending along the outer peripheral edge of the shapes, but are a planar pattern in which the inner portion is also covered. Accordingly, a capacitor can be formed between the pattern layer 15 and the reflection area forming layer 12.

With this sheet member 10, the pattern layer 15 makes it possible for electromagnetic waves at the resonance frequency of the conductive pattern portions 22 to be efficiently received. The resonance frequency of the sheet member 10 is first specified according to the length and the peripheral length of the conductive pattern portions 22. Since electromagnetic waves are received so as to be resonated with electromagnetic waves at a specific frequency, the resonance length is determined according to, for example, the length of ½ or ¼ of the wavelength of the electromagnetic waves at the specific frequency. Here, the final resonance frequency is determined not only according to the pattern size but also according to the binding properties between the conductive pattern portions 22, a wavelength shortening effect resulting from the real part ∈' of the complex relative dielectric constant or the real part μ' of the complex relative magnetic permeability of the first and the second storage layers 14 and 13, and a wavelength shortening effect resulting from the real part ∈' of the complex relative dielectric constant of the surface layer 16 and the influence of input impedance determined based on the first and the second storage layers 14 and 13 in a case where the surface layer 16 is additionally disposed. This resonance frequency is substantially the same as the frequency used for wireless communication in the antenna element 51 described later.

When the sheet member 10 is used according to the size corresponding to the tag main body 54 (described later), at least one of the radial pattern shapes 30*a* and the substantially rectangular pattern shapes 31*a* may be contained only partially in the conductive pattern portions 22. In this case, the resonance frequency is shifted toward the high frequency side according to the downsizing of the pattern shape, that is, the partial shape of the radial pattern shapes 30*a* and the partial shape of the substantially rectangular pattern shapes 31*a* contained in the conductive pattern portions 22.

Figure 6:
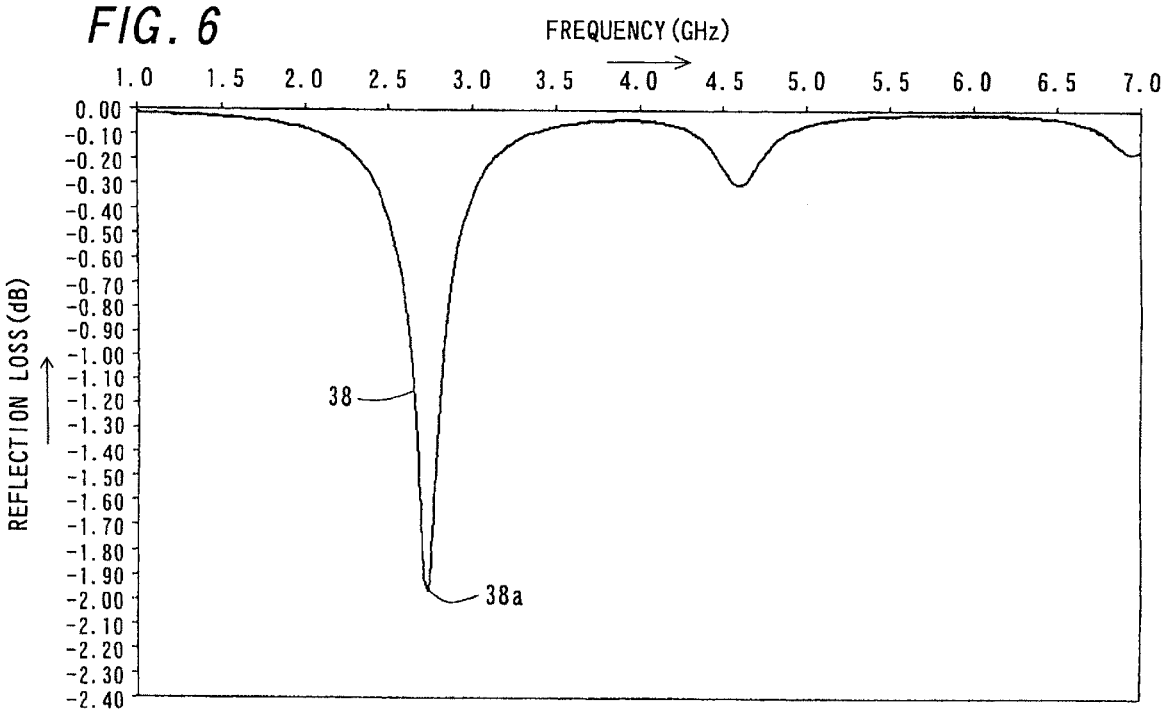
FIG. 6 is a graph showing a calculation result obtained with a simulation of the resonance frequency that is changed by the influence of cutting of conductive pattern portions 22.
Figure 7:
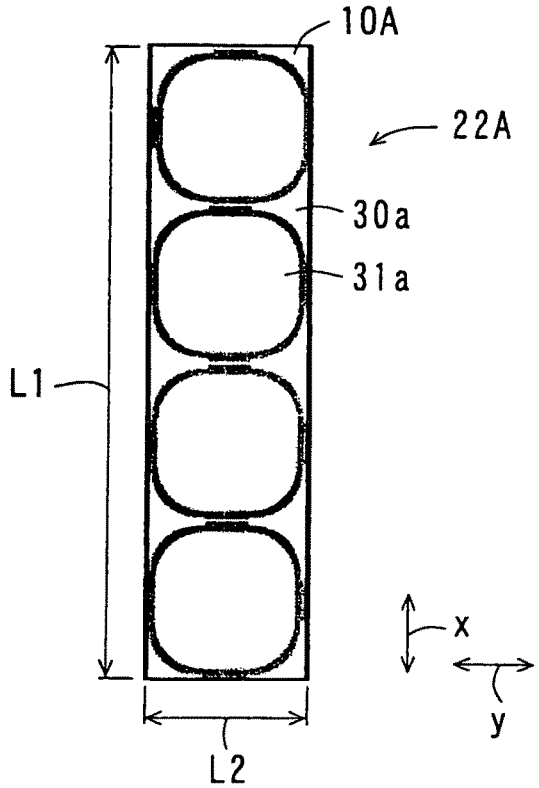
FIG. 7 is a front view showing a pattern shape of the conductive pattern portion 22 of the sheet member 10 used in the simulation.

FIG. 6 is a graph showing a calculation result obtained with a simulation of the resonance frequency that is changed by the influence of cutting of the conductive pattern portions 22. FIG. 7 is a front view showing the pattern shape of the conductive pattern portion 22 of the sheet member 10 used in the simulation. In FIG. 7, the horizontal axis represents the frequency, and the vertical axis represents the reflection loss. The reflection loss refers to the loss from a point of view in which electromagnetic waves that are incident on the sheet member 10 are reflected by the sheet member 10, and has a value corresponding to the amount of electromagnetic waves received in the sheet member 10. The reflection loss is represented by a negative value, and the absolute value of the reflection loss is the amount of electromagnetic waves received. That is to say, the reflection loss functions as an indicator in evaluation of the properties as an antenna. It is indicated that, as the value of the reflection loss is smaller, the efficiency of the sheet member 10 in receiving electromagnetic waves is higher. The reflection loss amount in the invention is calculated using a computer simulation. The simulation follows the TLM method and is performed using a 'Micro-Stripes' manufactured by Flomerics. In the calculation, the material constants of the first storage layer 14, for example, in a 2.4 GHz band were set so that the real part ∈' of the complex relative dielectric constant=12.3, the imaginary part ∈" of the complex relative dielectric constant=1.3, the real part μ' of the complex relative magnetic permeability=1.3, the imaginary part μ" of the complex relative magnetic permeability=0.5, and the thickness=0.5 mm. The material constants of the second storage layer 13, for example, in a 2.4 GHz band were set so that ∈'=4.6, ∈"=0.1, and the thickness=2.0 mm. In the simulation, the correspondence between the frequency and the reflection loss in a state where the sheet member 10 was overlaid on a metal plate was calculated.

In the conductive pattern portion 22 on which the pattern layer 15 used in the simulation was based, a1*x*=a1*y*=1.0 mm, a2*x*=a2*y*=17.5 mm, a3*x*=a3*y*=7.5 mm, c1*x*=c1*y*=1.5 mm, c2*x*=c2*y*=7.0 mm, b1*x*=b1*y*=20.5 mm, c1*x*=c1*y*=1.5 mm, R1=7.5, and R2=7.0 mm. Furthermore, a size L1 in the longer-side direction (the x direction) and a size L2 in the shorter-side direction (the y direction) perpendicular to the overlaid direction of the sheet member 10 were set so that L1=80 mm and L2=20 mm.

Two types of pattern shape formed by cutting part of the conductive pattern portion 22 of the sheet member 10 used in the simulation are respectively taken as a first pattern shape 22A and a second pattern shape 22B, the sheet member 10 in which the first pattern shape 22A is formed is taken as a first sheet member 10A, and the sheet member 10 in which the second pattern shape 22B is formed is taken as a second sheet member 10B.

FIG. 7 is a front view of the first sheet member 10A. The first pattern shape 22A includes, among the conductive pattern portions 22, the substantially rectangular pattern shapes 31*a* and part of the radial pattern shapes 30*a* in a portion enclosed by a rectangle defined by two sides that pass through the centroids of the radial pattern shapes 30*a* and that are parallel to the x direction and two sides that pass through the centroids of the radial pattern shapes 30*a* and that are parallel to the y direction. The first pattern shape 22A is arranged in a line in the x direction, and includes four substantially rectangular pattern shapes 31*a* that respectively have centroids arranged at the center in the y direction and part of the radial pattern shapes 30*a* that are arranged around the substantially rectangular pattern shapes 31*a*.

In FIG. 6, a solid line 38 represents the frequency-reflection loss properties of the first sheet member 10A. The conductive pattern portions 22 of the sheet member 10 are designed so that the frequency at which the reflection loss has a peak value (resonance frequency) corresponds to a 2.4 GHz band, but the resonance frequency of the first sheet member 10A after cutting of the samples is shifted toward the frequency side higher than a 2.4 GHz band. This resonance frequency is the frequency of the sheet member 10 alone before the antenna element 51 is attached.

In FIG. 6, the resonance frequency of the first sheet member 10A does not match a 2.4 GHz band, but the 2.4 GHz band is included in a portion around a resonance peak 38A at which the reflection loss is large, that is, the reflection loss in the 2.4 GHz band is large. Thus, it is seen that the first sheet member 10A has an ability to collect (an ability to collect and supply) electromagnetic waves at a frequency in a 2.4 GHz band. This fact shows that, although the resonance frequency of the sheet member 10 does not completely match the targeted 2.4 GHz band, the sheet member 10 can function as a sending and receiving antenna in which the influence of a metal face and the like is suppressed and a booster antenna that is to supply electromagnetic waves to the antenna element 51, after the resonance frequency is adjusted by reactance matching or the like.

When the antenna element 51 is mounted on the sheet member 10, the resonance frequency may be further shifted, but this problem can be dealt with, by adjusting the distance between the antenna element 51 and the sheet member 10, adjusting the dielectric constant and the magnetic permeability, or adjusting the method for cutting the conductive pattern portions 22 and the size of the antenna element 51. For example, a foam, resin, paper, or the like with an appropriate thickness can be interposed between the antenna element 51 and the sheet member 10, using an adhesive or glue.

When the sheet member 10 has the above-described layer configuration, the receiving efficiency of electromagnetic waves can be increased, and thus a large gain as the function of an antenna can be obtained, and the sheet member 10 can be made thinner and lighter.

Furthermore, in the conductive pattern portion 22, the radial pattern shapes 30*a* are arranged so that radially extending portions face each other as described above, and the rectangular pattern shapes 31*a* are formed into a shape corresponding to the region enclosed by the radial pattern shapes 30*a*. In this arrangement, the receiving efficiency is optimized (increased) by combining the radial pattern portions 30 and the rectangular pattern portions 31 having different receiving principles (the radial patterns function as dipole antennas, and the rectangular patterns function as patch antennas). Accordingly, the sheet member 10 having high receiving efficiency can be realized. Furthermore, the radial pattern shape 30*a* is radially disposed in the x direction and the y direction, and the side portions of a square on which the rectangular pattern shape 31*a* is based is disposed so as to extend in the x direction and the y direction. Thus, the receiving efficiency of electromagnetic waves polarized so that the direction of the electric field is in the x direction and the y direction can be increased.

In the sheet member 10, the conductive pattern portions 22 that receive electromagnetic waves have a substantially polygonal outer shape that is basically in the shape of a polygon, and thus a peak value of the gain can be increased compared with a case in which the outer shape of the conductive pattern portions 22 is circular. In this manner, the shape is basically polygonal, and at least one corner is curved. Thus, shift of the frequency at which the gain has a peak according to the direction in which electromagnetic waves are polarized can be suppressed low. Accordingly, excellent receiving properties can be obtained in which a peak value of the gain is high, and shift of the frequency at which the gain has a peak value according to the direction in which electromagnetic waves are polarized is small.

The sheet member 10 uses the conductive pattern portions 22 of the pattern layer 15 to receive electromagnetic waves at a specific frequency following the resonance principle of an antenna. In other words, in the sheet member 10 of the invention, the conductive pattern portions 22 function to effectively operate also as a receiving antenna. Herein, the specific frequency is a frequency determined according to factors such as the shape and the size of the conductive pattern portions 22. When electromagnetic waves are received by the conductive pattern portions 22, a resonance current flows at the end portions of the conductive pattern portions 22, and an electromagnetic field is generated around the peripheral edge portions of the conductive pattern portions 22. In the sheet member 10, electromagnetic waves at a specific frequency are concentrated at the interior of the sheet member due to resonance.

Furthermore, when the sheet member 10 is used in an overlaid state in which the storage layers are interposed between the pattern layer 15 and the conductive layer, a capacitor or an inductor can be formed between the conductive pattern portions 22 of the pattern layer 15 and the conductive layer. In this embodiment, the conductive layer is the reflection area forming layer 12. In another embodiment in which the reflection area forming layer 12 is not included, the conductive layer is a surface layer of an object made of a conductive material. In a case where the distance between the conductive pattern portions 22 and the conductive layer is reduced, the capacity of the capacitor can be increased. Also, a capacitor can be formed between the conductive pattern portions 22. As a capacitor, electromagnetic energy at a specific frequency can be stored. When a capacitor or the like is used, a function to adjust reactance is provided, and thus the sheet member 10 can be made thinner. Thus, electromagnetic energy corresponding to a specific frequency can be accumulated in the sheet member 10. Electromagnetic energy is apparently accumulated, but the sheet member 10 actually allows captured electromagnetic energy to continuously pass through. The sheet member 10 plays a role to highly effectively re-radiate electromagnetic waves at a specific frequency at the conductive pattern portions 22 functioning as a high-performance small antenna, to cause the electromagnetic waves to be interfered with incident waves thereby forming a region having high electric field intensity, and to transfer the energy by electromagnetic coupling to the antenna element 51 (described later).

Figure 8:
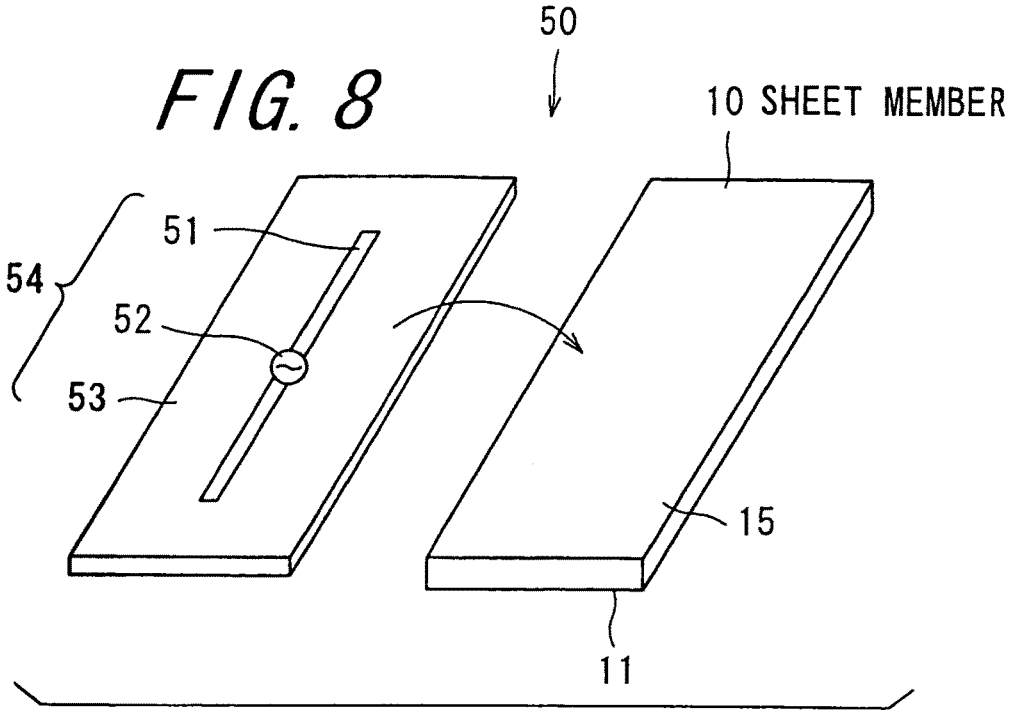
FIG. 8 is an exploded perspective view showing a tag 50 including the sheet member 10.

FIG. 8 is an exploded perspective view showing the tag 50 including the sheet member 10. The tag 50 is one of electronic information transmitting apparatuses that transmit information by wireless communication, and is used, for example, as a transponder of an RFID (Radio Frequency IDentification) system used for automatically recognizing a solid matter. The tag 50 includes the antenna element 51, an integrated circuit (hereinafter, referred to as an 'IC') 52 that is electrically connected to the antenna element 51 and that functions as communication means for performing communication using the antenna element 51, and the sheet member 10. In the tag 50, at the time when the antenna element 51 receives a request signal from a reader, the antenna element 51 sends signals indicating information stored in the IC 52. Accordingly, the reader can read information held in the tag 50. For example, the tag 50 is attached to a product, and used for management of products such as prevention of product theft or recognition of inventory status. An antenna device includes the antenna element 51 and the sheet member 10. The tag 50 is an electronic information transmitting apparatus that uses the antenna element 11 to send and receive electromagnetic wave signals, and is a battery-less tag that returns electromagnetic wave signals using the energy of the received electromagnetic wave signals. The tag 50 may be a battery-less tag, or may be a battery-equipped battery tag.

The antenna element 51 functioning as antenna means is at least an electric field-type antenna element, is a dipole antenna, a loop antenna, or a monopole antenna, and is realized as a dipole antenna in this embodiment. In another embodiment of the invention, the antenna element 51 may be realized as another antenna. In a case where a dipole antenna and the sheet member 10 are combined, the antenna element 51 can be made smaller. With the level of the real number part $\mu'$ of the complex relative magnetic permeability and the real number part $\in'$ of the complex relative dielectric constant of the sheet member 10, together with the wavelength shortening effect, the antenna element 51 can be made smaller. The dipole antenna is linear, and may have curve and bent portions. It is sufficient that the total length is $\lambda/2$. For example, in the case of 950 MHz, the length is approximately 15.8 cm. When a wavelength shortening effect obtained from the sheet member 10 is applied to this configuration, a linear element having a size of approximately 3 to 10 cm can be realized. When the element is curved or bent, the size allowing accommodation in a label of 2 to 3 cm can be realized. The element can be made further smaller, and thus the element can be attached to a wide range of targets. Since a monopole antenna supplies electricity between an element on one side of a dipole antenna and a ground plate, the total length of the element can be as small as $\lambda/4$. In the case of a loop antenna, when the circumferential length is close to one wavelength, the structure becomes similar to that in which two half-wavelength dipole antennas are arranged side by side, and thus this loop antenna can be regarded as an electric field-type antenna element. The antenna element of the invention includes an antenna element in which the type is switched between an electric field-type and a magnetic field-type, and an antenna element in which electric field-type and magnetic field-type functions are together provided, as long as the antenna element is not of completely magnetic field-type. Furthermore, the antenna element of the invention also includes an antenna element on which a reactance structure portion is mounted.

The antenna element 51 is realized as a pattern conductor that is formed on a surface portion of a base 53 (made of polyethylene terephthalate (PET)) on one side in the thickness direction. The IC 52 is disposed, for example, at the center portion of the antenna element 51, and is electrically connected to the antenna element 51. The IC 52 has at least a storage portion and a control portion. Information can be stored in the storage portion, and the control portion can store information in the storage portion or read information from the storage portion. In response to a command indicated by electromagnetic wave signals received by the antenna element 51, the IC 52 stores information in the storage portion or reads information stored in the storage portion, and gives signals indicated by the information to the antenna element 51. The base 53 is in the shape of a rectangular plate, and the antenna element 51 is disposed at the center portion of the base 53 so as to extend in the longer-side direction. The layer thickness of the antenna element 51 and the IC 52 is 1 nm or more and 500 μm or less, and the layer thickness of the base 53 is 0.1 μm or more and 2 mm or less. The configuration without a base also can be applied in which the antenna element 51 is directly printed or formed by treatment on the sheet member 10.

The antenna element 51, the IC 52, and the base 53 constitute the tag main body 54. The tag main body 54 is packaged so that the tag main body 54 is, for example, mounted on a flexible adhesive tape. The tag main body 54 and the sheet member 10 constitute the tag 50. FIG. 8 is an exploded view of the tag main body 54 and the sheet member 10, but the tag main body 54 is overlaid on the sheet member 10 so that the surface portion having the antenna element 51 opposes one surface of the sheet member 10 (one surface of the pattern layer 15 in this embodiment). The surface of the antenna element 51 is covered by a polyethylene terephthalate insulating film having a thickness of 25 μm, and thus the antenna element 51 is insulated from the conductive pattern portions 22. Although not shown in FIG. 8, a glue and an adhesive may be used between the tag main body 54 (that may not include the base 53) and the sheet member 10, or one or both of the tag main body 54 and the sheet member 10 may be glutinous or adhesive so that these layers are attached to each other. The sheet member 10 is in the form of a rectangular plate, and is overlaid on tag main body 54 to form the tag 50 in the shape of a rectangular plate.

There is no specific limitation on the binding structure between the sheet member 10 and the tag main body 54, but these layers may be bound to each other using a binding agent including a glue and an adhesive. In an area having an intensive electric field formed near the surface of the sheet member 10, the sheet member 10 and the antenna element 51 are overlaid in a non-conduction state, that is, overlaid via an electrically insulating non-conductive layer (that also may be a dielectric layer or magnetic layer). Regarding the distance between the sheet member 10 and the antenna element 51, the optimum position can be determined according to the communication properties of the antenna element 51. In FIG. 8, the configuration for binding the sheet member 10 and the tag main body 54 is omitted. In the tag 50, the layer of the base 53, the layer of the antenna element 51 and the IC 52, the tag main body adhesive layer, the pattern layer 15, the first storage layer 14, the second storage layer 13, the reflection area forming layer 12, and the attachment layer 11 are overlaid in this order from one side in the thickness direction to the other side.

The antenna element 51 can send electromagnetic wave signals in a direction intersecting the direction in which the antenna element 51 extends, and receive electromagnetic wave signals arriving from the direction intersecting the direction in which the antenna element 51 extends. In this embodiment, electromagnetic wave signals can be sent in a sending and receiving direction A that is oriented to the side farther from the sheet member 10 than the antenna element 51, and electromagnetic wave signals arriving from the sending and receiving direction A can be received.

In the tag 50, for example, at the time when the antenna element 51 receives an electromagnetic wave signal indicating predetermined information that is to be stored (hereinafter, referred to as 'main information') and information to give a command to store the main information (hereinafter, referred to as 'storage command information') from an information management apparatus that is a reader writer, an electrical signal indicating the main information and the storage command information is given from the antenna element 51 to the IC 52. In the IC 52, the control portion stores the main information in the storage portion based on the storage command information.

Furthermore, at the time when the antenna element 51 receives an electromagnetic wave signal indicating information (hereinafter, referred to as 'sending command information') to give a command to send information stored in the storage portion (hereinafter, referred to as 'stored information') from the information management apparatus, an electrical signal indicating the sending command information is given from the antenna element 51 to the IC 52. In IC 52, the control portion reads the information stored in the storage portion (stored information), and gives an electrical signal indicating the stored information to the antenna element 51, based on the sending command information. Thus, an electromagnetic wave signal indicating the stored information is sent from the antenna element 51.

Figure 9:
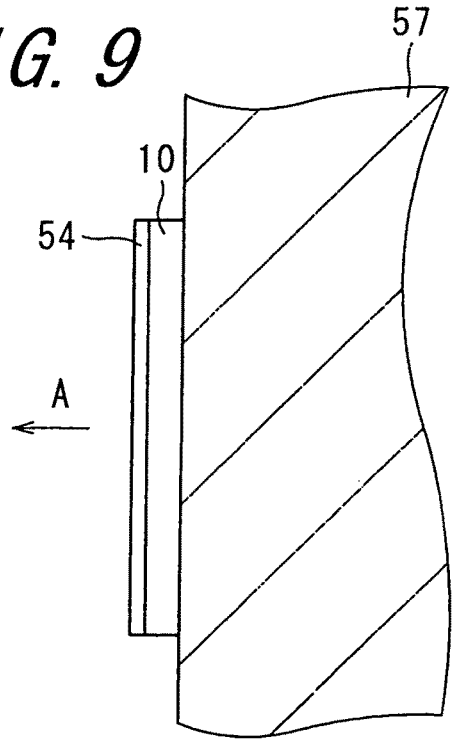
FIG. 9 is a view showing a state in which the tag 50 is attached to a communication jamming member 57.

FIG. 9 is a view showing a state in which the tag 50 is attached to the communication jamming member 57. The tag 50 includes the sheet member 10 so that the tag 50 can be used in the vicinity of the communication jamming member 57, which is a member that jams communication. Examples of conductive material, which is one of communication jamming materials in the invention, include metals, Si-based materials, carbon-based materials such as graphite sheet, oxides such as ITO and ZnO, and liquids such as water. The conductive material refers to a material that is conductive to the extent that a high-frequency short circuit may occur between the material and the antenna element. The conductive material refers to a material having conductivity, examples thereof include materials having relatively low resistivity that is $10^{-6}$ Ωcm or higher and lower than $10^{-1}$ Ωcm (metals, etc.) and materials having relatively high resistivity that is $10^{-1}$ Ωcm or higher and $10^{6}$ Ωcm or lower (liquids such as water and seawater, and semiconductors).

The sheet member 10 is disposed on the side farther from the sending and receiving direction A than the antenna element 51. The sheet member 10 is used in a state where the sheet member 10 is attached via the attachment layer 11 to the communication jamming member 57. The tag 50 is disposed so that the sheet member 10 is disposed closer to the communication jamming member 57 than the antenna element 51 and the sheet member 10 is interposed between the antenna element 51 and the communication jamming member 57.

Figure 10:
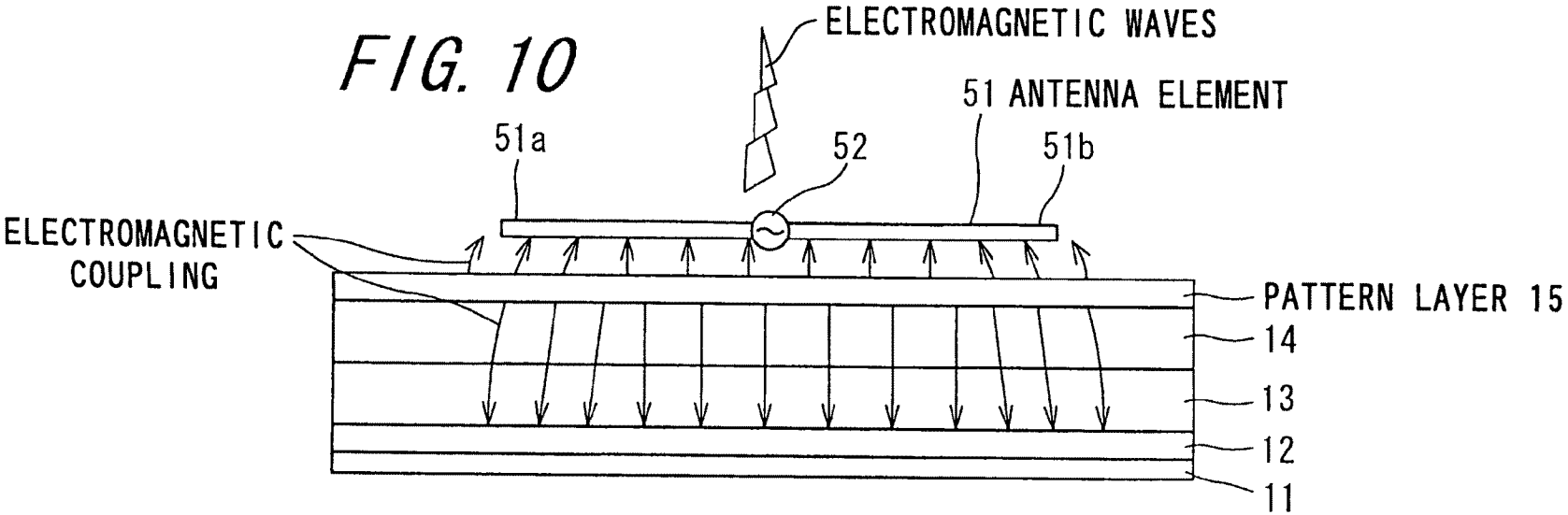
FIG. 10 is a cross-sectional view showing electromagnetic coupling between an antenna element 51 and a pattern layer 15 and electromagnetic coupling between the pattern layer 15 and a radio wave reflecting layer 12.

FIG. 10 is a cross-sectional view showing electromagnetic coupling between the antenna element 51 and the pattern layer 15 and electromagnetic coupling between the pattern layer 15 and the radio wave reflecting layer 12. In FIG. 10, for facilitating understanding, constituent elements other than the antenna element 51, the IC 52, and the sheet member 10 in the configuration of the tag 50 are omitted. In a free space in which the communication jamming member 57 is not present in the vicinity of the antenna element 51, an electric field formed by a potential difference between end portions 51*a* and 51*b* of the antenna element 51 spreads throughout the space, a magnetic field is formed by a change in the intensity of this electric field, and an electric field is formed by a change in the intensity of this magnetic field. Using the principle that an electric field and a magnetic field are repeatedly formed in a successive manner, the antenna element 51 can send electromagnetic waves. Furthermore, using the inverse principle, the antenna element 51 can receive electromagnetic waves at the resonance frequency.

Figure 13:
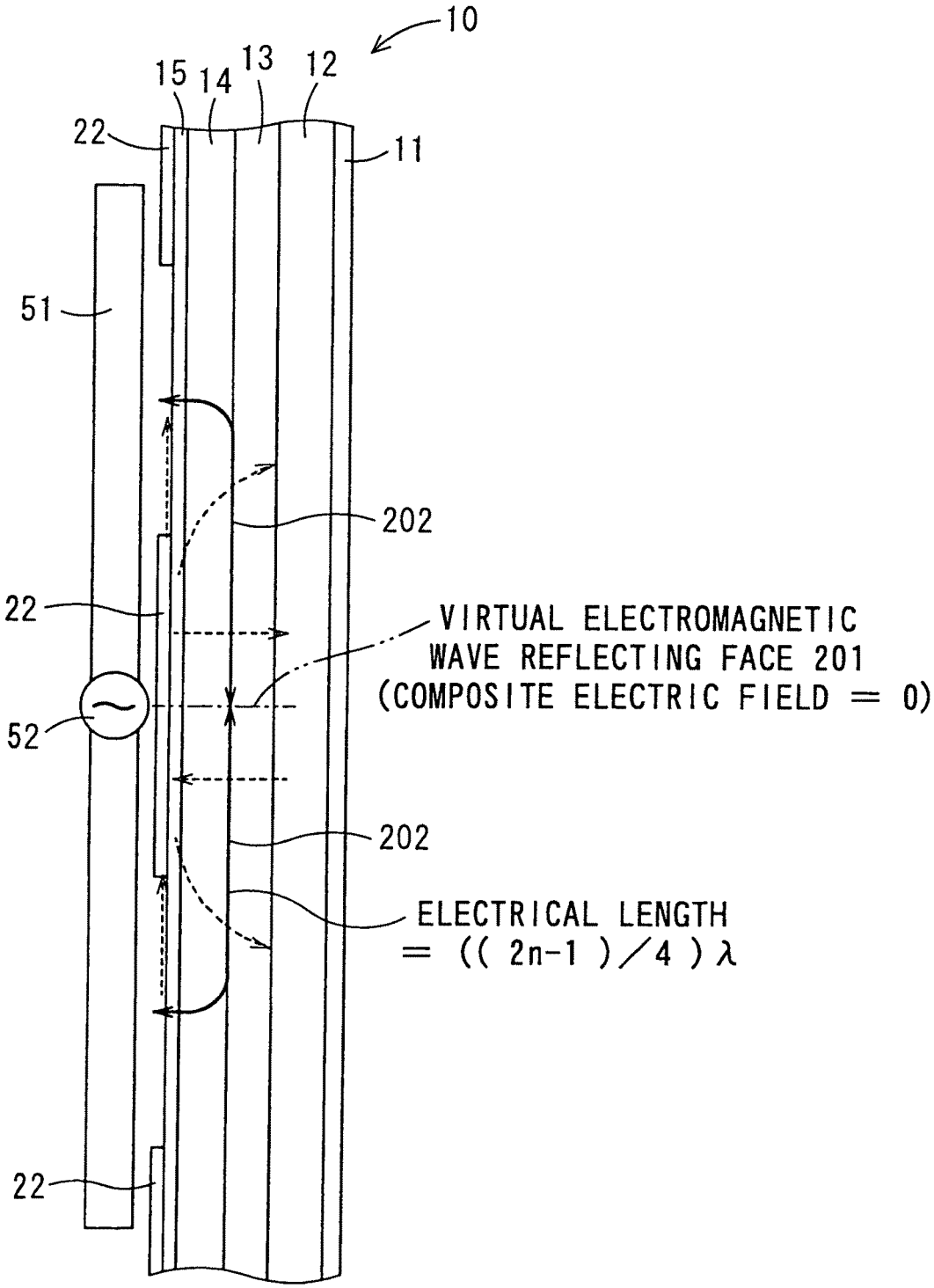
FIG. 13 is an enlarged schematic view showing a part of the sheet member 10 shown in FIG. 11.

In FIG. 13, when electromagnetic waves are incident on the tag 50, the conductive pattern portions 22 of the pattern layer 15 function as an antenna. When electromagnetic waves at a specific frequency that is a resonance frequency determined according to the layers 12 to 15 of the sheet member 10 are incident, resonance occurs, and electromagnetic waves at that frequency are concentrated at the interior of the sheet member 10. The dielectric and magnetic first storage layer 14 is interposed between the pattern layer 15 and the reflection area forming layer 12, and the real number part ($\mu'$) of the magnetic permeability of the first storage layer 14 is selected as described above, and thus electromagnetic waves that have entered the sheet member 10 are propagated along the first storage layer 14. Accordingly, jamming of communication of the antenna element 51 can be suppressed as small as possible. In FIG. 13, traveling waves enter the sheet member 10, and then pass only through the first storage layer 14. However, this is merely an example, and an effect of improving communication is obtained with all layers in the sheet member 10.

When an electromagnetic field is generated around the conductive pattern portions 22, an electromagnetic field is generated also on the side farther from the first storage layer 14 than the pattern layer 15. The antenna element 51 is disposed in the vicinity of the pattern layer 15, and when an electromagnetic field is generated around the conductive pattern portions 22, electromagnetic coupling is formed between the conductive pattern portions 22 and the antenna element 51, and electromagnetic energy is transferred from the conductive pattern portions 22 to the antenna element 51. Since electromagnetic energy at the resonance frequency is supplied from the conductive pattern portions 22 to the antenna element 51, receiving power of the antenna element 51 can be increased compared with a case in which the pattern layer 15 is not included. The tag 50 returns electromagnetic wave signals using the energy of the received electromagnetic wave signals, and thus communication distance can be made longer. This effect of reinforcing electromagnetic waves can be described also based on the distance effect between the conductive pattern portions 22 and the reflection area forming layer 12. The gap between the conductive pattern portions 22 and the reflection area forming layer 12 is ideally $((2n-1)/4)\lambda$ (n is a positive integer), but the distance for obtaining an effect corresponding to interference at $((2n-1)/4)\lambda$ in an air is reduced due to the magnetic permeability and the dielectric constant of the storage layers. Preferably, n is 0.

Furthermore, the sheet member 10 is designed so that the phase of captured electromagnetic waves is adjusted in the interior of the sheet member, and thus an area having high electric field intensity, at a position away from the reflection area forming layer by an electrical length of $((2n-1)/4)\lambda$ (where the wavelength of electromagnetic waves is taken as $\lambda$), is formed at the position of the pattern layer 15. In the invention, a position (a virtual electromagnetic wave reflecting face 201 indicated by the virtual line shown in FIGS. 11 and 13 described later) having a composite electric field of 0 (zero) and virtually connecting a point near the center of the conductive pattern portions 22 and the reflection area forming layer is formed. When electromagnetic waves are reflected by the virtual electromagnetic wave reflecting face 201 that forms a reflection area, the electromagnetic waves move around the conductive pattern portions 22 along the distance longer than the straight distance $((2n-1)/4)\lambda$. Using this aspect, a longer electrical length from the pattern layer 15 to the reflection area is obtained, and thus the sheet member 10 is made significantly thinner than $\lambda/4$. Portions in which the electrical length from the pattern layer 15 to the reflection area is $((2n-1)/4)\lambda$ in the invention are denoted by arrows 202 in FIG. 13. Accordingly, the electric field intensity is also increased by interference at the position of the conductive pattern portions. With these reinforcement effects, the sheet member 10 also functions as a booster antenna. Accordingly, wireless communication can be suitably performed even in the vicinity of the communication jamming member 57, and a sufficient communication distance can be secured. When the sheet member 10 includes the conductive pattern portions 22 and independently has an antenna function in this manner, an effect of improving communication of the antenna element 51 can be obtained.

In a state where there is a potential difference between the end portions 51*a* and 51*b* of the antenna element 51, each of the end portions 51*a* and 51*b* of the antenna element 51 is charged positively or negatively, and thus electric fields are formed between the end portions 51*a* and 51*b* of the antenna element 51 and portions 12*a* and 12*b* in the reflection area forming layer 12 respectively opposing the end portions 51*a* and 51*b* of the antenna element 51, and a positively or negatively charged state that is opposite to the charge of the end portions 51*a* and 51*b* of the antenna element 51 is formed. The IC 52 applies an alternating voltage to the antenna element 51, and the end portions 51*a* and 51*b* are charged so that the charge is alternately switched between positive and negative. In a case where the sheet member 10 is disposed between the electric field-type antenna element 51 and the communication jamming member 57, the distance between the antenna element 51 and the communication jamming member 57 can be increased. Thus, the intensity of an electric field that is generated by the end portions 51*a* and 51*b* of the antenna element 51 being charged and that is formed between the antenna element 51 and the communication jamming member 57 can be reduced. In this embodiment, the reflection area forming layer 12 is formed in the sheet member 10, and the storage layers are formed between the antenna element 51 and the reflection area forming layer 12. Thus, the electrical length between the antenna element 51 and the reflection area forming layer 12 can be increased, and the degree of an electrical short circuit that is generated by the end portions 51*a* and 51*b* of the antenna element 51 being charged and that is formed between the antenna element 51 and the reflection area forming layer 12 becomes smaller.

The above-described phenomenon is to be generated also between the antenna element 51 and the conductive pattern portions 22. However, since the conductive pattern portions 22 are smaller than the corresponding antenna element 51 and are non-continuously arranged, the influence to lower the impedance of the antenna element is small.

Accordingly, a high-frequency short circuit between the antenna element 51 and the communication jamming member 57 or the reflection area forming layer 12 is less likely to occur. That is to say, it is possible to suppress a high-frequency current flowing between the antenna element 51 and the communication jamming member 57 or the reflection area forming layer 12 due to a high-frequency short circuit occurring, which is similar to an electrical current flowing when a high-frequency voltage is applied to a capacitor, and thus a decrease in the input impedance of the antenna element 51 is suppressed. Suppression of a decrease in the input impedance has been confirmed based on the fact that the current value of a current that flows in the antenna element 51 becomes small as in a case where the communication jamming member 57 is not present. When the sheet member 10 is used in this manner, a decrease in the input impedance can be suppressed. When the input impedance becomes small, this impedance is deviated from the impedance of the communication means (the IC 52) for performing communication using the antenna element 51, and thus signals cannot be exchanged between the antenna element 51 and the communication means. However, since the sheet member 10 can suppress a decrease in the input impedance of the antenna element 51, wireless communication can be suitably performed even in the vicinity of the communication jamming member 57. In order to suppress a decrease in the input impedance, the conductive pattern portions 22 may have slits, projections and recesses, inclination, lightness and darkness, or the like, so as to resist conduction.

Figure 11:
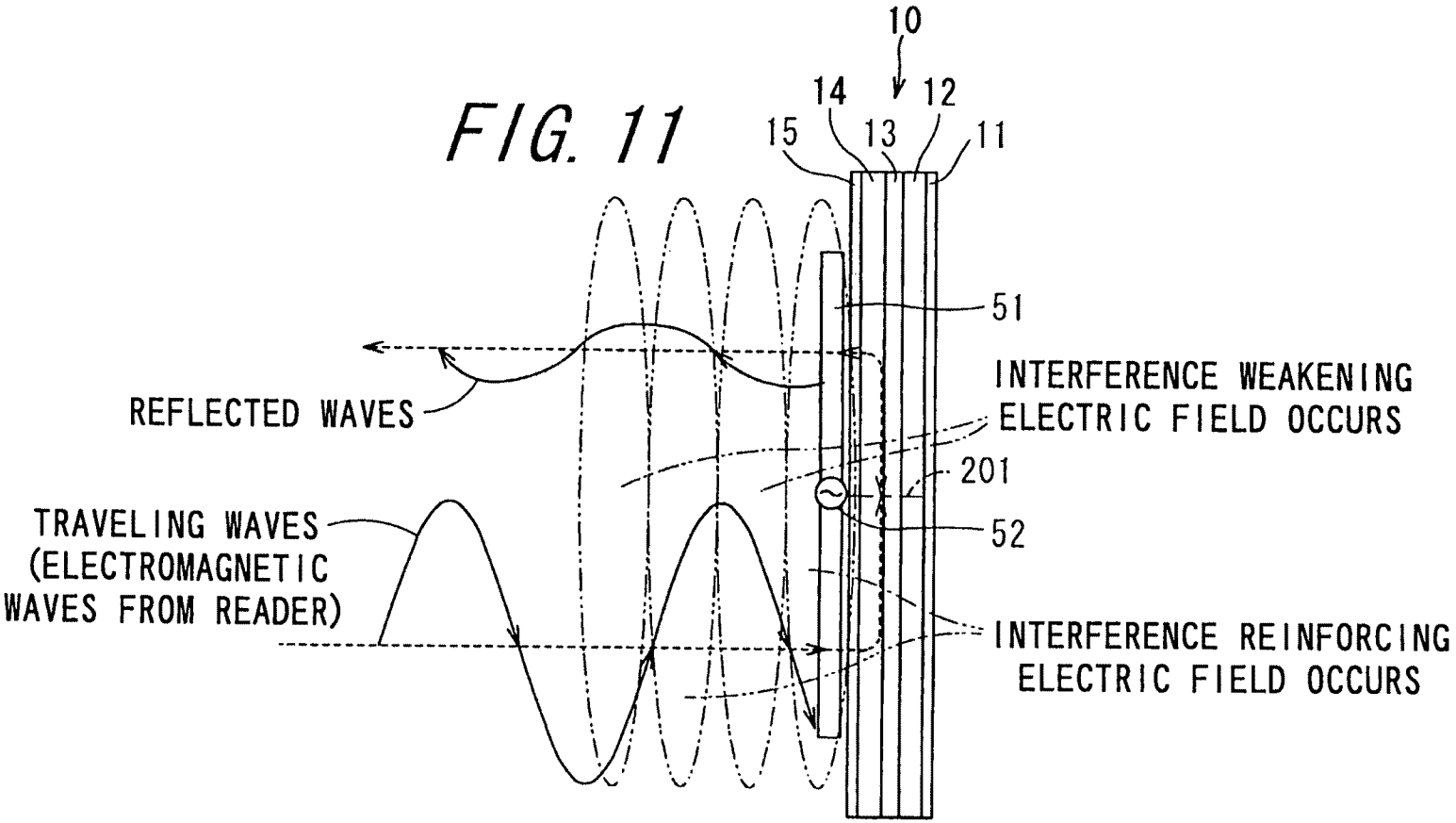
FIG. 11 is a schematic view showing electromagnetic waves that are incident on the sheet member 10 (referred to as traveling waves) and electromagnetic waves that are reflected by the sheet member 10 (referred to as reflected waves)
Figure 12:
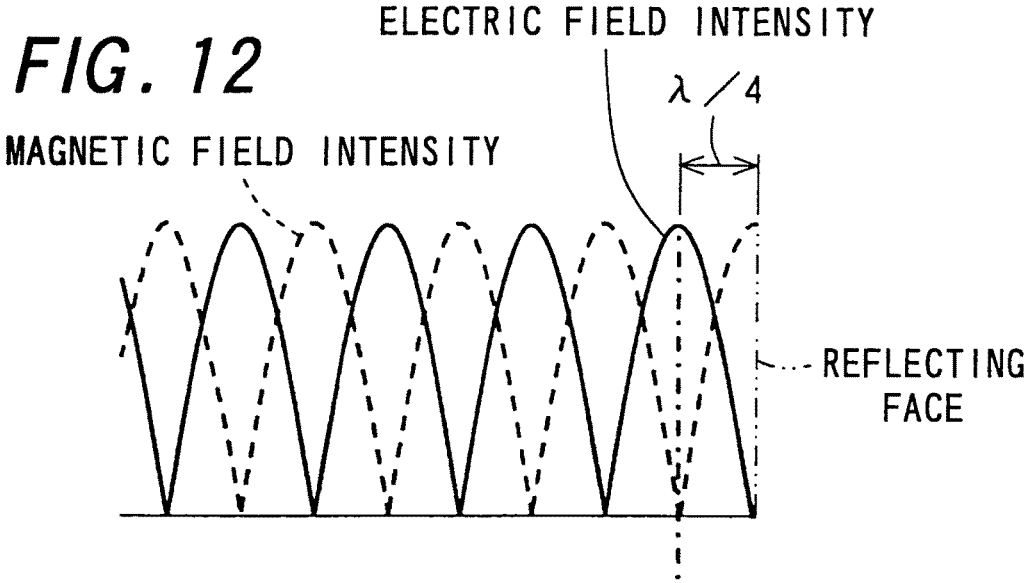
FIG. 12 is a view illustrating reflection of electromagnetic waves.

FIG. 11 is a schematic view showing electromagnetic waves that are incident on the sheet member 10 (referred to as traveling waves) and electromagnetic waves that are reflected by the sheet member 10 (referred to as reflected waves). FIG. 12 is a view illustrating reflection of electromagnetic waves. FIG. 13 is an enlarged schematic view showing a part of the sheet member 10 shown in FIG. 11. In FIGS. 11 and 13, for facilitating understanding, constituent elements other than the antenna element 51, the IC 52, and the sheet member 10 in the configuration of the configuration of the tag 50 are omitted. When traveling waves are incident on the pattern layer 15, the traveling waves are received by the conductive pattern portions 22, and thus the energy of the traveling waves are apparently collected at the storage layers. In FIG. 13, the orientations of the electric field formed by the electromagnetic waves inside the sheet member 10 are indicated by the broken lines.

In the sheet member 10, the storage layers can be made thinner by optimally designing the above-described pattern layer 15, and electromagnetic waves can be efficiently received. Moreover, since the pattern layer 15 in which a plurality of types of conductive pattern portions are formed is used, electromagnetic waves can be efficiently received using the properties of the receiving operation in the conductive pattern portions 22. Since the conductive pattern portions 22 are electrically insulated from each other, the frequency band can be made wider, and electromagnetic waves in a wide band can be efficiently received.

Since the receiving efficiency of electromagnetic waves in a wide frequency band can be increased in this manner, wide and high performance in receiving electromagnetic waves can be obtained. The sheet member 10 can be made thinner and lighter. Furthermore, the degree of freedom in selecting the material quality of the storage layers is increased so as to provide flexibility. Thus, the sheet member 10 having excellent productivity can be obtained.

Traveling waves and reflected waves of electromagnetic waves are interfered with each other, and thus stationary waves are formed. Depending on the distance from a reflecting face (reflection area) that is formed by the reflection area forming layer 12 and reflects electromagnetic waves, the electric field and the magnetic field reinforce or weaken each other as shown in FIG. 12. At that time, the phase of the reflected waves (electric field) is shifted from the phase of the traveling waves by 180°. FIGS. 12 and 13 show stationary waves. In FIG. 12, the stationary waves of the electric field are indicated by the solid lines, and the stationary waves of the magnetic field are indicated by the broken lines. In FIG. 13, the stationary waves of the electric field are indicated by the broken lines. The mechanism in which the stationary waves are formed is not described, but FIGS. 12 and 13 show only the intensity (the same views are obtained also in a case where only the amplitude is shown). At the position that is away from the reflecting face by $((2n-1)/4)\lambda$ (n is a positive integer), the electric field intensity is highest, and the magnetic field intensity becomes 0 (zero). The reflecting face shown in FIG. 12 is equivalent to a face having a composite electric field of 0 (zero), and is equivalent to a metal face.

On the side farther from the antenna element 51 than the pattern layer 15 and the first and the second storage layers 14 and 13, the above-described virtual electromagnetic wave reflecting face 201 that has the storage layers interposed between this face and the pattern layer 15 and that is spaced away from at least one of the antenna element 51 and the pattern layer 15 at the portion between the conductive pattern portions 22 by an electrical length of $((2n-1)/4)\lambda$ (n is a positive integer) is formed so as to connect the conductive pattern portions 22 and the reflection area forming layer 12. The virtual electromagnetic wave reflecting face 201 is an area in which the intensity of an electric field formed between the center portion of the conductive pattern portions 22 and the reflection area forming layer 12 is 0 (zero). Since the intensity of the electric field is 0 (zero), the virtual electromagnetic wave reflecting face 201 functions as a reflecting plate of electromagnetic waves, and electromagnetic waves that have entered the sheet member 10 from the conductive pattern portions 22 are reflected by the virtual electromagnetic wave reflecting face 201 and return. That is to say, at least one of the antenna element 51 and the pattern layer 15 at the portion between the conductive pattern portions 22 and the virtual electromagnetic wave reflecting face 201 are away from each other by a distance of $((2n-1)/4)$ times of the wavelength of electromagnetic waves that travel through the pattern layer 15 and the storage layers. The wavelength of electromagnetic waves is shorter than the wavelength in an air due to effects of the pattern layer 15 and the storage layers, and thus the portion from the incident portion of the pattern layer 15 to the virtual electromagnetic wave reflecting face 201 realizes a distance corresponding to $((2n-1)/4)$ times (substantially $\lambda/4$, when n=0) of the wavelength of electromagnetic waves in a thin sheet. Furthermore, the electrical distance from at least one of the antenna element 51 and the pattern layer 15 at the portion between the conductive pattern portions 22 to the virtual electromagnetic wave reflecting face 201 is taken as $((2n-1)/4)\lambda$ (n is a positive integer), and thus a longer distance is obtained using curve of the propagation path of electromagnetic waves due to the real number part $\in'$ of the complex relative dielectric constant and/or the real number part $\mu'$ of the complex relative magnetic permeability in the sheet member 10. When n=0, the distance (the thickness of the sheet member 10) from the pattern layer 15 to the reflection area forming layer 12 can be made significantly thinner than $\lambda/4$. This sort of technique for making Regarding an electric field, when the wavelength of electromagnetic waves is taken as $\lambda$, at a position away from the reflecting face of the reflection area forming layer 12 by $n\times(\lambda/2)$ (n is a positive integer), traveling waves are canceled by reflected waves. However, at a position away from the reflection area (the virtual electromagnetic wave reflecting face 201) by an electrical length of $((2n-1)/4)$ times of the wavelength, traveling waves and reflected waves reinforce each other by interference. When the antenna element 51 is disposed at a position where reflected electromagnetic waves and arriving electromagnetic waves reinforce each other for interference, wireless communication can be suitably performed even in the vicinity of the communication jamming member 57.

Figure 14:
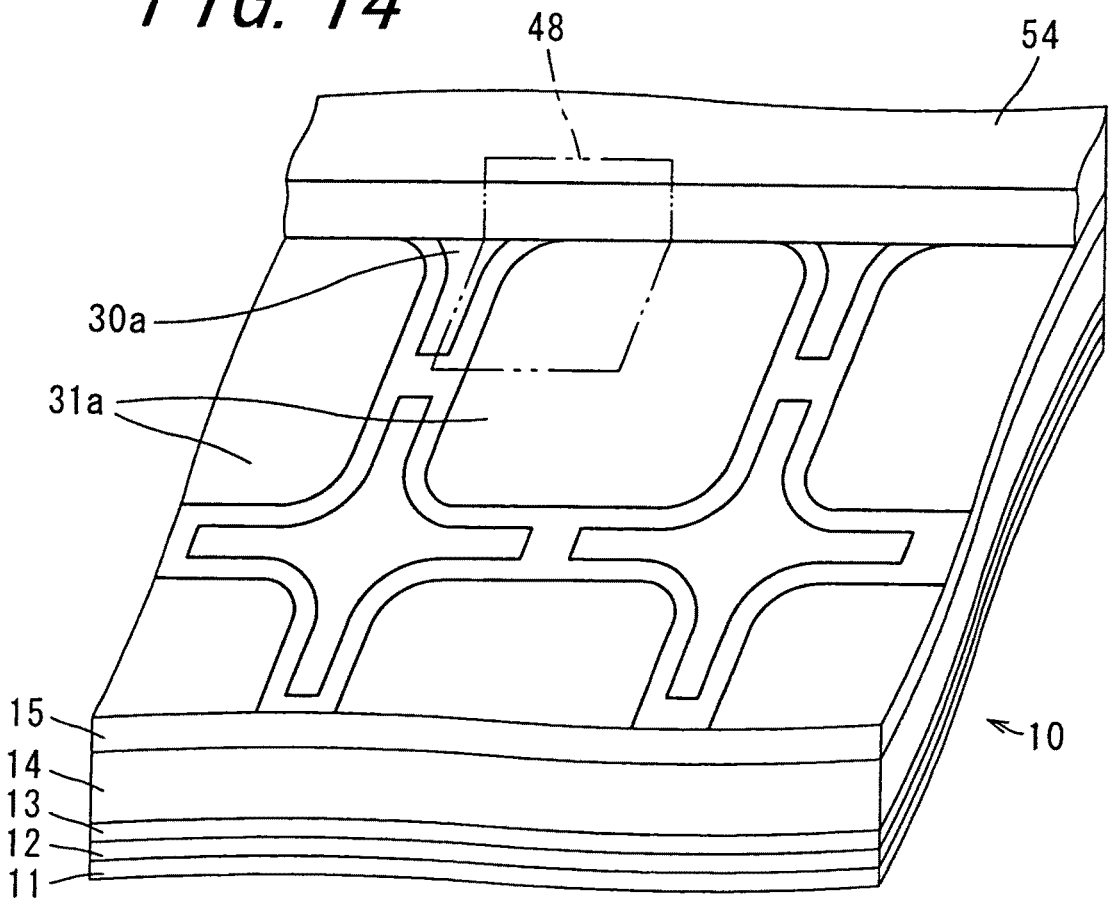
FIG. 14 is an enlarged perspective view showing a part of the tag 50, in which a part of a tag main body 54 overlaid on the sheet member 10 is cut out.
Figure 15:
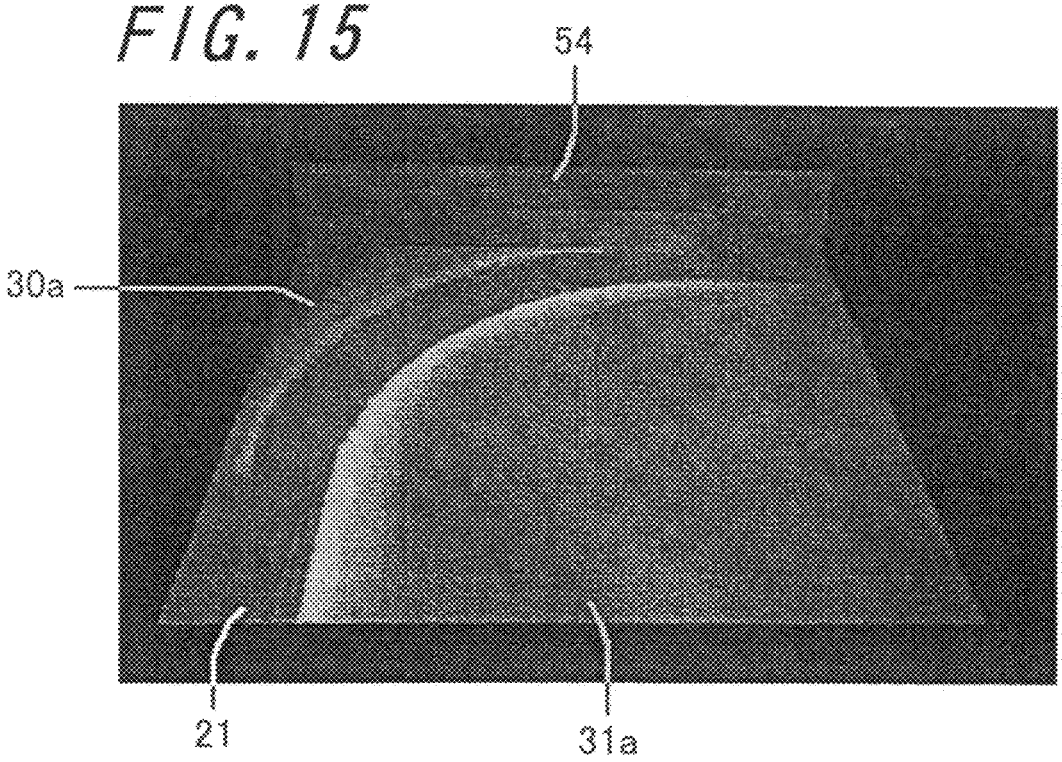
FIG. 15 is a view showing the electric field intensity obtained by a simulation performed in a region indicated by a virtual line 48 shown in FIG. 14.

FIG. 14 is an enlarged perspective view showing a part of the tag 50, in which a part of the tag main body 54 overlaid on the sheet member 10 is cut out. FIG. 15 is a view showing the electric field intensity obtained by a simulation performed in a region indicated by a virtual line 48 shown in FIG. 14. In FIG. 15, the electric field intensity is indicated with a gray scale where an electric field is intensive in a white portion and is less intensive as the color is changed from white toward black. Based on the simulation result, an area having an intensive electric field is observed at the rectangular pattern shapes 31*a*. In FIG. 15, the electric field vector used for the calculation is horizontal, and the magnetic field vector is vertical. A portion on the right side of the rectangular pattern shapes 31*a* in FIG. 15 has a black area in which the electric field is 0 (zero). This area corresponds to the above-described virtual electromagnetic wave reflecting face 201.

Furthermore, the conductive pattern portions 22 that receive electromagnetic waves have a substantially polygonal outer shape that is basically in the shape of a polygon, and thus a peak value of the gain can be increased compared with a case in which the outer shape of the conductive pattern portions 22 is circular.

The reason for this is that, in the case of a polygonal pattern, the Q value is higher than that of a circular pattern. First, the Q value will be described. The Q value of resonance can be indicated by a band width. The correspondence is Q=resonance frequency/band width. Accordingly, a high Q value indicates that the band width is narrow.

This correspondence can be applied for a peak value of the gain using the pattern. That is to say, a high Q value of a polygonal pattern indicates that the gain is high although the reception band is narrow. A low Q value indicates that the gain is low although the reception band is wide.

When the Q value of a polygonal pattern is high, in turn, the reception band becomes narrow, and the resonance frequency is shifted due to the influence of polarization. The reason for this can be described as below. In a case where a 0° electric field (non-polarized state) is present in a rectangular (quadrangular) pattern, an intensive current flows along the sides of the rectangular pattern, and resonance occurs at that portion. On the other hand, in a case where the electric field is inclined by 45° in the rectangular pattern, or the pattern is a circular pattern, the path through which an intensive current flows is not concentrated to be thin at the edge compared with the case where the rectangular pattern is at 0°. In other words, since the path of the current becomes wider, a region in which half-wavelength waves related to resonance are distributed is expanded, and thus resonance conditions are increased. It is considered that, as a result, the band width can be increased. For example, in the case of a rectangular pattern, when electromagnetic waves (TE waves) are received, an electric field is formed to extend in a straight line parallel to the sides, but in a case where the rectangle is rotated by 45°, an electric field in the pattern in a case where electromagnetic waves (TE waves) are received is formed so as to extend in the shape of an arc, that is, the distributions are clearly different from each other. That is to say, a rectangular (polygonal) pattern is disadvantageous in that since resonance is concentratedly occurs, communication easily depends on polarization, although receiving properties become high.

In order to improve this disadvantage, the pattern shape is basically polygonal, but at least one corner is set to be curved. Herein, an effect resulting from the fact that the corner is rounded off, that is, formed to be curved is to cause a resonance current to easily flow without stagnating at the corner, and to make the resonant region wider. As a result, the Q value becomes slightly smaller, but wide-band performance is exhibited, and thus polarization properties are improved. Thus, shift of the frequency at which the gain has a peak according to the direction in which electromagnetic waves are polarized can be suppressed low. Accordingly, a sheet member having excellent receiving properties can be realized in which a peak value of the gain is high, and shift of the frequency at which the gain has a peak according to the direction in which electromagnetic waves are polarized is small (polarization loss is small).

When the conductive pattern portions 22 are basically polygonal and at least part of the corners is formed to be curved, a sheet member having excellent receiving properties can be realized in which a peak value of the gain is high, and shift of the frequency at which the gain has a peak according to the direction in which electromagnetic waves are polarized is small.

Figure 16:
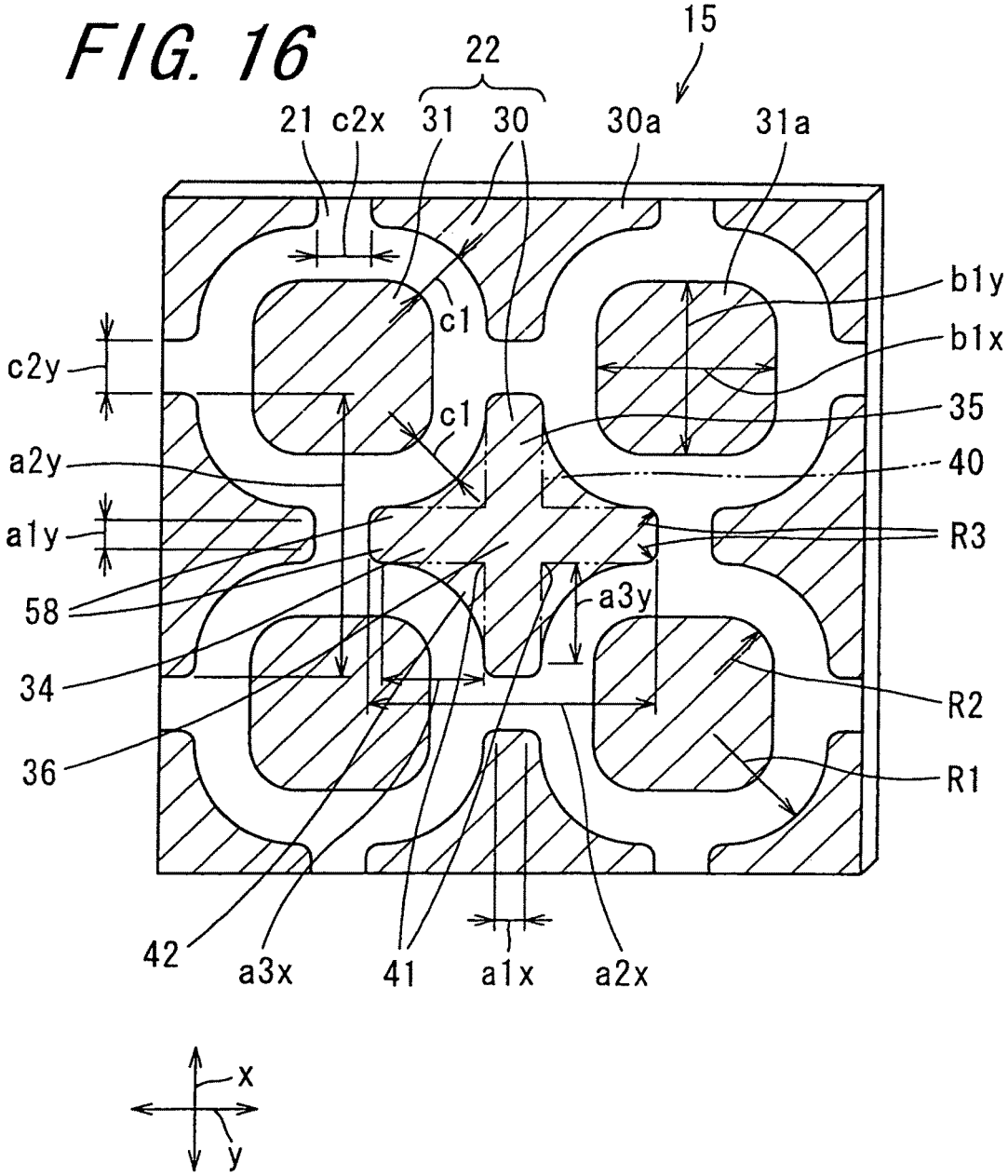
FIG. 16 is an enlarged perspective view showing a part of the pattern layer 15, which is another embodiment constituting the sheet member 10 in the embodiment shown in FIG. 1.

FIG. 16 is an enlarged perspective view showing a part of the pattern layer 15, which is another embodiment constituting the sheet member 10 in the embodiment shown in FIG. 1. The conductive pattern portions 22 in this case have the radial pattern portions 30 and the rectangular pattern portions 31 that are two types of geometrical shapes. In FIG. 16, for facilitating understanding, the conductive pattern portions 22 are hatched with diagonal lines.

The radial pattern shape 30*a* has a shape in which four corners 41 in the intersecting portion 36 and corners 58 other than the corners 41 are formed into curves, more specifically, arcs, based on the base cross 40 indicated by the virtual line in FIG. 16. The corners 58 are formed in the shape of arcs projecting outward.

For example, the radial pattern shape 30*a* has a size in which the widths a1*x* and a1*y* of the shape portions 34 and 35 are the same, for example, 1.0 mm, and the lengths a2*x* and a2*y* of the shape portions 34 and 35 are the same, for example, 17.5 mm. The sizes of the arc at the arc-shaped corner, that is, the lengths of the sides excluding the oblique side of the substantially triangular portion 42, more specifically, the length a3*x* of the side in the x direction and the length a3*y* of the side in the y direction are the same, for example, 7.5 mm, and the radius of curvature R1 of the oblique side is 7.5 mm. Furthermore, the radius of curvature R3 of the outer peripheral sides of the corners 58 is 7.0 mm. Regarding the radial pattern gaps, the gap c2*x* in the x direction and the gap c2*y* in the y direction are the same, for example, 7.0 mm. Furthermore, in the rectangular pattern shapes 31*a*, the size b1*x* in the x direction and the size b1*y* in the y direction are the same, for example, 20.5 mm. Regarding the radial-rectangular portion gap between the radial pattern shapes 30*a* and the rectangular pattern shapes 31*a*, the gap c1*x* in the x direction and the gap c1*y* in the y direction are the same, for example, 1.5 mm. Also with this sort of configuration, a similar effect can be obtained.

Figure 17:
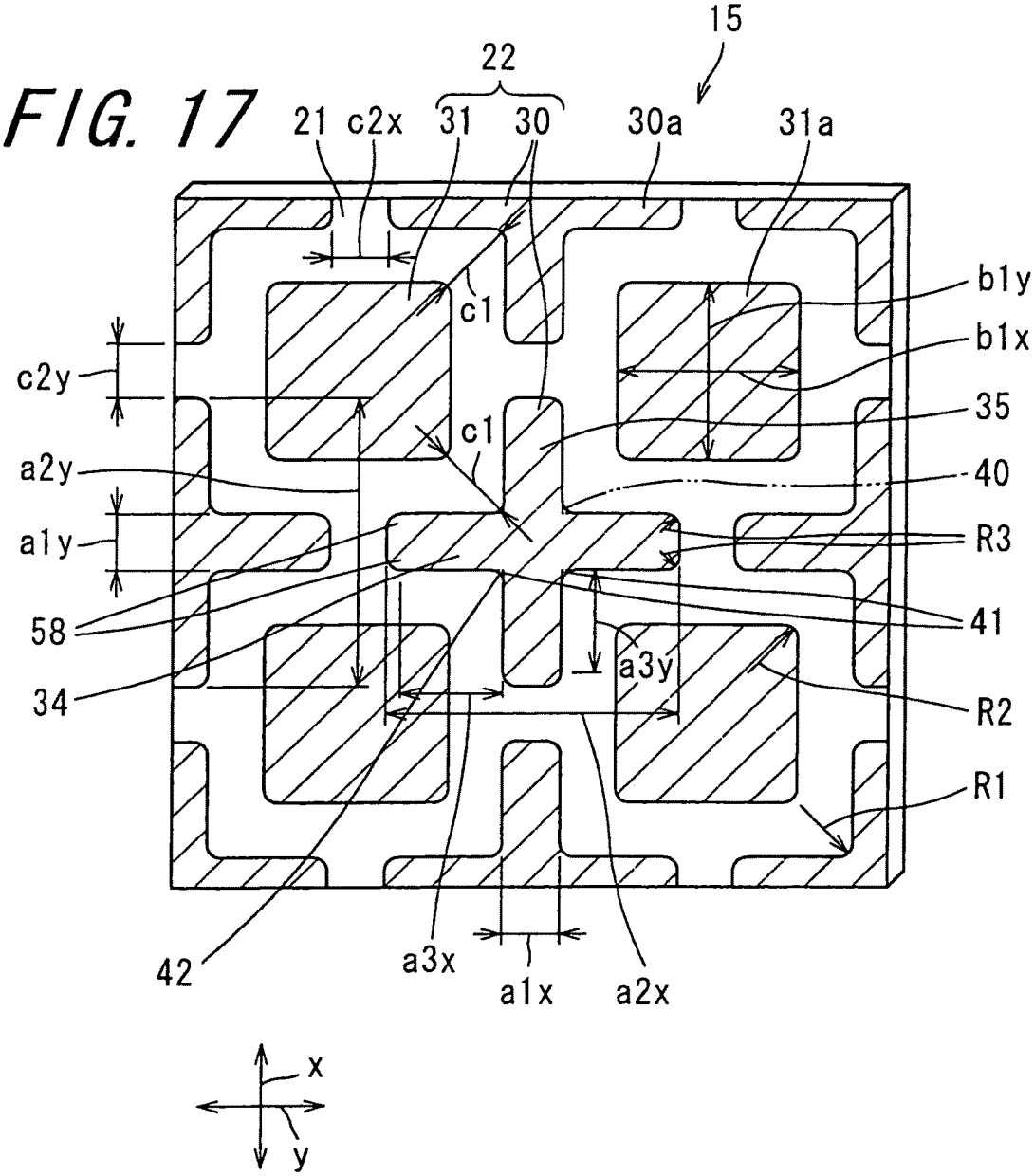
FIG. 17 is an enlarged perspective view showing a part of the pattern layer 15 according to another embodiment constituting the sheet member 10 in the embodiment shown in FIG. 1.

FIG. 17 is an enlarged perspective view showing a part of the pattern layer 15 according to another embodiment constituting the sheet member 10 in the embodiment shown in FIG. 1. The conductive pattern portions 22 in this case have the radial pattern portions 30 and the rectangular pattern portions 31. In FIG. 17, for facilitating understanding, the conductive pattern portions 22 are hatched with diagonal lines.

The radial pattern shape 30*a* has a shape in which four corners 41 in the intersecting portion 36 and corners 58 other than the corners 41 are formed into curves, more specifically, arcs, based on the base cross 40 indicated by the virtual line in FIG. 17. The corners 58 are formed in the shape of arcs projecting outward.

For example, the radial pattern shape 30*a* has a size in which the widths a1*x* and a1*y* of the shape portions 34 and 35 are the same, for example, 2 mm, and the lengths a2*x* and a2*y* of the shape portions 34 and 35 are the same, for example, 10 mm. The sizes of the arc at the arc-shaped corner, that is, the lengths of the sides excluding the oblique side of the substantially triangular portion 42, more specifically, the length a3*x* of the side in the x direction and the length a3*y* of the side in the y direction are the same, for example, 3 mm, and the radius of curvature R1 of the oblique side is 0.5 mm. Furthermore, the radius of curvature R3 of the outer peripheral sides of the corners 58 is 0.5 mm. Regarding the radial pattern gaps, the gap c2*x* in the x direction and the gap c2*y* in the y direction are the same, for example, 2 mm. Furthermore, in the rectangular pattern shapes 31*a*, the size b1*x* in the x direction and the size b1*y* in the y direction are the same, for example, 6 mm. Regarding the radial-rectangular portion gap between the radial pattern shapes 30*a* and the rectangular pattern shapes 31*a*, the gap c1*x* in the x direction and the gap c1*y* in the y direction are the same, for example, 2 mm. Also with this sort of configuration, a similar effect can be obtained.

Figure 18:
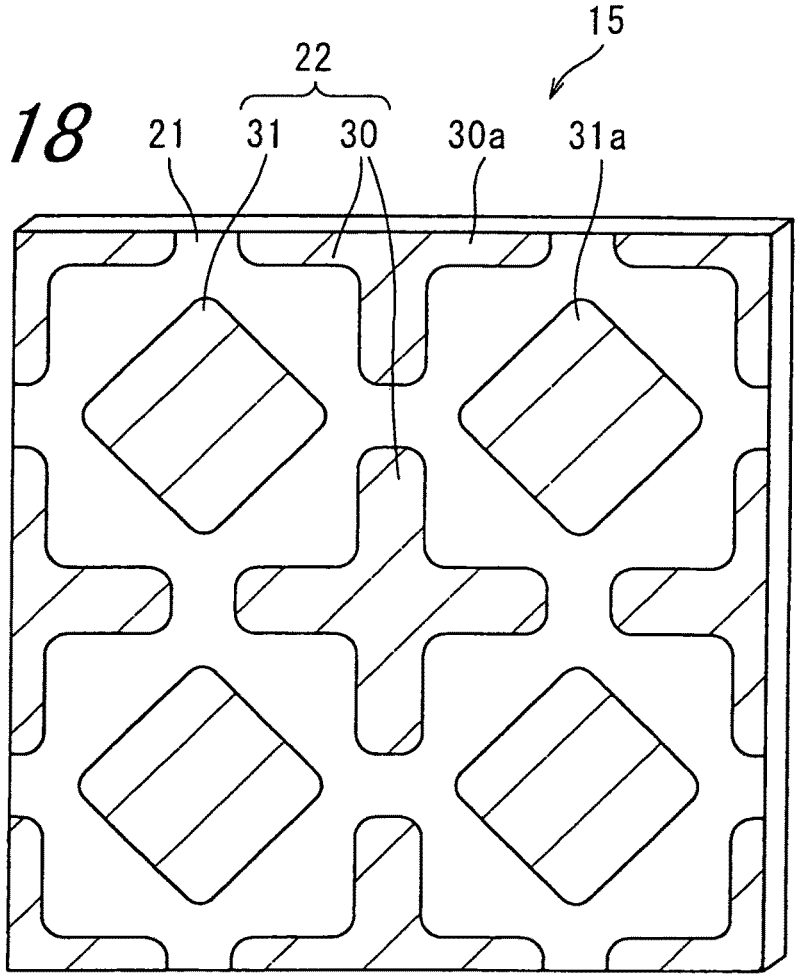
FIG. 18 is an enlarged perspective view showing a part of the pattern layer 15 according to another embodiment constituting the sheet member 10 in the embodiment shown in FIG. 1.

FIG. 18 is an enlarged perspective view showing a part of the pattern layer 15 according to another embodiment constituting the sheet member 10 in the embodiment shown in FIG. 1. The conductive pattern portions 22 in this case have the radial pattern portions 30 and the rectangular pattern portions 31. In FIG. 18, for facilitating understanding, the conductive pattern portions 22 are hatched with diagonal lines. The rectangular pattern shapes 31*a* in this embodiment have a shape obtained by angularly displacing the rectangular pattern shapes 31*a* of the conductive pattern portions 22 shown in FIG. 17 by 90° about the centroids, and the other constituent elements in the configuration are the same as those in the conductive pattern portions 22 shown in FIG. 17. Also with this sort of configuration, a similar effect can be obtained.

Figure 19:
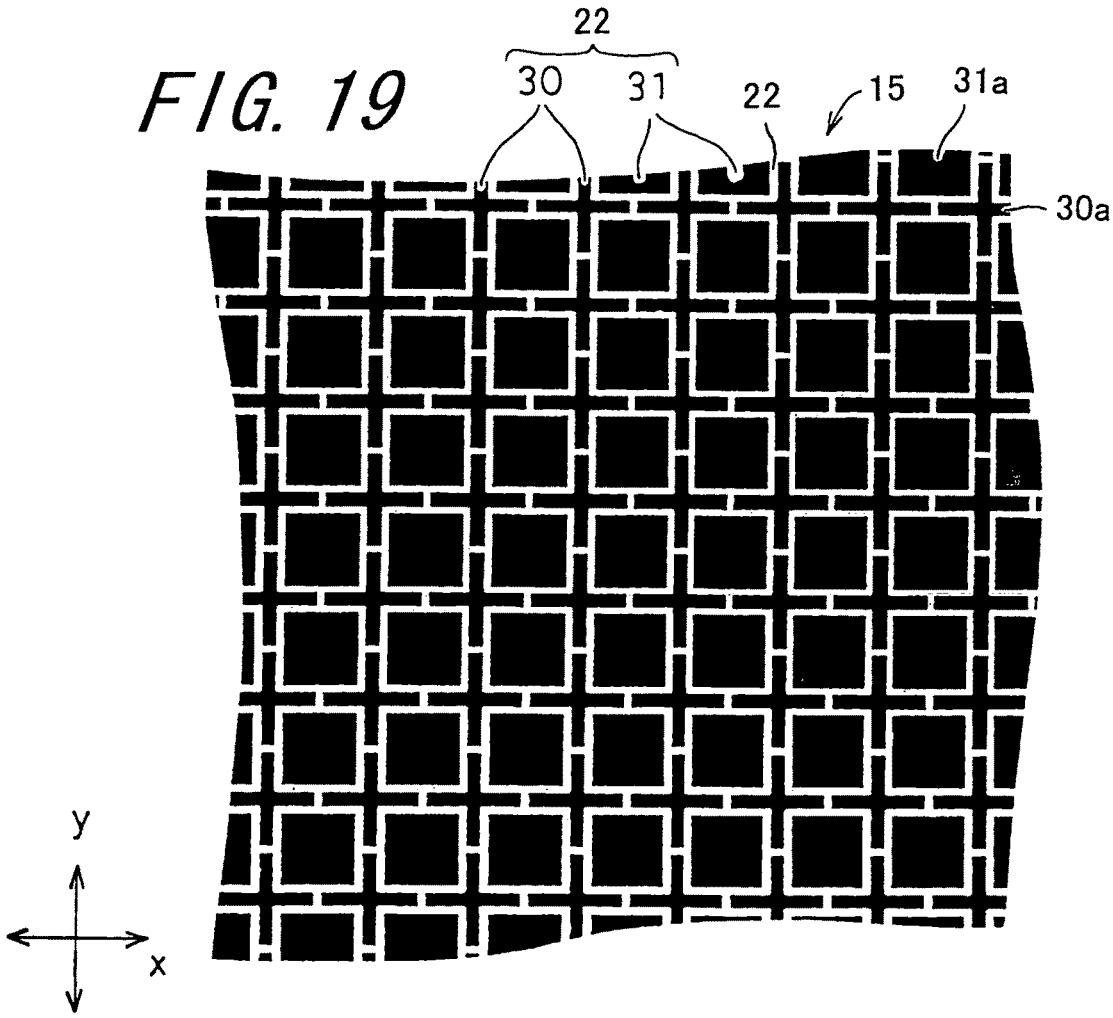
FIG. 19 is a front view of the pattern layer 15 according to another embodiment constituting the sheet member 10 in the embodiment shown in FIG. 1.
Figure 20:
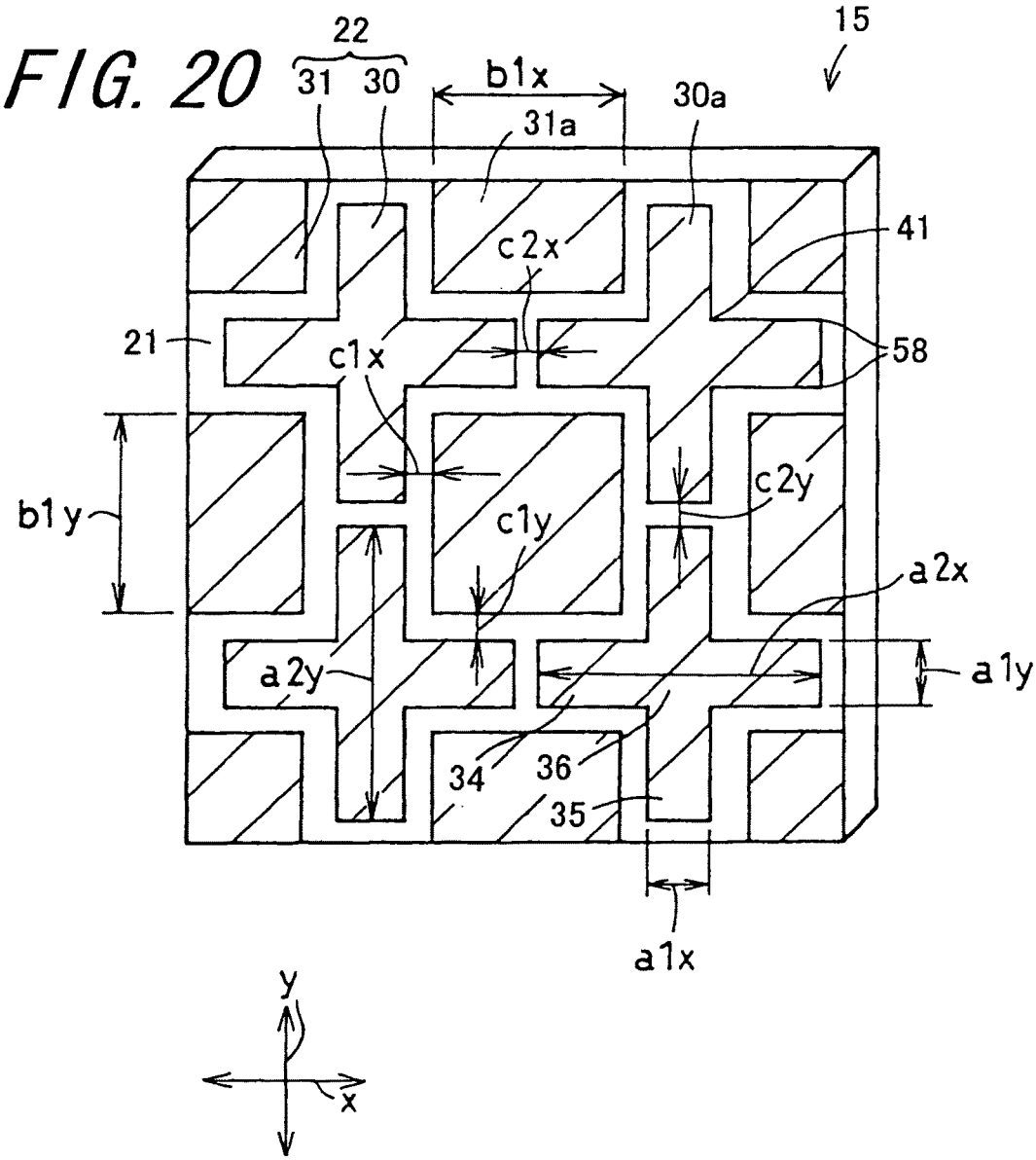
FIG. 20 is an enlarged perspective view showing a part of the pattern layer 15 in FIG. 19.

FIG. 19 is a front view of the pattern layer 15 according to another embodiment constituting the sheet member 10 in the embodiment shown in FIG. 1. FIG. 20 is an enlarged perspective view showing a part of the pattern layer 15 in FIG. 19. The conductive pattern portions 22 in this case have the radial pattern portions 30 in which the outlines of the corners 41 and 58 are formed at right angles and the rectangular pattern portions 31 in which the outlines of the corners are formed at right angles. The rectangular pattern shape 31*a* is disposed in a region enclosed by the radial pattern shapes 30*a* so as to be spaced away from the radial pattern shapes 30*a* by the radial-rectangular portion gaps c1*x* and c1*y* respectively in the x direction and the y direction. In FIG. 20, for facilitating understanding, the conductive pattern portions 22 are hatched with diagonal lines.

For example, the radial pattern shape 30*a* has a size in which the widths a1*x* and a1*y* of the shape portions 34 and 35 are the same, for example, 2.5 mm, and the lengths a2*x* and a2*y* of the shape portions 34 and 35 are the same, for example, 16.0 mm. The radial-rectangular portion gaps c1*x* and c1*y* are the same, for example, 1.0 mm. Regarding the radial pattern gaps, the gap c2*x* in the x direction and the gap c2*y* in the y direction are the same, for example, 1.0 mm. Furthermore, in the rectangular pattern shapes 31*a*, the size b1*x* in the x direction and the size b1*y* in the y direction are the same, for example, 12.5 mm. Regarding the radial-rectangular portion gap between the radial pattern shapes 30*a* and the rectangular pattern shapes 31*a*, the gap c1*x* in the x direction and the gap c1*y* in the y direction are the same, for example, 1.0 mm. Also with this sort of configuration, a similar effect can be obtained.

Figure 21:
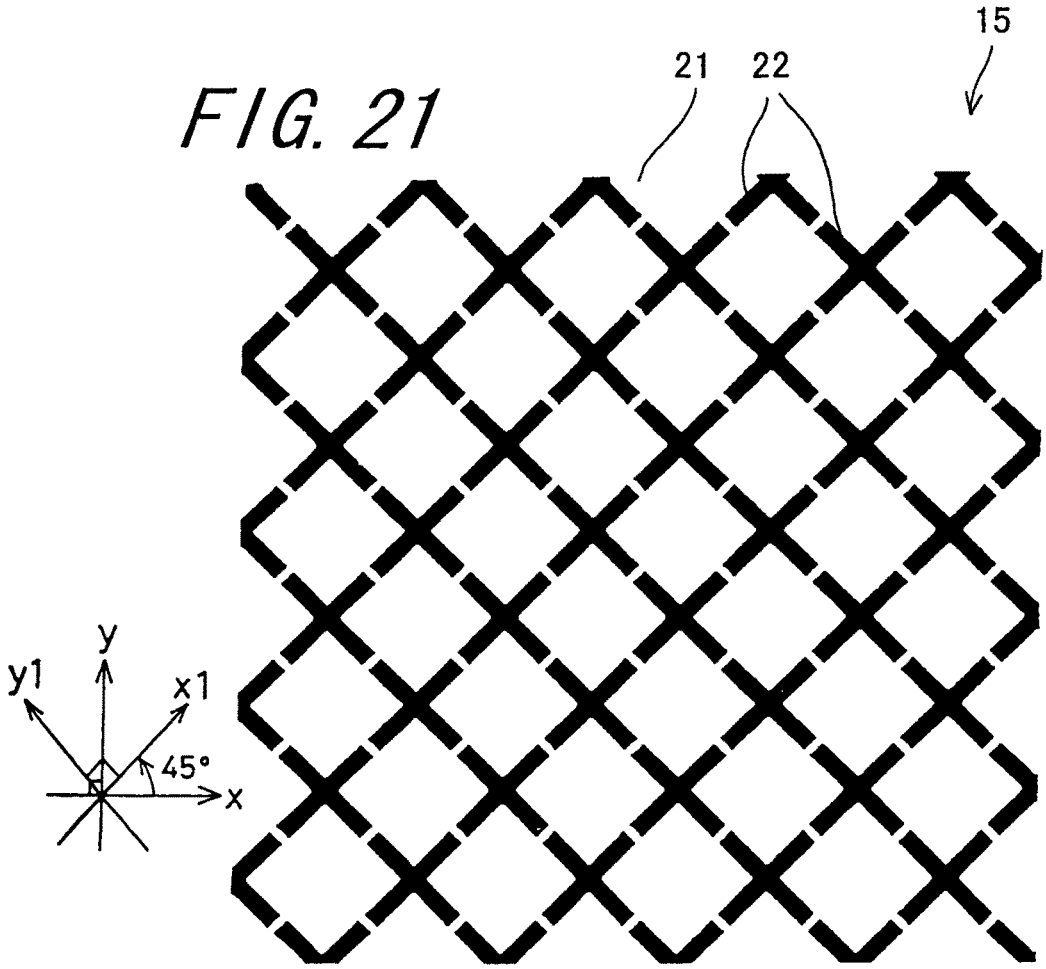
FIG. 21 is a front view of the pattern layer 15 showing double-humped properties according to another embodiment constituting the sheet member 10 in the embodiment shown in FIG. 1.
Figure 22:
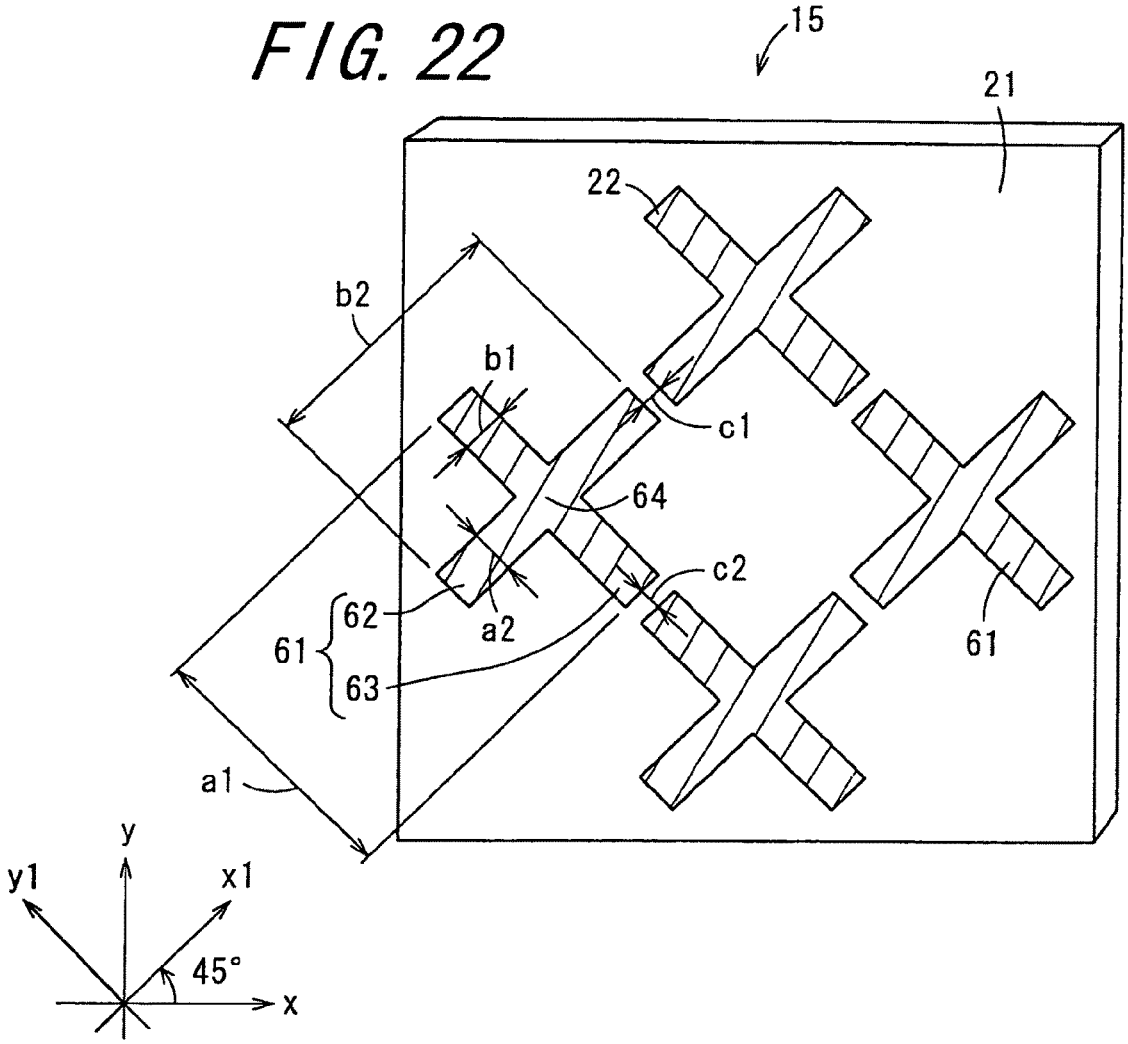
FIG. 22 is an enlarged perspective view of a part of the pattern layer 15 in the embodiment shown in FIG. 21.

FIG. 21 is a front view of the pattern layer 15 showing double-humped properties according to another embodiment constituting the sheet member 10 in the embodiment shown in FIG. 1. FIG. 22 is an enlarged perspective view of part of the pattern layer 15 in the embodiment shown in FIG. 21. In the pattern layer 15, the conductive pattern portions 22 are formed on the surface of the plate-shaped base 31 on the radio wave incident side. In FIG. 22, for facilitating understanding, the conductive pattern portions 22 are hatched with diagonal lines.

For example, the conductive pattern portions 22 in this embodiment may have a pattern in which pattern shape portions in the shape of a cross, having a single type of geometrical shape, are regularly arranged in a matrix so as to be spaced away from each other by gaps c1 and c2 in the x1 direction and the y1 direction of the rectangular coordinate system, which is obtained by angularly displacing the x direction and the y direction of the rectangular coordinate system by 45° about an axis perpendicular to the section of the diagram of FIG. 21. Thus, pattern shapes 61 constituting the conductive pattern portions 22 are formed in the shape of "X". The pattern shapes 61 in the shape of "X" are formed so that a rectangular shape portion 62 linearly extending in the x1 direction and a rectangular shape portion 63 linearly extending in the y1 direction intersect each other at right angles at an intersecting portion 64 so that the centroids of the shape portions 62 and 63 are overlapped. The shape portions 62 and 63 are displaced from each other by 90° about an axis perpendicular to the intersecting portion 64, and have the same shape. In the shape portions 62 and 63, for example, width a2=b1=2.5 mm and length a1=b2=17 mm. The shapes 61 may be arranged in the x1 direction and the y1 direction at gaps of c1=c2=1 mm. The pattern shape 61 has a linear structure having end portions, and a plurality of pattern shapes 61 are arranged so as not to be connected to each other. Furthermore, the shape portions 62 and 63 constituting the pattern shapes 61 have a linear structure having end portions, the shape portions 62 and 63 function as a unit, and the shape portions 62 and 63 in the unit in which the number of the portions is two or more (two in this embodiment) intersect each other at right angles at a portion that is not at the end portions. Also with this sort of configuration, a similar effect can be obtained. With the double-humped properties, a tag can be proposed that operates at two or more frequencies using one sheet member 10. It will be appreciated that a plurality of antennas have to be arranged on the tag, or a plurality of chips also have to be arranged in a case where the chip cannot be shared. However, when communication is performed, for example, at both frequencies in a high MHz band and a 2.4 GHz band, a tag can be proposed in which communication properties are improved even in a case where a communication jamming member is present.

Figure 23:
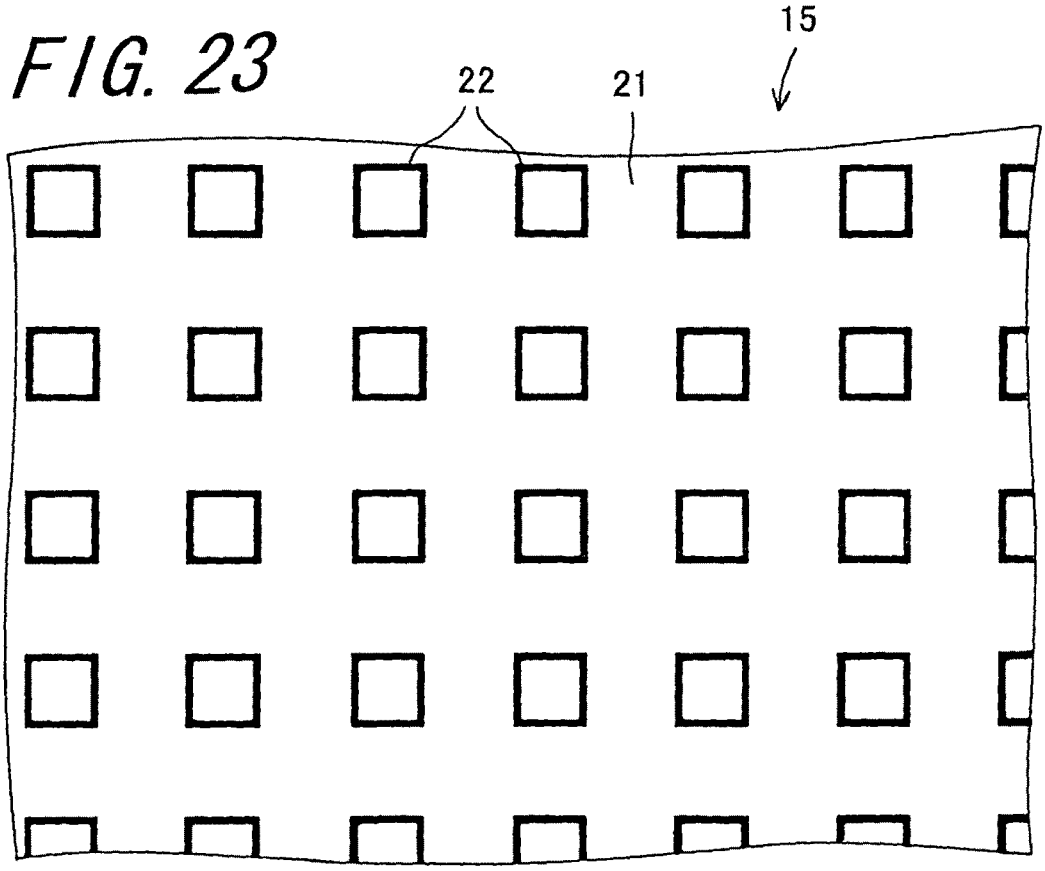
FIG. 23 is a front view of the pattern layer 15 showing double-humped properties according to another embodiment constituting the sheet member 10 in the embodiment shown in FIG. 1.
Figure 24:
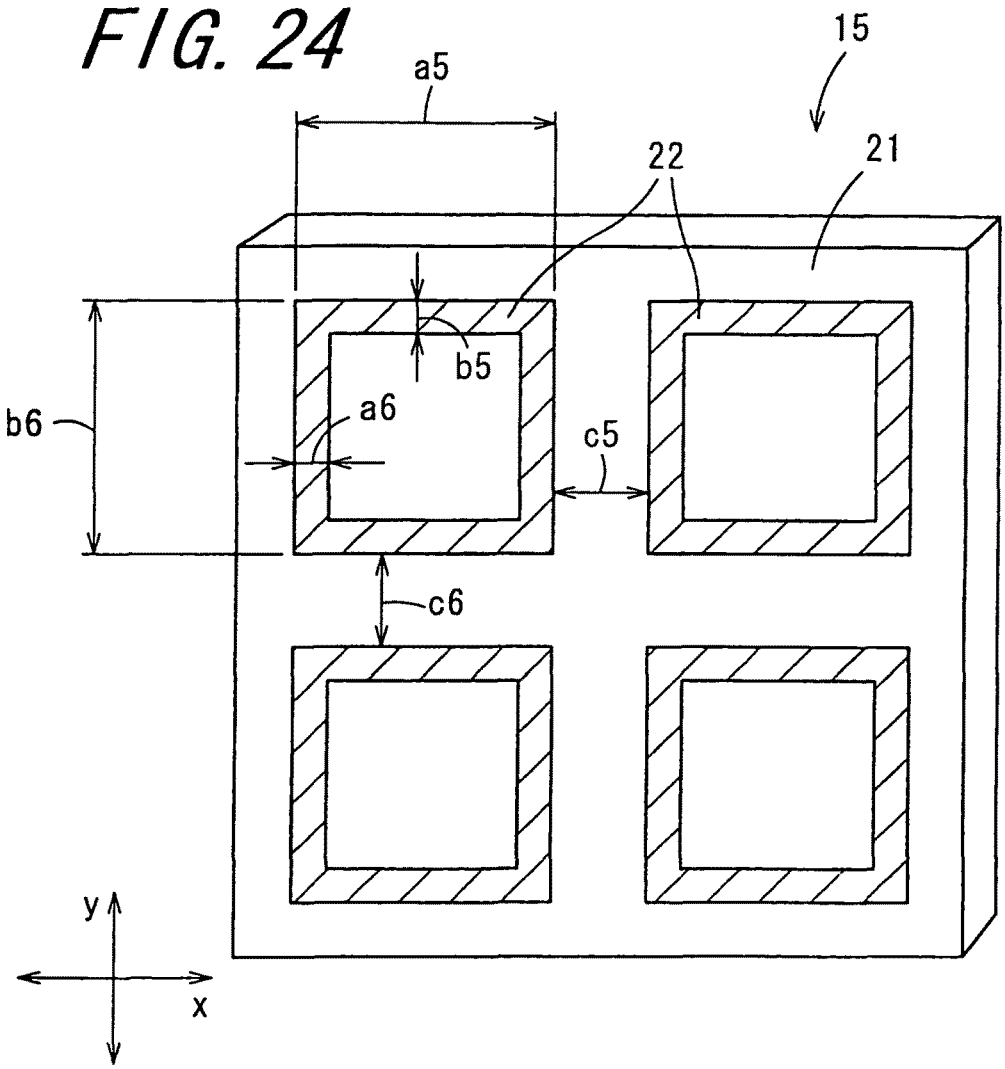
FIG. 24 is an enlarged perspective view of a part of the pattern layer 15 in the embodiment shown in FIG. 23.

FIG. 23 is a front view of the pattern layer 15 showing double-humped properties according to another embodiment constituting the sheet member 10 in the embodiment shown in FIG. 1. FIG. 24 is an enlarged perspective view of part of the pattern layer 15 in the embodiment shown in FIG. 23. In the pattern layer 15, the conductive pattern portions 22 are formed on the surface of the plate-shaped base 21 on the radio wave incident side. In FIG. 24, for facilitating understanding, the conductive pattern portions 22 are hatched with diagonal lines. For example, the conductive pattern portions 22 in this embodiment may have a pattern in which rectangular loop pattern shapes (in the shape of closed loops), having a single type of geometrical shape, are regularly arranged in a matrix so as to be spaced away from each other by a gap c5=c6 in the x direction and the y direction of the rectangular coordinate system. A plurality of pattern shapes are arranged so as not to be connected to each other. The gap may be set so that gap c5=c6=12 mm. Furthermore, the size may be set so that, for example, line width a6=b5=1 mm and one outer peripheral side a5=b6=10 mm.

Figure 25:
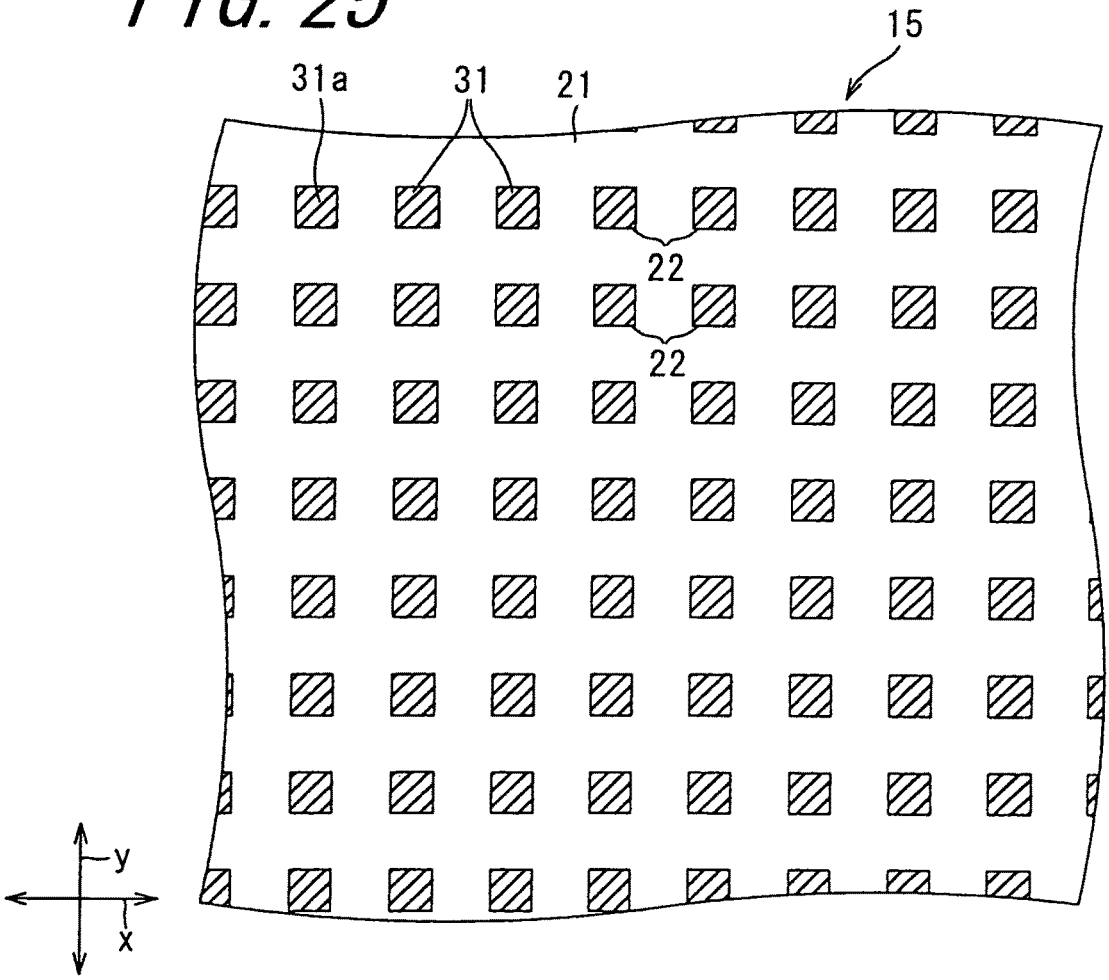
FIG. 25 is a front view of the pattern layer 15 according to another embodiment constituting the sheet member 10 in the embodiment shown in FIG. 1.
Figure 26:
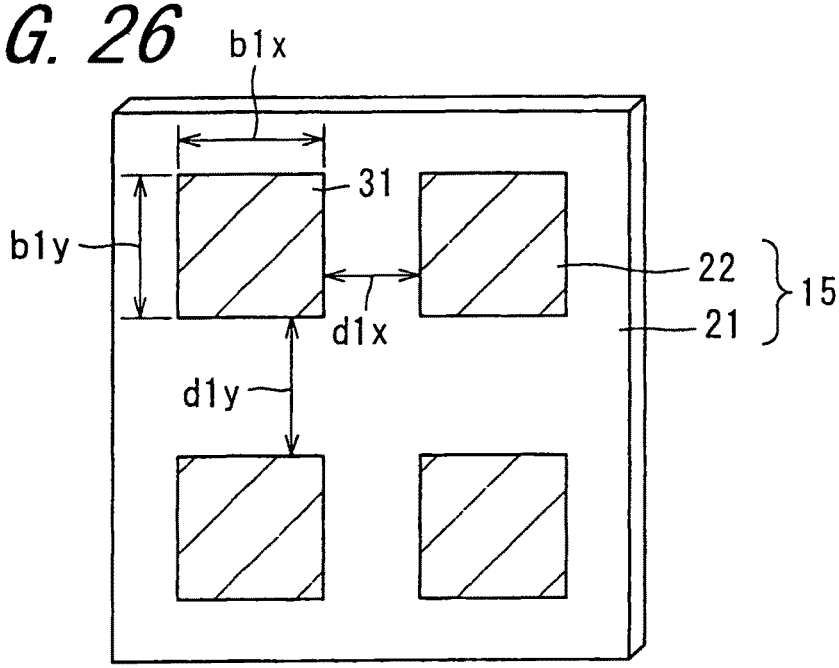
FIG. 26 is an enlarged perspective view showing a part of the pattern layer 15 shown in FIG. 25.

FIG. 25 is a front view of the pattern layer 15 according to another embodiment constituting the sheet member 10 in the embodiment shown in FIG. 1. FIG. 26 is an enlarged perspective view showing a part of the pattern layer 15 shown in FIG. 25. In FIGS. 25 and 26, for facilitating understanding, the conductive pattern portions 22 are hatched with diagonal lines. The conductive pattern portions 22 in this case are formed so that the rectangular pattern portions 31, having a single type of geometrical shape, are regularly arranged in a matrix so as to be spaced away from each other by gaps (hereinafter, referred to as 'pattern gaps') d1*x* and d1*y* in the x direction and the y direction. While the conductive pattern portions 22 of the pattern layer 15 shown in FIG. 1 have the radial pattern portions 30 and the rectangular pattern portions 31, the conductive pattern portions 22 of the pattern layer 15 in FIG. 25 only have the rectangular pattern portions 31.

The rectangular pattern shapes 31*a* are in the shape of a square, and the length b1*x* in the x direction and the length b1*y* in the y direction are the same, for example, 21.0 mm. Furthermore, regarding a second pattern gap, which is the gap between pattern shapes 59 adjacent to each other in the x direction and the y direction, the gap d1*x* in the x direction and the gap d1*y* in the y direction are the same, for example, 1.5 mm. Also with this sort of configuration, a similar effect can be obtained.

Figure 27:
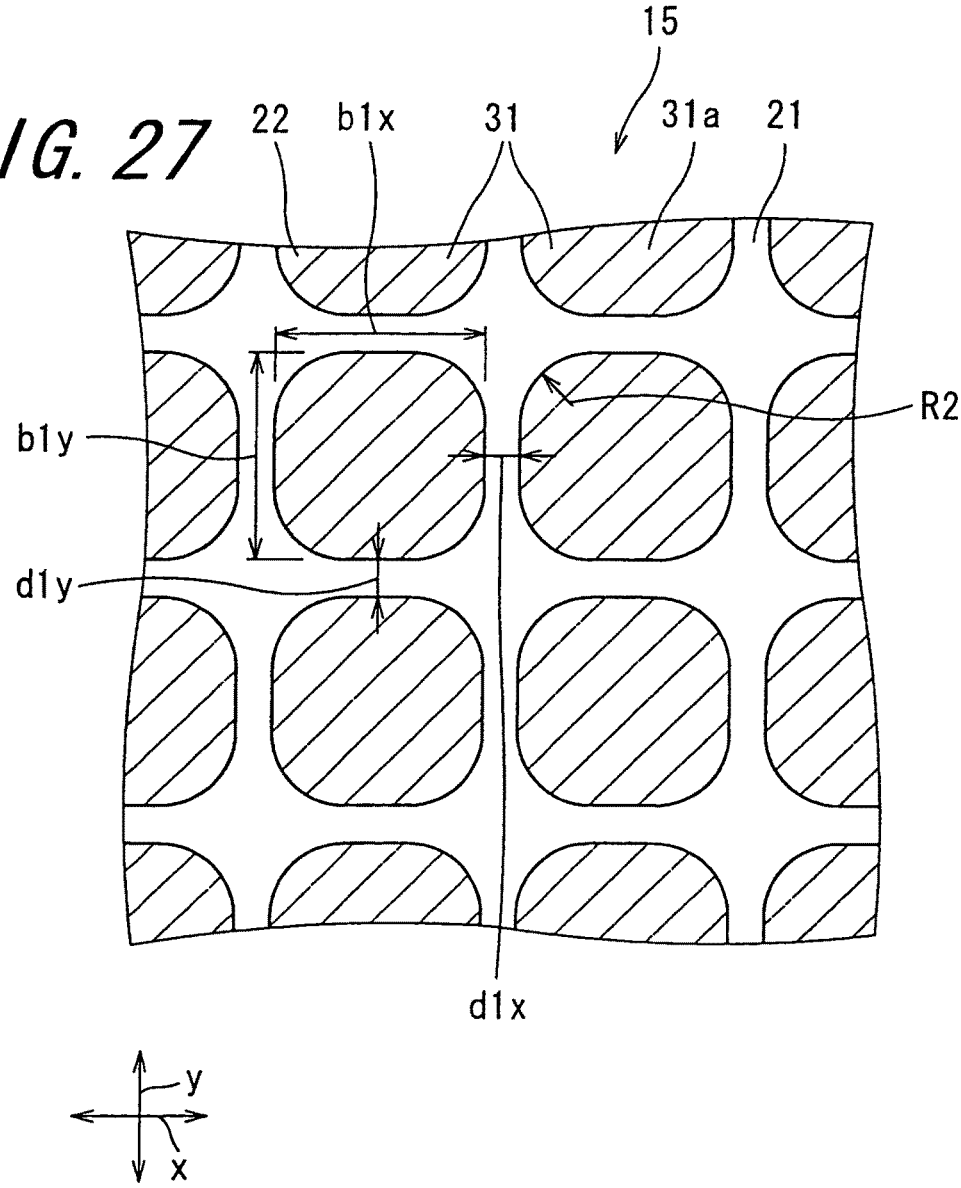
FIG. 27 is a front view showing the pattern layer 15 according to another embodiment constituting the sheet member 10 in the embodiment shown in FIG. 1.

FIG. 27 is a front view showing the pattern layer 15 according to another embodiment constituting the sheet member 10 in the embodiment shown in FIG. 1. In FIG. 27, for facilitating understanding, the conductive pattern portions 22 are hatched with diagonal lines. The conductive pattern portions 22 in this case are formed so that the rectangular pattern shapes 31*a*, having a single type of geometrical shape, are regularly arranged in a matrix so as to be spaced away from each other by the pattern gaps d1*x* and d1*y* in the x direction and the y direction. While the conductive pattern portions 22 of the pattern layer 15 shown in FIG. 1 have the radial pattern portions 30 and the rectangular pattern portions 31, the conductive pattern portions 22 of the pattern layer 15 in FIG. 25 only have the rectangular pattern portions 31.

The rectangular pattern shapes 31*a* are in the shape of a square, the length b1*x* in the x direction and the length b1*y* in the y direction are the same, for example, 21.0 mm, and the radius of curvature R2 of the corners is selected to be 10.0 mm. Furthermore, regarding a second pattern gap, which is the gap between the pattern shapes 59 adjacent to each other in the x direction and the y direction, the gap d1*x* in the x direction and the gap d1*y* in the y direction are the same, for example, 1.5 mm.

Figure 28:
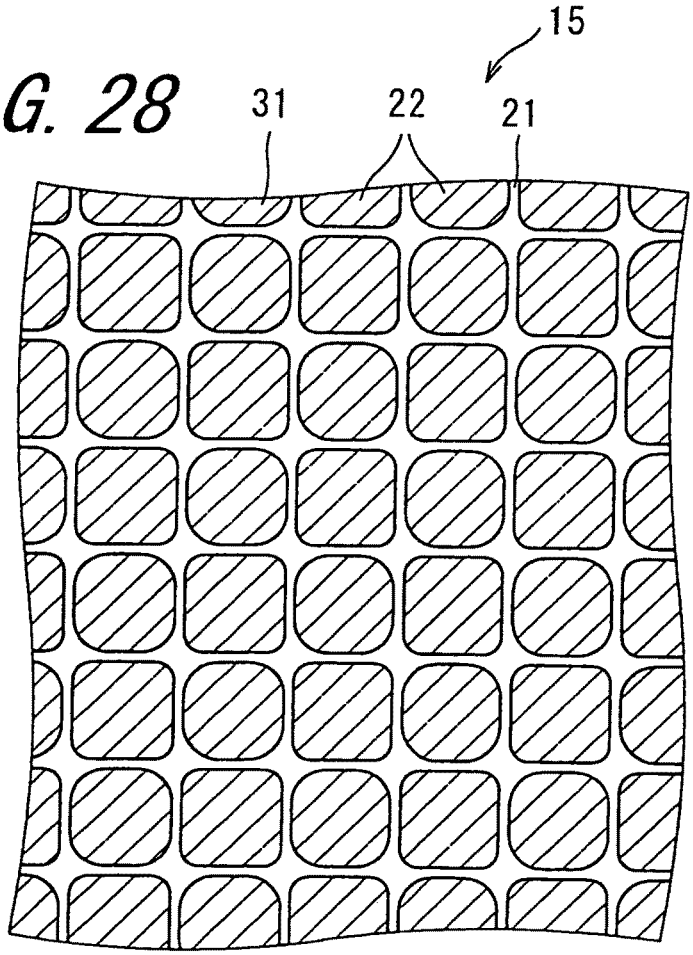
FIG. 28 is a front view showing the pattern layer 15 according to another embodiment constituting the sheet member 10 in the embodiment shown in FIG. 1.
Figure 29:
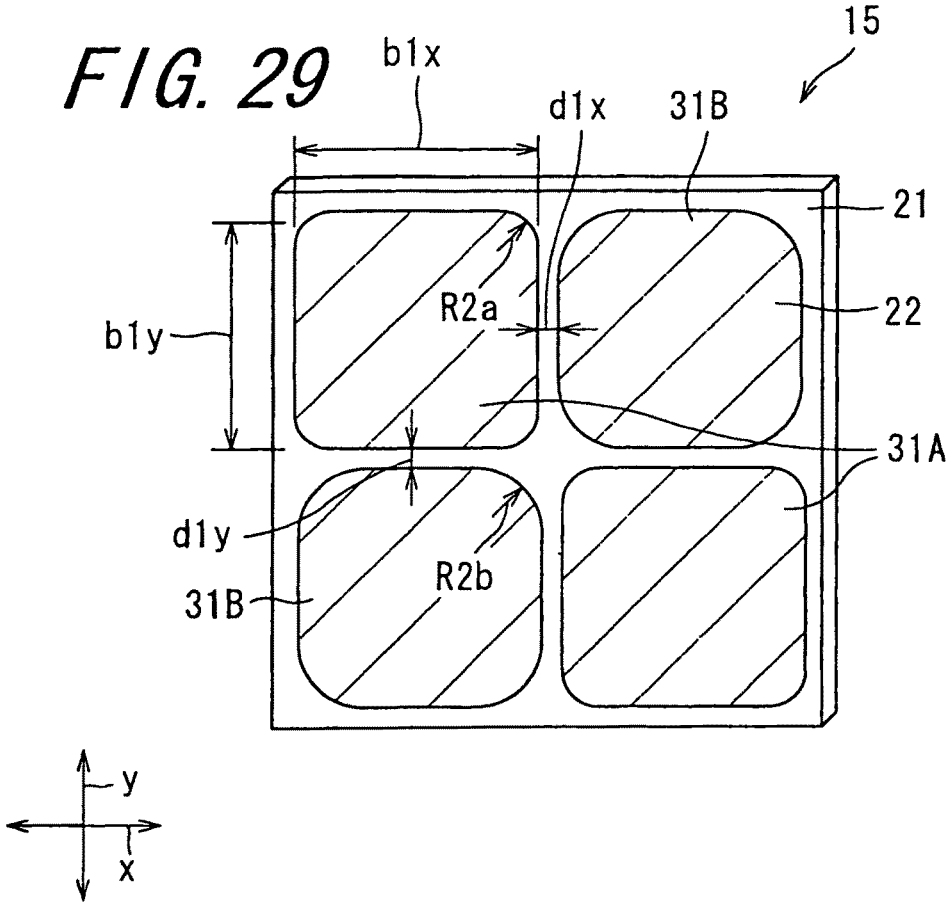
FIG. 29 is an enlarged perspective view showing a part of the pattern layer 15 shown in FIG. 28.

FIG. 28 is a front view showing the pattern layer 15 according to another embodiment constituting the sheet member 10 in the embodiment shown in FIG. 1. FIG. 29 is an enlarged perspective view showing a part of the pattern layer 15 shown in FIG. 28. In FIGS. 28 and 29, for facilitating understanding, the conductive pattern portions 22 are hatched with diagonal lines. The conductive pattern portions 22 in this case are formed so that rectangular pattern shapes 31A and 31B, having two types of geometrical shapes, are regularly arranged in a matrix so as to be spaced away from each other by the pattern gaps d1*x* and d1*y* in the x direction and the y direction. The first and the second rectangular pattern shapes 31A and 31B are alternately arranged in the x direction. Furthermore, the first and the second rectangular pattern shapes 31A and 31B are alternately arranged in the y direction.

The first and the second rectangular pattern shapes 31A and 31B are substantially in the shape of a square, and the first rectangular pattern shape 31A and the second rectangular pattern shape 31B have different radiuses of curvature of the corners. The radius of curvature R2*a* of the corners of the first rectangular pattern portion 31A is selected to be smaller than the radius of curvature of the corners of the second rectangular pattern portion 31B. The length b1*x* in the x direction and the length b1*y* in the y direction are the same, for example, 21.0 mm, and the radiuses of curvature R2*a* and R2*b* of the corners are respectively selected to be 4.0 mm and 7.0 mm. Furthermore, regarding a second pattern gap, which is the gap between the pattern shapes 59 adjacent to each other in the x direction and the y direction, the gap d1*x* in the x direction and the gap d1*y* in the y direction are the same, for example, 1.5 mm. Also with this sort of configuration, a similar effect can be obtained.

Figure 30:
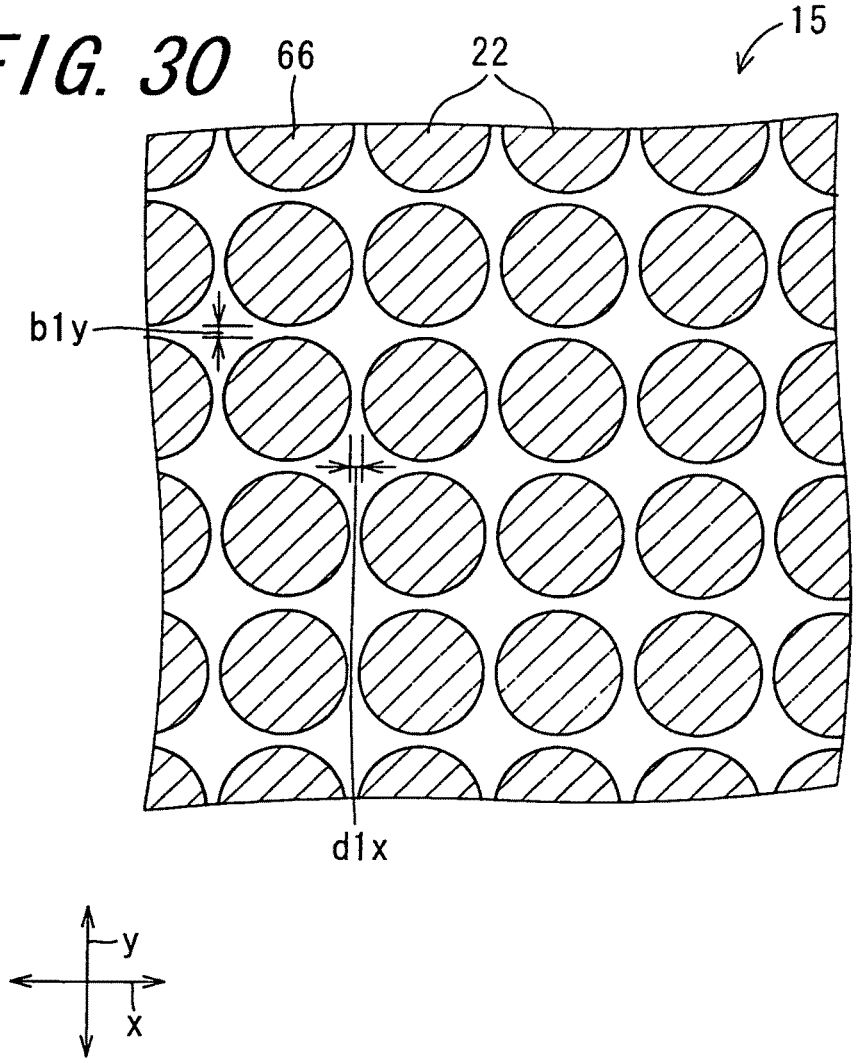
FIG. 30 is a front view of the pattern layer 15 according to still another embodiment constituting the sheet member 10 in the embodiment shown in FIG. 1.

FIG. 30 is a front view of the pattern layer 15 according to still another embodiment constituting the sheet member 10 in the embodiment shown in FIG. 1. In FIG. 30, for facilitating understanding, the conductive pattern portions 22 are hatched with diagonal lines. The conductive pattern portions 22 in this case are formed so that pattern shapes 66, having a single type of geometrical shape, are regularly arranged in a matrix so as to be spaced away from each other by the pattern gaps d1*x* and d1*y* in the x direction and the y direction.

The pattern shapes 66 are circular, and a radius r is, for example, 13 mm. Furthermore, regarding a pattern gap, which is the gap between the pattern shapes 66 adjacent to each other in the x direction and the y direction, the gap d1*x* in the x direction and the gap d1*y* in the y direction are the same, for example, 8 mm. Also with this sort of configuration, a similar effect can be obtained.

Figure 31:
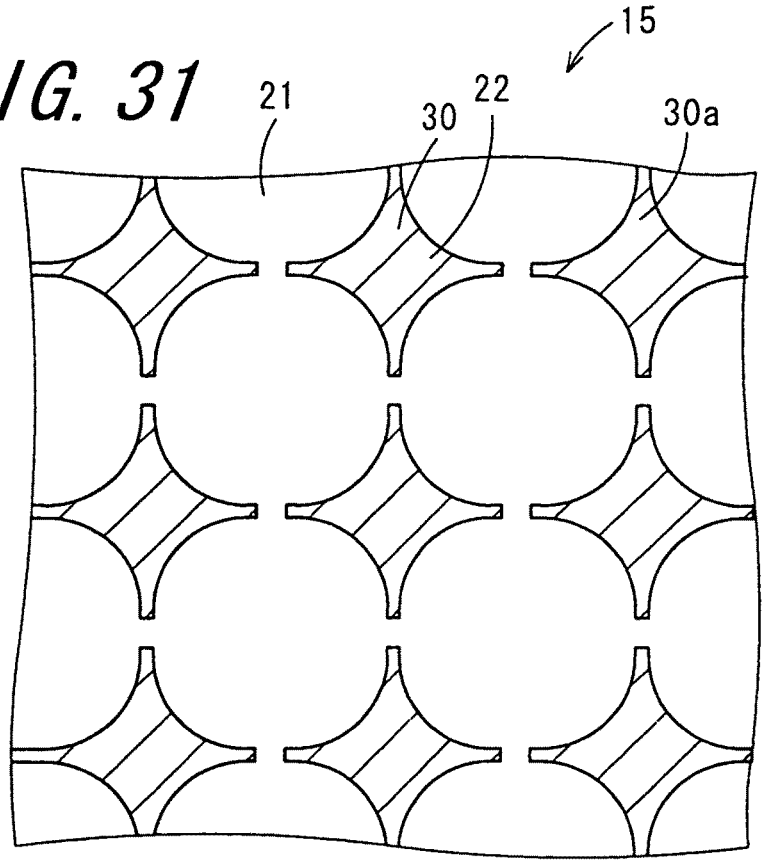
FIG. 31 is a front view of the pattern layer 15 according to still another embodiment constituting the sheet member 10 in the embodiment shown in FIG. 1.

FIG. 31 is a front view of the pattern layer 15 according to still another embodiment constituting the sheet member 10 in the embodiment shown in FIG. 1. In FIG. 31, for facilitating understanding, the conductive pattern portions 22 are hatched with diagonal lines. While the conductive pattern portions 22 of the pattern layer 15 shown in FIG. 4 have the radial pattern portions 30 and the rectangular pattern portions 31, the conductive pattern portions 22 of the pattern layer 15 in FIG. 31 only have the radial pattern portions 30. Also with this sort of configuration, a similar effect can be obtained.

Figure 32:
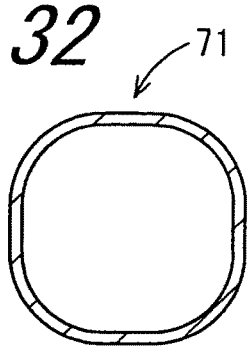
FIG. 32 is a front view showing a rectangular pattern shape 71 according to another embodiment.

FIG. 32 is a front view showing a rectangular pattern shape 71 according to another embodiment. In this embodiment, instead of the rectangular pattern shapes 31*a* in FIGS. 4, 16, 17, 18, 19, 25, 27, and 28, the rectangular pattern shape 71 shown in FIG. 32 is used. The other constituent elements in the configuration are the same as those in the embodiment shown in FIG. 1. While the rectangular pattern shapes 31*a* shown in FIGS. 4, 16, 17, 18, 19, 25, 27, and 28 are planar patterns, the rectangular pattern shape 71 in FIG. 32 is a pattern in the shape of a strip (belt) forming a closed loop extending along the outer peripheral edge. Also with this sort of configuration, a similar effect can be obtained.

Figure 33:
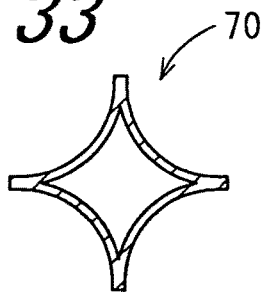
FIG. 33 is a front view showing a radial pattern shape 70 according to still another embodiment of the invention.

FIG. 33 is a front view showing a radial pattern shape 70 according to still another embodiment of the invention. In this embodiment, instead of the radial pattern shapes 30*a* shown in FIGS. 4, 16, 17, 18, 19, and 31, the radial pattern shape 70 shown in FIG. 33 is used. The other constituent elements in the configuration are the same as those in the embodiment shown in FIG. 1. While the radial pattern shapes 30*a* shown in FIGS. 4, 16, 17, 18, 19, and 31 are planar patterns, the radial pattern shape 70 in FIG. 33 is a pattern in the shape of a strip (belt) forming a closed loop extending along the outer peripheral edge. Also with this sort of configuration, a similar effect can be obtained.

Figure 34:
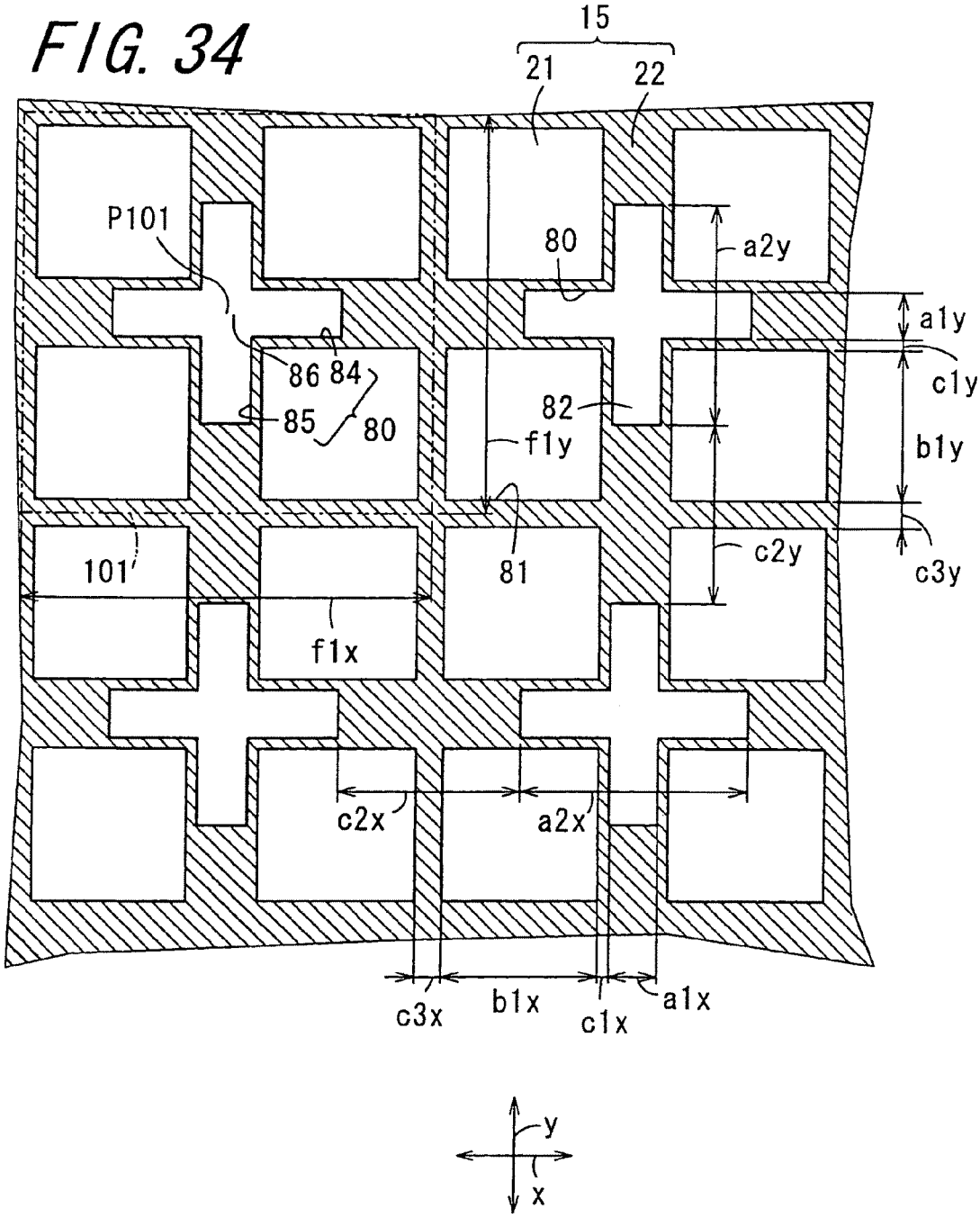
FIG. 34 is a front view of the pattern layer 15 according to still another embodiment constituting the sheet member 10 in the embodiment shown in FIG. 1.

FIG. 34 is a front view of the pattern layer 15 according to still another embodiment constituting the sheet member 10 in the embodiment shown in FIG. 1. In FIG. 34, for facilitating understanding, the conductive pattern portions 22 are hatched with diagonal lines. In the pattern layer 15, the conductive pattern portions 22 made of a metal are formed on the surface of the plate-shaped base 21 on the electromagnetic wave incident side.

The conductive pattern portions 22 are continuously formed in an electrically connected manner over a wide range, more specifically, the entire range of the sheet member 10, in directions intersecting the electromagnetic wave incident direction, more specifically, in the x direction and the y direction that are perpendicular to the thickness direction and that are perpendicular to each other. On the conductive pattern portions 22 functioning as continuously arranged conductive elements, a plurality of holes 80 and 81 are formed. Each of the holes 80 and 81 has a shape selected from polygons (including rectangles, which are types of quadrangles), circles, substantially polygonal shapes in which the outline at the corners is curved, shapes extending in the shape of a string, and combinations thereof. The shapes extending in the shape of a string are a linearly extending shapes, and may extend in a straight line, may extend in a curved line (e.g., a spiral), or may be bent at an intermediate portion.

More specifically, in the conductive pattern portions 22, a plurality of types of holes in which at least one of shape and size is different therebetween, more specifically, the cross holes 80 and the rectangular holes 81 are formed.

The cross hole 80 is formed in the shape of a cross, and a plurality of cross holes 80 are spaced away from each other by gaps (hereinafter, referred to as 'cross hole gaps') c2*x* and c2*y*. More specifically, the cross holes 80 are arranged so that radially extending portions 82 face each other, and the radially extending portions 82 facing each other are spaced away from each other by the cross hole gaps c2*x* and c2*y*. More specifically, for example, in this embodiment, the cross holes 80 may be formed in the shape of crosses radially extending in the x direction and the y direction that are perpendicular to each other, and regularly arranged in a matrix in which the cross hole gap c2*x* is interposed in the x direction and the cross hole gap c2*y* is interposed in the y direction.

The cross hole 80 has a shape in which a rectangular shape portion 84 linearly extending in the x direction and a rectangular shape portion 85 linearly extending in the y direction intersect each other at right angles at an intersecting portion 86 so that the centroids of the shape portions 84 and 85 are overlapped. The shape portions 84 and 85 are displaced from each other by 90° about an axis perpendicular to the intersecting portion 86, and have the same shape. Widths a1*y* and a1*x* of the shape portions 84 and 85 are the same, for example, 8 mm. Lengths a2*x* and a2*y* of the shape portions 84 and 85 are the same, for example, 38 mm. Regarding the cross hole gaps of the cross holes 80, the gap c2*x* in the x direction and the gap c2*y* in the y direction are the same, for example, 32 mm.

The rectangular holes 81 are arranged in a region enclosed by the cross holes 80 so as to be spaced away from the cross holes 80 by gaps (hereinafter, referred to as 'cross rectangular portion gaps') c1*x* and c1*y* so that the rectangular holes 81 cover the region enclosed by the cross holes 80. More specifically, the rectangular holes 81 divide the region enclosed by the cross holes 80 into four, and are arranged respectively in the regions obtained by the division. Accordingly, in one region enclosed by the cross holes 80, four rectangular holes 81 are formed.

The rectangular holes 81 are formed into a shape corresponding to the region enclosed by the cross holes 80. For example, in this embodiment, the cross hole 80 is in the shape of a cross as described above, and the region enclosed by the cross holes 80 is rectangular, that is, in the shape of a rectangle corresponding thereto. In a case where the shape portions 84 and 85 have the same shape as described above, the region enclosed by the cross holes 80 is in the shape of a square, the rectangular holes 81 are in the shape of a square.

Four rectangular holes 80 in one region enclosed by the cross holes 80 are arranged so that the edge side portions extend in either the x direction or the y direction, and the rectangular holes are arranged in a matrix in the x direction and the y direction. The region in which the four rectangular holes are arranged is in the shape of a quadrangle, more specifically, a square. Cross rectangular gaps c1*x* and c1*y*, which are the distance between the region and the cross holes 80, are formed to have the same shape throughout the entire periphery.

From another point of view, the holes 80 and 81 are arranged so that, when a hole group having four rectangular holes 81 and one cross hole 80 is taken as one unit, a plurality of unit hole groups are regularly arranged in directions intersecting the electromagnetic wave incident direction, more specifically, the groups are arranged in a matrix in the x direction and the y direction. In one hole group, four rectangular holes 81 are arranged in a matrix in the x direction and the y direction, and the cross hole 80 is disposed in a region in the shape of a cross formed between the four rectangular holes 81.

The size b1*x* in the x direction and the size b1*y* in the y direction of the rectangular holes 81 are the same, for example, 27 mm. Regarding the cross rectangular portion gaps between the cross holes 80 and the rectangular holes 81, the gap c1*x* in the x direction and the gap c1*y* in the y direction are the same, for example, 2 mm. Furthermore, regarding gaps (hereinafter, referred to as 'rectangular hole gaps') c3*x* and c3*y* between four rectangular holes 81 in the region enclosed by the cross holes 80, the gap c3*x* in the x direction and the gap c3*y* in the y direction are the same, for example, 4 mm.

Accordingly, the conductive pattern portion 22 has, as one unit element portion 101, an element portion having a shape in which the above-described unit hole group is cut out from a square defined by two sides parallel to the x direction and two sides parallel to the y direction. The unit element portion 101 is symmetric about a center point P101 and is rotationally symmetric having the same shape each time the unit element portion 101 is rotated by 90° about the center point P101. The unit element portion 101 is symmetric with respect to a straight line that passes through the center point P101 and that is parallel to the x direction, and is symmetric with respect to a straight line that passes through the center point P101 and that is parallel to the y direction. The conductive pattern portions 22 have a shape in which a plurality of unit element portions 101 are moved in parallel in the x direction and the y direction to be arranged in a matrix. This shape is also a shape in which the unit element portions 101 and symmetrical unit element portions that are symmetric to the unit element portions 101 with respect to the x direction and the y direction are alternately arranged in a checkered pattern. A size f1*x* in the x direction and a size f1*y* in the y direction, which also function as the arrangement pitch of the unit element portions 101, are, for example, 70 mm. The cross holes 80 and the rectangular holes 81 are polygonal, and all corners are sharp-pointed, that is, formed in the shape of angled edges. Also with this sort of configuration, a similar effect can be obtained.

Figure 35:
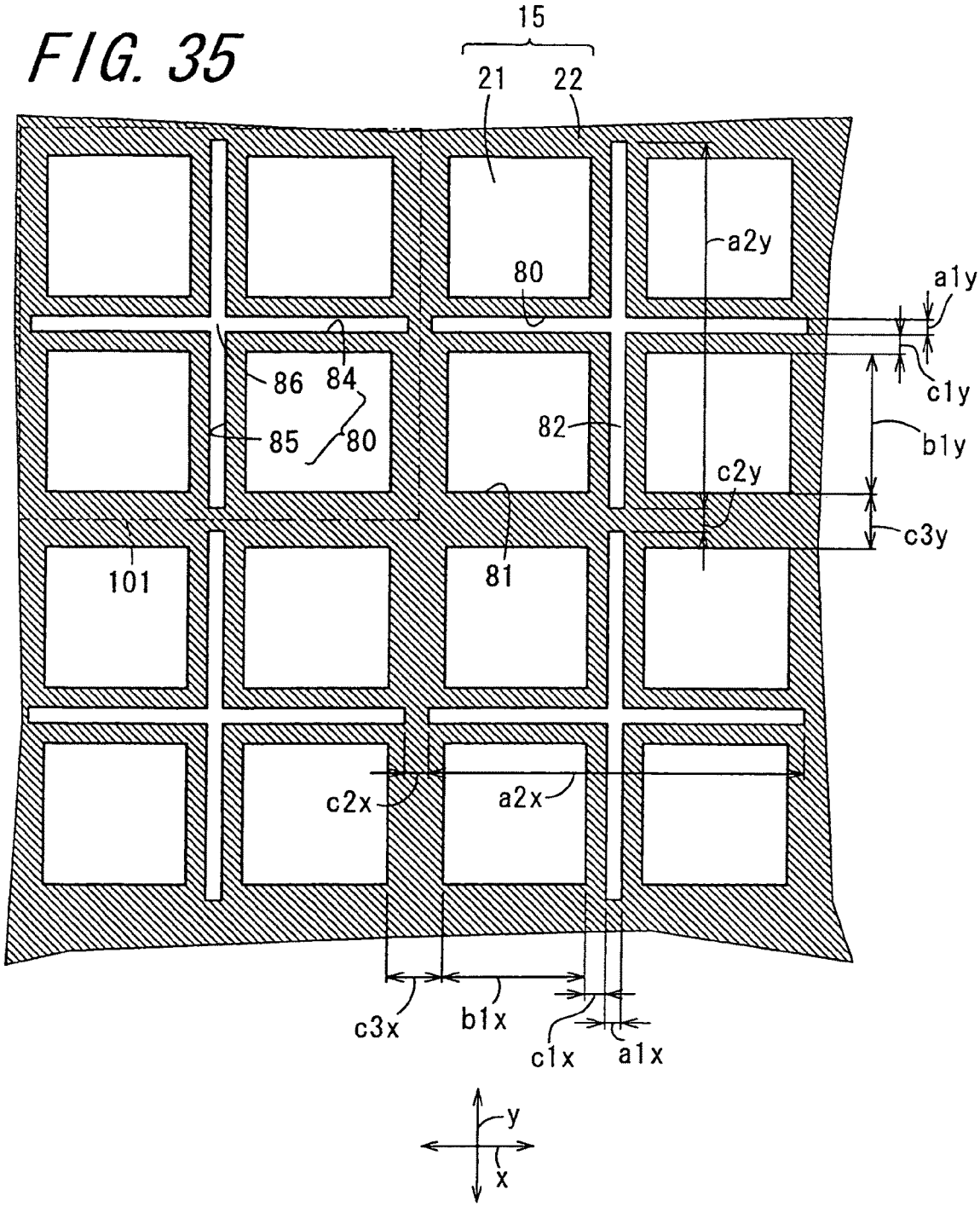
FIG. 35 is a front view showing another pattern layer 15 whose configuration is different in size from that of the pattern layer 15 in FIG. 34, according to still another embodiment of the invention.

FIG. 35 is a front view showing another pattern layer 15 whose configuration is different in size from that of the pattern layer 15 in FIG. 34, according to still another embodiment of the invention. In FIG. 34, for facilitating understanding, the conductive pattern portions 22 are hatched with diagonal lines. Since the configuration, except for size, is similar to the configuration described with reference to FIG. 33, the corresponding constituent elements are denoted by the same numerals, and only size, which is a different aspect, will be described. Instead of the pattern layer 15 shown in FIG. 3, this pattern layer 15 can be used for the sheet member 10. The widths a1*y* and a1*x* of the shape portions 84 and 85 are, for example, 6 mm, and the lengths a2*x* and a2*y* of the shape portions 84 and 85 are, for example, 132 mm. The cross hole gaps c2*x* and c2*y* are, for example, 8 mm. Furthermore, the sizes b1*x* and b1*y* of the rectangular holes 81 are, for example, 50 mm. The cross rectangular gaps c1*x* and c1*y* are, for example, 7 mm. Furthermore, the rectangular hole gaps c3*x* and c3*y* are, for example, 20 mm. Furthermore, the sizes f1*x* and f1*y* of the unit element portion 101 are, for example, 140 mm. Also in the conductive pattern portions 22 shown in FIG. 35, the rectangular holes 81 correspond to the same size portions. Hereinafter, the same size portions may be denoted by the same numeral 81 as that for the rectangular holes.

Figure 36:
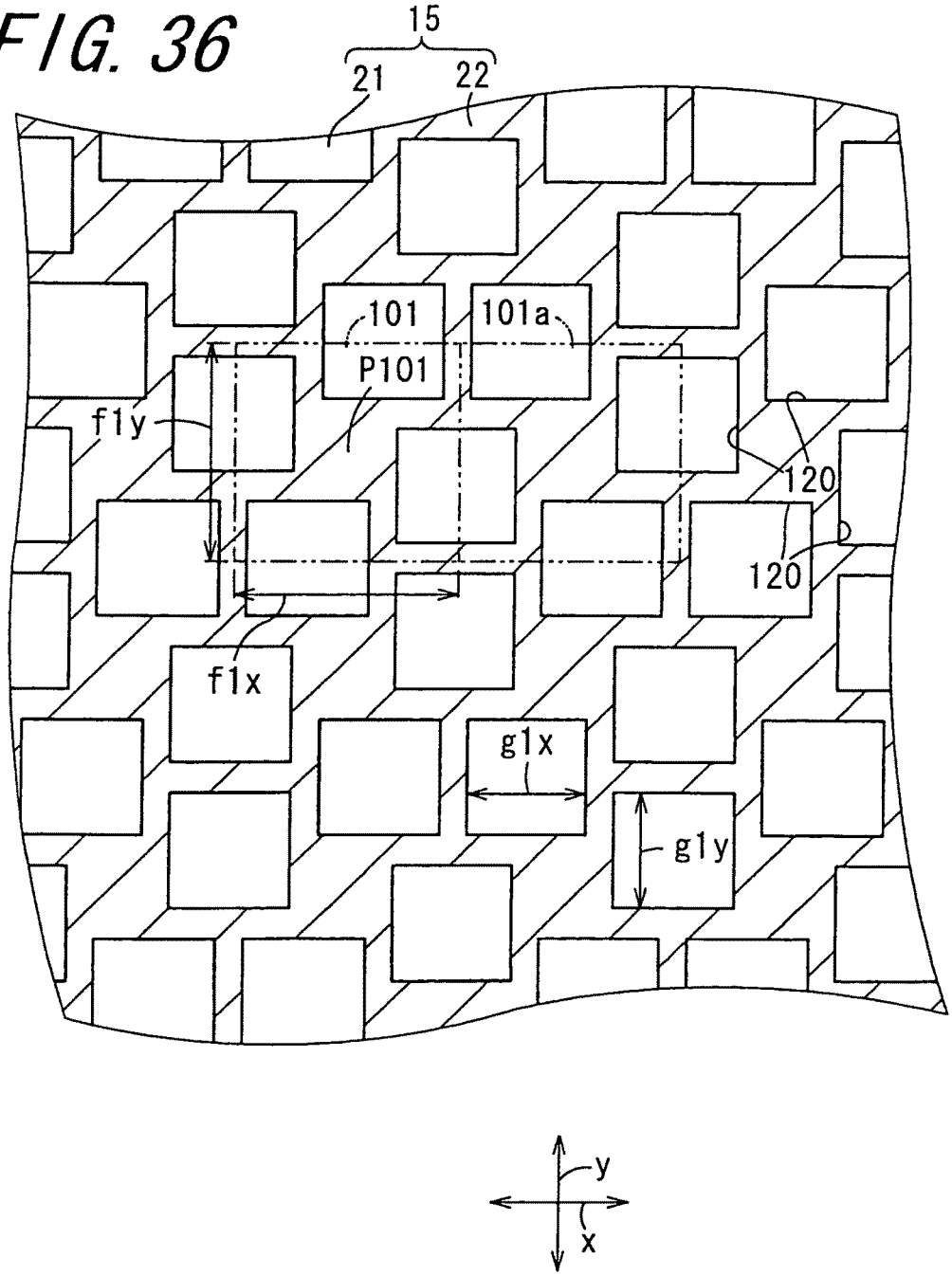
FIG. 36 is a front view showing another pattern layer 15 that can be used as still another embodiment of the invention.

FIG. 36 is a front view showing another pattern layer 15 that can be used as still another embodiment of the invention. In FIG. 36, for facilitating understanding, the conductive pattern portions 22 are hatched with diagonal lines. The constituent elements corresponding to those in the pattern layer 15 shown in FIG. 34 are denoted by the same numerals, and only different constituent elements in the configuration will be described. Instead of the pattern layer 15 shown in FIG. 3, this pattern layer 15 can be used for the sheet member 10. In the pattern layer 15 shown in FIG. 36, the conductive pattern portions 22 are different in shape from the conductive pattern portions 22 shown in FIG. 34. In the conductive pattern portions 22 shown in FIG. 36, a plurality of holes 120 are formed.

Each of the holes 120 is in the shape of a polygon in which all interior angles are smaller than 180°, and may be in the shape of a regular polygon. In this embodiment, each of the holes 120 is quadrangular, and specifically, rectangular. The rectangular shapes include square shapes. More specifically, each of the holes 120 is in the shape of a square defined by two sides parallel to the x direction and two sides parallel to the y direction, and the rectangular holes 120 are arranged in a predetermined pattern that is not a matrix pattern.

More specifically, the conductive pattern portion 22 has a unit element portion 101 having a shape in which four rectangles (rectangles obtained by cutting each the holes 120 into half along a straight line parallel to one side thereof) are formed as portions cut out from a square defined by two sides parallel to the x direction and two sides parallel to the y direction. The unit element portion 101 has a shape in which each of the four cut-out portions is disposed at each side portion of the unit element portion 101 so that the side of the cut-out portion matches the side of the unit element portion 101 and opens outward. Furthermore, the center positions of the four cut-out portions are displaced from the midpoints of the respective sides of the unit element portion 101 by the same displacement amount in one peripheral direction about the center position P101 of the unit element portion 101. In the four cut-out portions, the size of the side matching the side of the unit element portion 101 is the same as the size of one of two adjacent sides of the hole 120, and the size of the side perpendicular to the side of the unit element portion 101 is ½ of the size of the other side of the of two adjacent sides of the hole 120.

The unit element portion 101 is symmetric about a center point P101, and is rotationally symmetric having the same shape each time the unit element portion 101 is rotated by 90° about the center point P101. The conductive pattern portions 22 have a shape in which a plurality of unit element portions 101 and a plurality of symmetrical unit element portions 101*a* that are symmetric to the unit element portions 101 with respect to the x direction and the y direction are alternately arranged in a checkered pattern. The pattern layer 15 with the conductive pattern portions 22 having this shape can be used in a similar manner instead of the pattern layer 15 shown in FIG. 3, and the sheet member 10 can be formed including this pattern layer 15 shown in FIG. 35. The size f1*x* in the x direction and the size f1*y* in the y direction of the unit element portion 101 are, for example, 70 mm.

The pattern layer 15 shown in FIG. 36 will be described more specifically. Each of the holes 120 is in the shape of a square. Each of the cut-out portions formed in the unit element portion 101 is in the shape of a rectangle in which the size of the longer side is the same as the size of one side of the hole 120, and the size of the shorter side is ½ of the size of one side of the hole 120. Each of the cut-out portions is arranged so that the longer side matches the side of the unit element portion 101. When the unit element portions 101 in which the cut-out portions are formed and the symmetrical unit element portions 101*a* that are symmetric thereto are arranged in a checkered pattern as described above, the pattern layer 15 in which a plurality of square holes 120 are formed can be obtained. A size g1*x* in the x direction and a size g1*y* in the y direction of each of the holes 120 are the same, for example, 40 mm. In this embodiment, the holes 120 correspond to the same size portions. Hereinafter, the same size portions may be denoted by the same numeral as that for the holes 120.

Figure 37:
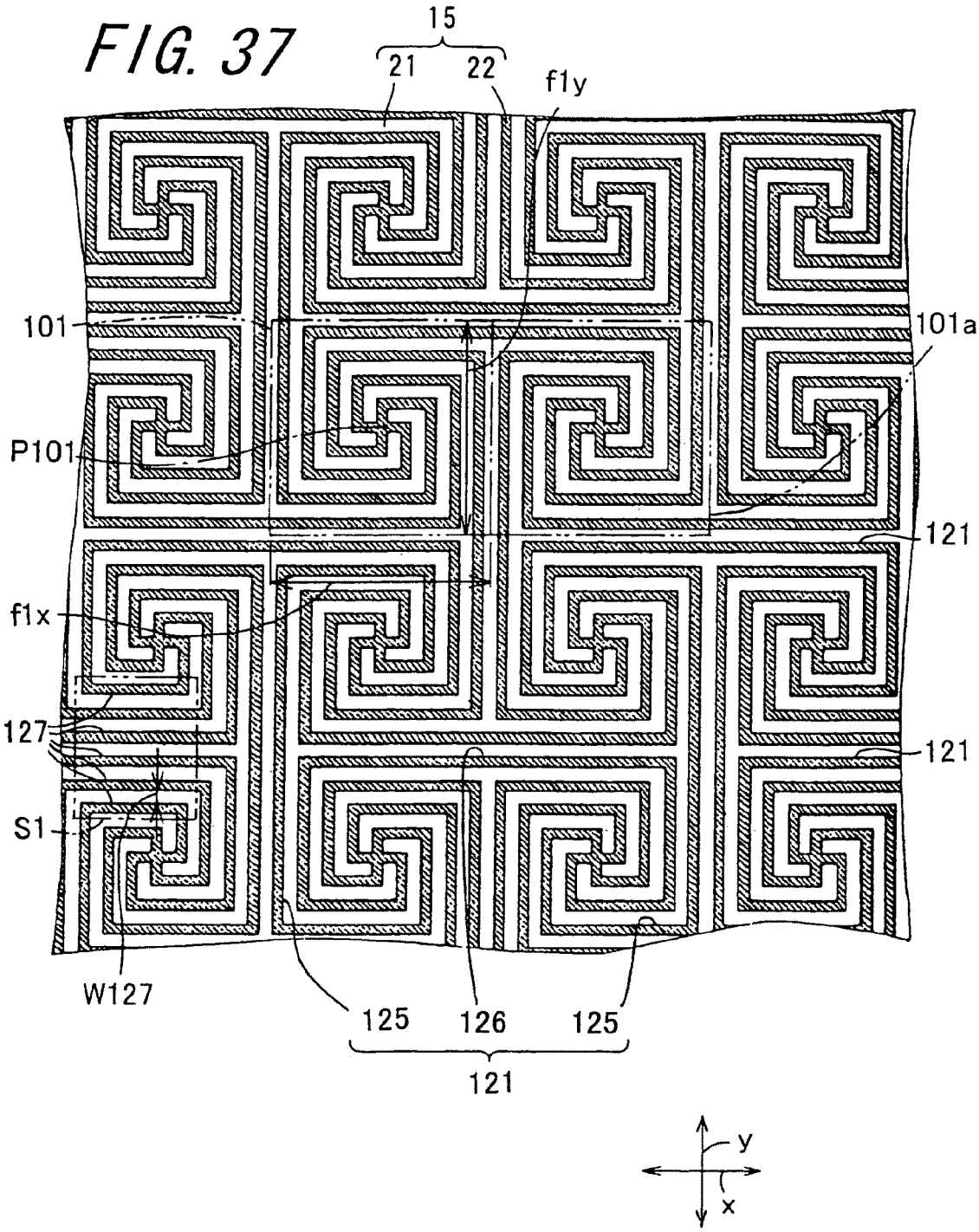
FIG. 37 is a front view showing another pattern layer 15 that can be used as still another embodiment of the invention.

FIG. 37 is a front view showing another pattern layer 15 that can be used as still another embodiment of the invention. In FIG. 37, for facilitating understanding, the conductive pattern portions 22 are hatched with diagonal lines. The constituent elements corresponding to those in the pattern layer 15 shown in FIG. 34 are denoted by the same numerals, and only different constituent elements in the configuration will be described. Instead of the pattern layer 15 shown in FIG. 3, this pattern layer 15 can be used for the sheet member 10. In the pattern layer 15 shown in FIG. 37, the conductive pattern portions 22 are different in shape from the conductive pattern portions 22 shown in FIG. 34.

In the conductive pattern portions 22 shown in FIG. 37, a plurality of holes 121 are formed. Each of the holes 121 has a shape in which two C-shaped portions 125, in which a plurality of line segment portions are bent at right angles and connected to be substantially in the shape of Cs, are arranged so that the recessed sides oppose each other, and the center portions of the C-shaped portions are connected by a linear connecting portion 126. The holes 121 having this shape are formed in an arrangement following a predetermined pattern in which one of the C-shaped portions 125 is fitted to the recessed portion on one side with respect to the connecting portion 126 of another hole 121, and the C-shaped portions 125 are intertwined. Each line segment portion of each of the C-shaped portions 125 and each of the connecting portions 126 are parallel to the x direction or the y direction.

More specifically, the conductive pattern portion 22 has a unit element portion 101 having a shape in which four hookshaped portions are arranged in the peripheral direction and cut out in the shape of a spiral from a square defined by two sides parallel to the x direction and two sides parallel to the y direction. Each hook portion has a shape in which five line segment portions are connected at four bent portions, and the size of the line segment portion becomes smaller toward the inner side of the unit element portion 101. The line segment portion on the outermost side is disposed along a side of the unit element portion 101, and opens outward in the unit element portion 101. The unit element portion 101 has a shape in which a plurality of (five in this embodiment) line segment portions parallel to the x direction or the y direction are connected so as to be bent at right angles, and formed in the shape of a spiral extending outward in the radial direction while being rotated toward one side in the peripheral direction, so that a fylfot-shaped portion where the intersecting portions are integrally connected at the center point P101 is formed.

The unit element portion 101 is symmetric about a center point P101, and is rotationally symmetric having the same shape each time the unit element portion 101 is rotated by 90° about the center point P101. The conductive pattern portions 22 have a shape in which a plurality of unit element portions 101 and a plurality of symmetrical unit element portions 101*a* that are symmetric to the unit element portions 101 with respect to the x direction and the y direction are alternately arranged in a checkered pattern. In this manner, the conductive pattern portions 22 have a shape in which a plurality of spiral portions are mutually connected. The pattern layer 15 with the conductive pattern portions 22 having this shape can be used in a similar manner instead of the pattern layer 15 shown in FIG. 3, and the sheet member 10 can be formed including this pattern layer 15 shown in FIG. 37. The size f1*x* in the x direction and the size f1*y* in the y direction of the unit element portion 101 are, for example, 63 mm.

From another point of view, in the conductive pattern portions 22 shown in FIG. 37, the holes 121 are formed so that a plurality of different size portions 127 extending in one direction are arranged in a direction intersecting the one direction, for example, focusing on a region S1 enclosed by the virtual line. In the region S1, the different size portions 127 extend in the x direction and are arranged in the y direction. In the conductive pattern portions 22, a plurality of regions having the same shape as the region S1 are present, and a plurality of regions having the shape obtained by rotating the region S1 by 90° are present.

In this manner, the conductive pattern portions 22 shown in FIG. 37 are continuously arranged conductive elements that are continuously formed in an electrically connected manner across a face intersecting the electromagnetic wave incident direction, and a plurality of holes 121 are formed therein. The holes 121 have the different size portions 127 in which the sizes in two directions intersecting each other at right angles in a state where the conductive pattern portions 22 are arranged along a plane are different from each other. The different size portions 127 are arranged in a direction of the smaller size of the sizes in the two directions. Herein, the two directions are the x direction and the y direction. A width w127 of the different size portions 127, which is the smaller size of the sizes in the two directions of the different size portions 127 is, for example, 4 mm, and a length of the different size portions 127, which is the larger size of the sizes in the two directions of the different size portions 127, is twice or more than the width w127.

Figure 38:
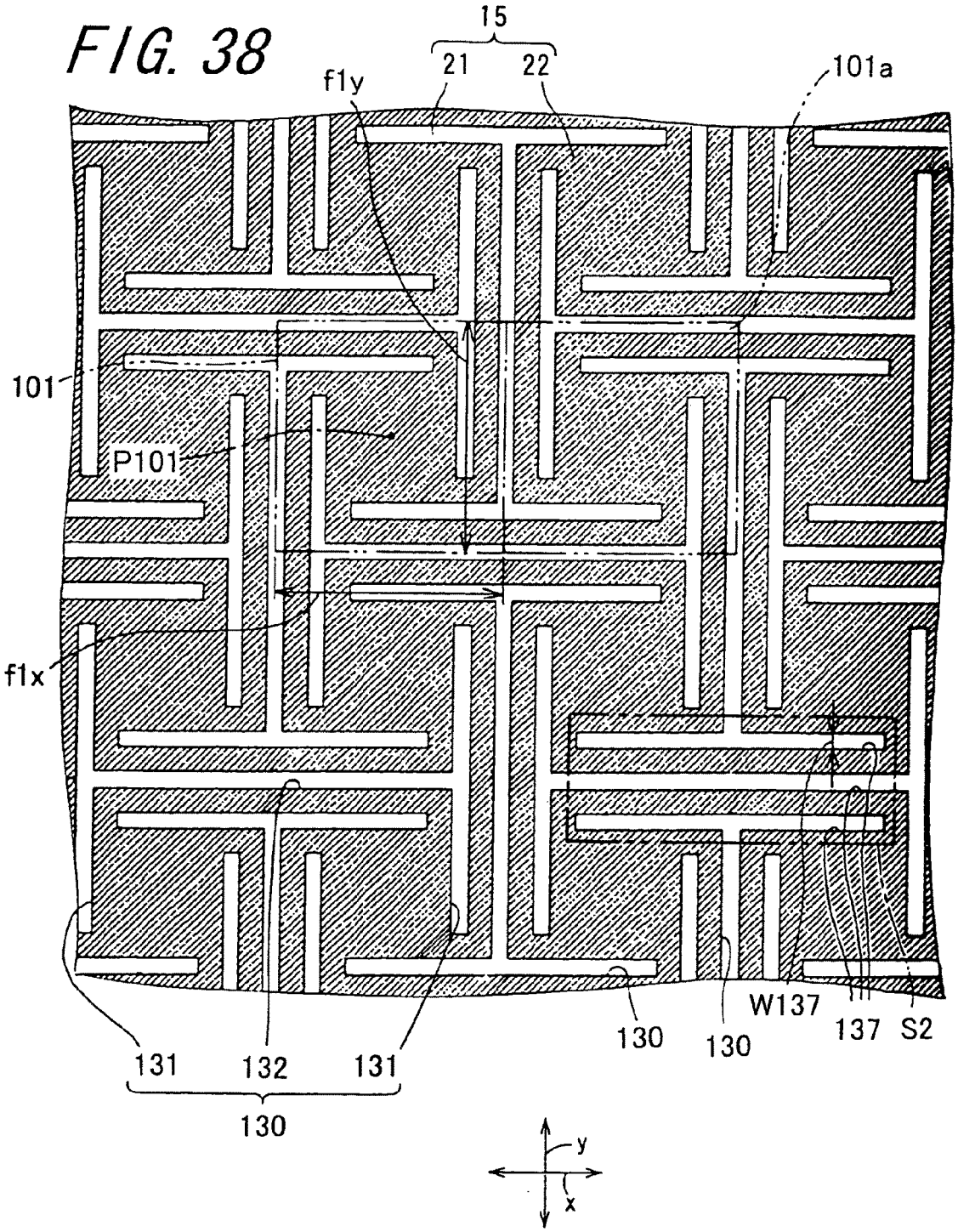
FIG. 38 is a front view showing another pattern layer 15 that can be used as still another embodiment of the invention.

FIG. 38 is a front view showing another pattern layer 15 that can be used as still another embodiment of the invention. In FIG. 38, for facilitating understanding, the conductive pattern portions 22 are hatched with diagonal lines. The constituent elements corresponding to those in the pattern layer 15 shown in FIG. 34 are denoted by the same numerals, and only different constituent elements in the configuration will be described. Instead of the pattern layer 15 shown in FIG. 3, this pattern layer 15 can be used for the sheet member 10. In the pattern layer 15 shown in FIG. 38, the conductive pattern portions 22 are different in shape from the conductive pattern portions 22 shown in FIG. 34.

In the conductive pattern portions 22 shown in FIG. 38, a plurality of holes 130 are formed. Each of the holes 130 has the overall shape of "I" in which two linear end wall portions 131 that are spaced away from each other and extend in parallel are connected at the center portions by a linear connecting portion 132. The holes 130 having this shape are formed in an arrangement following a predetermined pattern in which one of the end wall portions 131 is fitted to the recessed portion on one side with respect to the connecting portion 132 of another hole 130. Each of the end wall portions 131 and each of the connecting portions 132 are parallel to the x direction or the y direction.

More specifically, the conductive pattern portion 22 has a unit element portion 101 having a shape in which four L-shaped portions are arranged in the peripheral direction and cut out in the shape of a spiral from a square defined by two sides parallel to the x direction and two sides parallel to the y direction in a state where one straight line portion of each L-shaped portion is disposed along a side of the square and opens outward. The unit element portion 101 has a shape in which a plurality of (two in this embodiment) line segments are connected so as to be bent at right angles, to be in the shape of a spiral extending outward in the radial direction from a square base whose center matches the center point P101 while being rotated toward one side in the peripheral direction.

The unit element portion 101 is symmetric about a center point P101, and is rotationally symmetric having the same shape each time the unit element portion 101 is rotated by 90° about the center point P101. The conductive pattern portions 22 have a shape in which a plurality of unit element portions 101 and a plurality of symmetrical unit element portions 101*a* that are symmetric to the unit element portions 101 with respect to the x direction and the y direction are alternately arranged in a checkered pattern. In this manner, the conductive pattern portions 22 have a shape in which a plurality of spiral portions are mutually connected. The pattern layer 15 with the conductive pattern portions 22 having this shape can be used in a similar manner instead of the pattern layer 15 shown in FIG. 3, and element receiving means 100 can be formed including this pattern layer 15 shown in FIG. 38. The size f1*x* in the x direction and the size f1*y* in the y direction of the unit element portion 101 are, for example, 41 mm.

From another point of view, in the conductive pattern portions 22 shown in FIG. 38, the holes 130 are formed so that a plurality of different size portions 137 extending in one direction are arranged in a direction intersecting the one direction, for example, focusing on a region S2 enclosed by the virtual line. In the region S2, the different size portions 137 extend in the x direction and are arranged in the y direction. In the conductive pattern portions 22, a plurality of regions having the same shape as the region S2 are present, and a plurality of regions having the shape obtained by rotating the region S2 by 90° are present.

In this manner, the conductive pattern portions 22 shown in FIG. 38 are continuously arranged conductive elements that are continuously formed in an electrically connected manner across a face intersecting the electromagnetic wave incident direction, and a plurality of holes 130 are formed therein. The holes 130 have the different size portions 137 in which the sizes in two directions intersecting each other at right angles in a state where the conductive pattern portions 22 are arranged along a plane are different from each other. The different size portions 137 are arranged in a direction of the smaller size of the sizes in the two directions. Herein, the two directions are the x direction and the y direction. A width w137 of the different size portions 137, which is the smaller size of the sizes in the two directions of the different size portions 137 is, for example, 3 mm, and a length of the different size portions 137, which is the larger size of the sizes in the two directions of the different size portions 137, is twice or more than the width w137.

Figure 39:
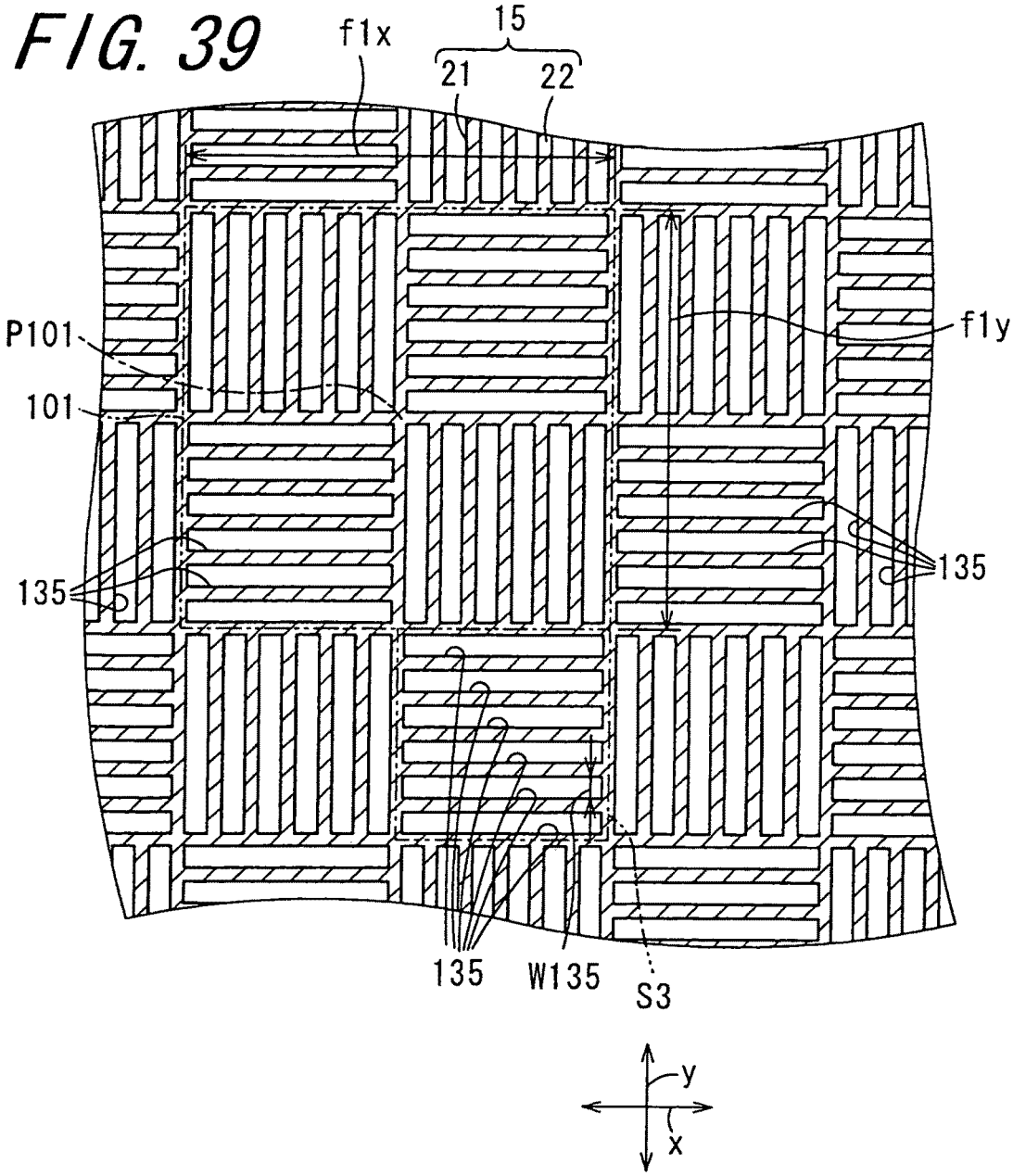
FIG. 39 is a front view showing another pattern layer 15 that can be used as still another embodiment of the invention.

FIG. 39 is a front view showing another pattern layer 15 that can be used as still another embodiment of the invention. In FIG. 39, for facilitating understanding, the conductive pattern portions 22 are hatched with diagonal lines. The constituent elements corresponding to those in the pattern layer 15 shown in FIG. 34 are denoted by the same numerals, and only different constituent elements in the configuration will be described. Instead of the pattern layer 15 shown in FIG. 3, this pattern layer 15 can be used for the sheet member 10. In the pattern layer 15 shown in FIG. 39, the conductive pattern portions 22 are different in shape from the conductive pattern portions 22 shown in FIG. 34.

In the conductive pattern portions 22 shown in FIG. 39, a plurality of holes 135 are formed. Each of the holes 135 is in the shape of an elongated rectangle, and formed in an arrangement following a predetermined pattern in which the holes 135 are arranged in a stripe pattern. Each of the holes 135 is parallel to the x direction or the y direction, more specifically, the conductive pattern portion 22 has a unit element portion 101 having a shape in which a plurality of holes 135 arranged in a stripe pattern are cut out from a square defined by two sides parallel to the x direction and two sides parallel to the y direction. In the unit element portion 101, four regions are obtained by dividing the unit element portion 101 along a straight line parallel to the x direction and a straight line parallel to the y direction that intersect each other at right angles at the center point P101, a plurality of (six in this embodiment) holes 135 are arranged substantially at equal spacings in a stripe pattern parallel to the x direction in two regions arranged in one of the diagonal directions, and a plurality of (six in this embodiment) holes 135 are arranged substantially at equal spacings in a stripe pattern parallel to the y direction in two regions arranged in the other diagonal direction.

The unit element portion 101 is symmetric about a center point P101, and is rotationally symmetric having the same shape each time the unit element portion 101 is rotated by 90° about the center point P101. The conductive pattern portions 22 have a shape in which a plurality of unit element portions 101 are arranged in a matrix. This shape is also a shape in which the unit element portions 101 and symmetrical unit element portions that are symmetric to the unit element portions 101 with respect to the x direction and the y direction are alternately arranged in a checkered pattern. Furthermore, the shape of the conductive pattern portions 22 also may be a shape in which portions in which six holes 135 extending in the x direction are arranged in the y direction in a square region defined by two sides parallel to the x direction and two sides parallel to the y direction and portions in which six holes 135 extending in the y direction are arranged in the x direction in a similar square region are alternately arranged in a checkered pattern. The pattern layer 15 with the conductive pattern portions 22 having this shape can be used in a similar manner instead of the pattern layer 15 shown in FIG. 4, and the element receiving means 100 can be formed including this pattern layer 15 shown in FIG. 14. The size f1*x* in the x direction and the size f1*y* in the y direction of the unit element portion 101 are, for example, 129 mm.

From another point of view, in the conductive pattern portions 22 shown in FIG. 39, the holes 135 are formed so that a plurality of different size portions extending in one direction are arranged in a direction intersecting the one direction, for example, focusing on a region S3 enclosed by the virtual line. In the configuration in FIG. 39, the holes 135 respectively correspond to the different size portions. In the region S3, the holes 135 functioning as the different size portions extend in the x direction and are arranged in the y direction. In the conductive pattern portions 22, a plurality of regions having the same shape as the region S3 are present, and a plurality of regions having the shape obtained by rotating the region S3 by 90° are present.

In this manner, the conductive pattern portions 22 shown in FIG. 39 are continuously arranged conductive elements that are continuously formed in an electrically connected manner across a face intersecting the electromagnetic wave incident direction, and a plurality of holes 135 are formed therein. The holes 135 correspond to the different size portions in which the sizes in two directions intersecting each other at right angles in a state where the conductive pattern portions 22 are arranged along a plane are different from each other. Hereinafter, the different size portions may be denoted by the same numeral 135 as that for the holes 135. The holes 135 functioning as the different size portions are arranged in a direction of the smaller size of the sizes in the two directions. Herein, the two directions are the x direction and the y direction. A width w135 of the holes 135, which is the smaller size of the sizes in the two directions of the holes 135, is, for example, 6 mm, and a length of the holes 135, which is the larger size of the sizes in the two directions of the holes 135, is twice or more than the width w135.

Figure 40:
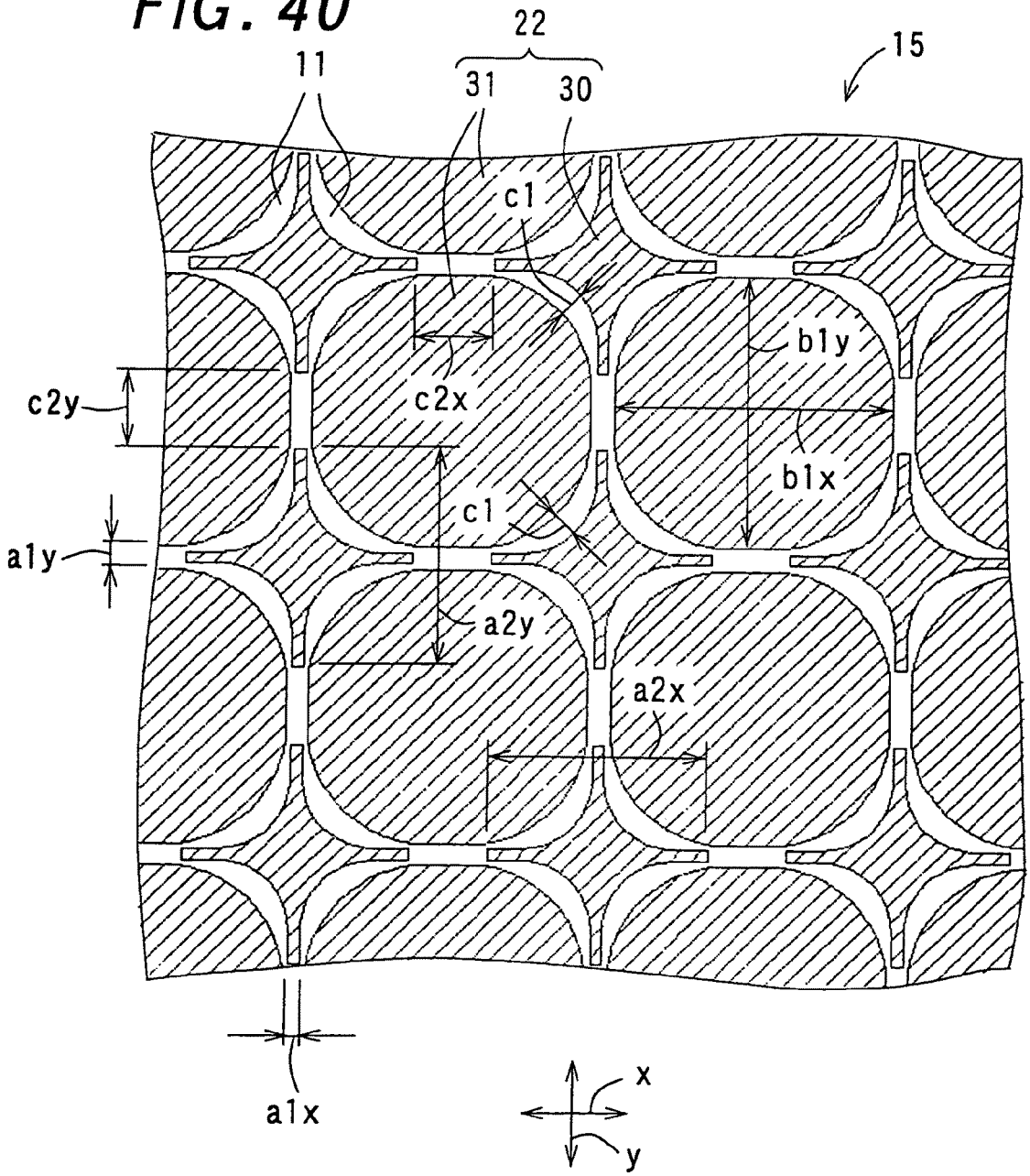
FIG. 40 is an enlarged front view showing a part of the pattern layer 15 according to another embodiment constituting the sheet member 10 in the embodiment shown in FIG. 1.
Figure 41:
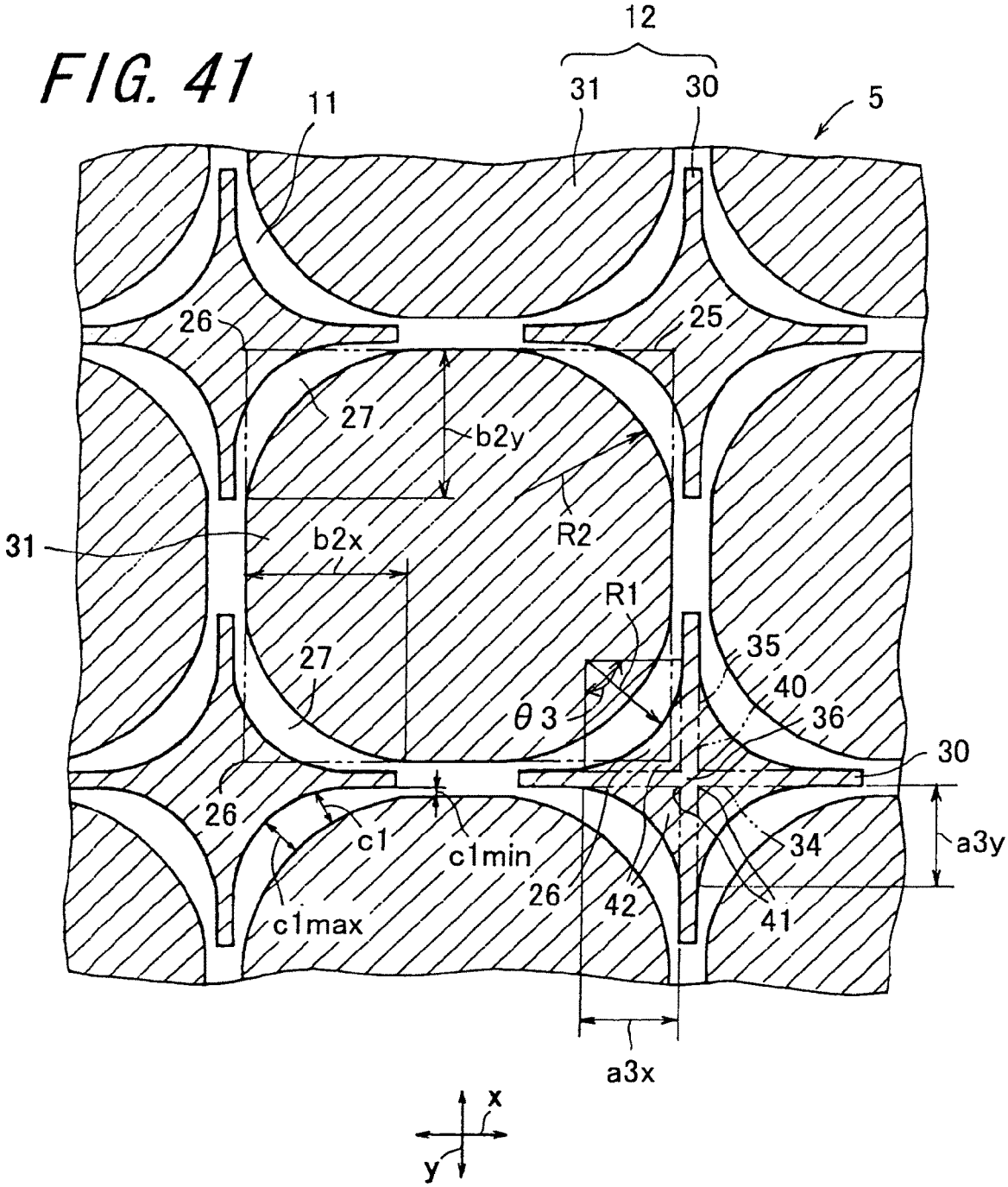
FIG. 41 is a front view of the pattern layer 15 in which a part of FIG. 40 is enlarged.

FIG. 40 is an enlarged front view showing a part of the pattern layer 15 according to another embodiment constituting the sheet member 10 in the embodiment shown in FIG. 1. FIG. 41 is a front view of the pattern layer 15 in which a part of FIG. 40 is enlarged. In FIGS. 40 and 41, for facilitating understanding, the conductive pattern portions 22 are hatched with diagonal lines. This pattern layer 15 is a pattern layer used instead of the above-described pattern layer 15 shown in FIG. 1, and is similar to the above-described pattern layer 15 shown in FIG. 1. Thus, the corresponding portions are denoted by the same numerals, and a description of the same portions may be omitted. The pattern layer 15 in FIG. 40 is different, in the shape and the size of the conductive pattern portions 22, from the pattern layer 15 in FIG. 1. The conductive pattern portions 22 in FIG. 40 have a plurality of radial pattern portions 30 and a plurality of substantially rectangular patterns 31.

Each of the radial pattern portion 30 is formed into a radial shape, and a plurality of radial pattern portions 30 are spaced away from each other. Each of the radial pattern portion 30 is formed substantially in the shape of a cross radially extending in the x direction and the y direction that intersect each other at right angles in a virtual plane, and the radial pattern portion are regularly arranged in a matrix in the x direction and the y direction. Each of the radial pattern portion 30 has a shape in which four corners 41 in the intersecting portion 36 of a cross (hereinafter, referred to as a 'base cross') 40 indicated by the virtual line in FIG. 41 are formed into curves, more specifically, arcs. The base cross 40 has a shape in which a first rectangular portion 34 linearly extending in the x direction and a second rectangular portion 35 linearly extending in the y direction intersect each other at right angles at the intersecting portion 36 so that the centers of the rectangular portions 34 and 35 are overlapped. The rectangular portions 34 and 35 are displaced from each other by 90° about an axis perpendicular to the intersecting portion 36, and have the same shape. Four first substantially right-angled triangles 42 are arranged on this base cross 40 so that the corners of the first substantially right-angled triangles 42 are respectively accommodated in the four corners 41 of the intersecting portion 36. The first substantially right-angled triangles 42 are substantially in the shape of a right-angled isosceles triangle in which the oblique side opposing the right-angled corner is curved in the shape of an arc recessed toward the right-angled corner. Each of the radial pattern portion 30 is four-fold rotationally symmetric, is symmetric about the centers of the rectangular portions 34 and 35, is symmetric with respect to two straight lines that pass through the centers of the rectangular portions 34 and 35 and that are parallel to the longer sides of the rectangular portions, and is symmetric with respect to two straight lines obtained by displacing, by 45°, the two straight lines that pass through the centers of the rectangular portions 34 and 35 and that are parallel to the longer sides of the rectangular portions.

The substantially rectangular pattern 31 is disposed in a region enclosed by the radial pattern portions 30 so as to be spaced away from the radial pattern portions 30 so that the substantially rectangular pattern 31 covers the region enclosed by the radial pattern portions 30. The region enclosed by four radial pattern portions 30 in which two radial pattern portions 30 adjacent to each other in the x direction and two radial pattern portions 30 adjacent to the two radial pattern portions 30 on either one side in the y direction are combined is substantially square. One substantially rectangular pattern 31 is disposed so as to be fitted to this region. Each of the substantially rectangular patterns 31 is formed into a shape similar to the shape of the region enclosed by the four radial pattern portions 30.

Each of the radial pattern portion 30 is substantially in the shape of a cross as described above, and each region enclosed by the radial pattern portion 30 is in the shape of a quadrangle with rounded corners in which the corners of the rectangle are formed in the shape of arcs. Examples of the rectangle on which this quadrangle with rounded corners is based include rectangles in which the longer sides are different in size from the shorter sides and squares in which the longer sides have the same size as that of the shorter sides. In this embodiment, each region enclosed by the radial pattern portion 30 is in the shape of a quadrangle with rounded corners, which is substantially square, and each of the substantially rectangular patterns 31 is in the shape of a quadrangle with rounded corners, which is substantially square.

Each of the substantially rectangular patterns 31 has a shape in which four corners 26 of the base square 25 are changed into the shape of arcs. Each of the substantially rectangular patterns 31 has a shape in which four second substantially right-angled triangles 27 arranged so that the right-angled corners are accommodated in the corners of the base square 25 are removed from the base square 25. The second substantially right-angled triangles 27 are substantially in the shape of a right-angled isosceles triangle in which the oblique side opposing the right-angled corner is curved in the shape of an arc recessed toward the right-angled corner. Each of the substantially rectangular patterns 31 is disposed so that the center of the base square 25 matches the center of a square formed by connecting the centers of the base crosses of four radial pattern portions 30 arranged around the base square 25, and each side of the base square 25 extends in either the x direction or the y direction. Each of the substantially rectangular patterns 12 is four-fold rotationally symmetric, is symmetric about the center of the base square 25, is symmetric with respect to two diagonal lines of the base square 25, and is symmetric with respect to two straight lines that pass through the center of the base square 25 and that are parallel to any side.

The pattern layer 15 in which the patterns 12 having the radial pattern portions 30 and the substantially rectangular patterns 31 are formed has an area ratio in which, when the area of the entire region of the pattern layer 15 is taken as 1, the area of the region in which the conductive pattern portions 22 are formed (hereinafter, referred to as a 'pattern area') is 0.6 or more.

A width a1$y$ of the first rectangular portion 34 and a width a1$x$ of the second rectangular portion 35 are the same, for example, 0.05 mm or more and 10 mm or less. A length a2$x$ of the first rectangular portion 34 and a length a2$y$ of the second rectangular portion 35 are the same, for example, 1 mm or more and 100 mm or less. The lengths of two sides of the first substantially right-angled triangle 42 having the right-angled corner interposed therebetween, that is, the length a3$x$ of the side extending in the x direction and the length a3$y$ of the side extending in the y direction, of the two sides, are the same, for example, 0.1 mm or more and 50 mm or less, and the radius of curvature R1 of the oblique side of the first substantially right-angled triangles 42 is, for example, 1 mm or more and 100 mm or less. An angle θ3 formed by two straight lines connecting the center point of the arc at the oblique side of the first substantially right-angled triangle 42 and ends of the oblique side of the first substantially right-angled triangle 42 is 5° or more and 45° or less. A distance c2$x$ between the first rectangular portions 34 of two radial pattern portions 30 adjacent to each other in the x direction and a distance c2$y$ between the second rectangular portions 35 of two radial pattern portions 30 adjacent to each other in the y direction are the same, for example, 0.1 mm or more and 100 mm or less.

Furthermore, the size b1$x$ in the x direction and the size b1$y$ in the y direction of the base square 25 are the same, for example, 1 mm or more and 100 mm or less. The sizes b1$x$ and b1$y$ of the base square 25 are the size in the x direction and the size in the y direction of the substantially rectangular pattern 31. The lengths of two sides of the second substantially right-angled triangle 27 having the right-angled corner interposed therebetween, that is, the length b2$x$ of the side extending in the x direction and the length b2$y$ of the side extending in the y direction, of the two sides, are the same, for example, 0.1 mm or more and 50 mm or less, and the radius of curvature R2 of the oblique side of the second substantially right-angled triangle 27 is, 1 mm or more and 100 mm or less.

Furthermore, a width c1 of a gap (hereinafter, referred to as a 'radial-rectangular portion gap') between the radial pattern portion 30 and the substantially rectangular pattern 31 continuously changes from a minimum width c1min to a maximum width c1max in a direction in which the gap extends. The minimum width c1min of the radial-rectangular portion gap is the size from the radial pattern portion 30 at ends in the longer-side direction of the rectangular portions 34 and 35 to the substantially rectangular pattern 31, for example, 0.1 mm or more and 20 mm or less. The maximum width c1max of the radial-rectangular portion gap is the size along a straight line equally dividing the right-angled corner of the substantially right-angled triangles 42 and 27 into two, for example, 0.5 mm or more and 50 mm or less.

In this manner, the width c1 of the radial-rectangular portion gap continuously changes in a direction in which the gap extends. A change ratio Δc1 of the width c1 of the radial-rectangular portion gap is, for example, 0.001 or more and 10 or less. The change ratio Δc1 of the width c1 of the radial-rectangular portion gap is the amount of change in the width c1 of the radial-rectangular portion gap per unit size along the edge side of the radial pattern portion 30. In this embodiment, the change ratio Δc1 is not constant, and becomes smaller from the position of the minimum width c1min toward the position of the maximum width c1max.

The change ratio Δc1 is represented by Formula (1). The coefficient k in Formula (1) is represented by Formula (2).

$$\Delta c1 = \frac{c1\max - c1\min}{\frac{k}{2}} \tag{1}$$

$$k = \left(\frac{a2x - a1x}{2} - a3x\right) + \left(\frac{a2y - a1y}{2} - a3y\right) + \frac{2\pi R1}{\left(\frac{\theta 3}{360}\right)} \tag{2}$$

In a case where the frequency of electromagnetic waves that are to be absorbed by the sheet member 10 is in a UHF band, the widths a1*x* and a1*y* of the rectangular portions 34 and 35 are, for example, 1 mm, the lengths a2*x* and a2*y* of the rectangular portions 34 and 35 are, for example, 20 mm, the lengths a3*x* and a3*y* of the two sides of the first substantially right-angled triangle 42 having the right-angled corner interposed therebetween are, for example, 6.5 mm, and the radius of curvature R1 of the oblique side is 6.5 mm. In a case where the frequency of electromagnetic waves that are to be absorbed by the sheet member 10 is in a UHF band, the sizes b1*x* and b1*y* of the base square 25 are, for example, 25 mm, the lengths b2*x* and b2*y* of two sides of the second substantially right-angled triangle 27 having the right-angled corner interposed therebetween are, for example, 10.5 mm, and the radius of curvature R2 of the oblique side is, 10.5 mm. In a case where the frequency of electromagnetic waves that are to be absorbed by the sheet member 10 is in a UHF band, the minimum width c1min of the width c1 of the radial-rectangular portion gap is, for example, 0.5 mm, the maximum width c1max is, for example, 2 mm, and the change ratio Δc1 is, for example, 0.15. In a case where the frequency of electromagnetic waves that are to be absorbed by the sheet member 10 is in a UHF band, the gaps c2*x* and c2*y* between the radial pattern portions are, for example, 7 mm.

In a case where the frequency of electromagnetic waves that are to be absorbed by the sheet member 10 is in a 2.4 GHz band, the widths a1*x* and a1*y* of the rectangular portions 34 and 35 are, for example, 0.5 mm, the lengths a2*x* and a2*y* of the rectangular portions 34 and 35 are, for example, 17.5 mm, the lengths a3*x* and a3*y* of the two sides of the first substantially right-angled triangle 42 having the right-angled corner interposed therebetween are, for example, 5 mm, and the radius of curvature R1 of the oblique side is 5 mm. In a case where the frequency of electromagnetic waves that are to be absorbed by the sheet member 10 is in a 2.4 GHz band, the sizes b1*x* and b1*y* of the base square 25 are, for example, 20.5 mm, the lengths b2*x* and b2*y* of two sides of the second substantially right-angled triangle 27 having the right-angled corner interposed therebetween are, for example, 8 mm, the radius of curvature R2 of the oblique side is, 8 mm. In a case where the frequency of electromagnetic waves that are to be absorbed by the sheet member 10 is in a 2.4 GHz band, the minimum width c1min of the width c1 of the radial-rectangular portion gap is, for example, 0.5 mm, the maximum width c1max is, for example, approximately 1.7 mm, and the change ratio Δc1 is, for example, 0.14. In a case where the frequency of electromagnetic waves that are to be absorbed by the sheet member 10 is in a 2.4 GHz band, the gaps c2*x* and c2*y* between the radial pattern portions are, for example, 2.5 mm.

With the sheet member 10 including the pattern layer 15 in which the conductive pattern portions 22 having the radial pattern portions 30 and the substantially rectangular patterns 31 are formed, a similar effect can be obtained as in the case of the sheet member 10 including the pattern layer 15 in FIG. 3. Furthermore, in the pattern layer 15 in FIGS. 40 and 41, at least part of pattern portions in among the conductive pattern portions 22 has the outer shape including curved portion. In this embodiment, all of the conductive pattern portions 22 have the outer shape including curved portion. In this sort of conductive pattern portions 22, a resonance current when receiving electromagnetic waves smoothly flows at the curved portions.

Furthermore, as another embodiment of the invention, the layer configuration of the sheet member 10 also may be a layer configuration other than that in FIG. 1.

Figure 42:
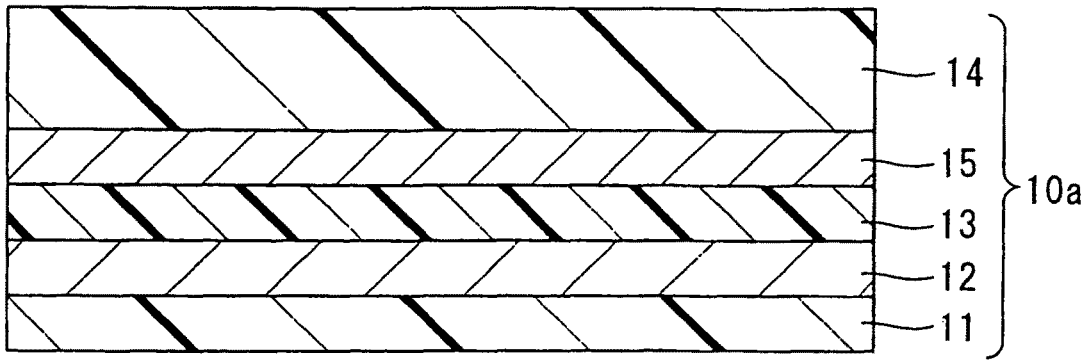
FIG. 42 is a cross-sectional view showing a sheet member 10*a* according to still another embodiment of the invention.
Figure 44:
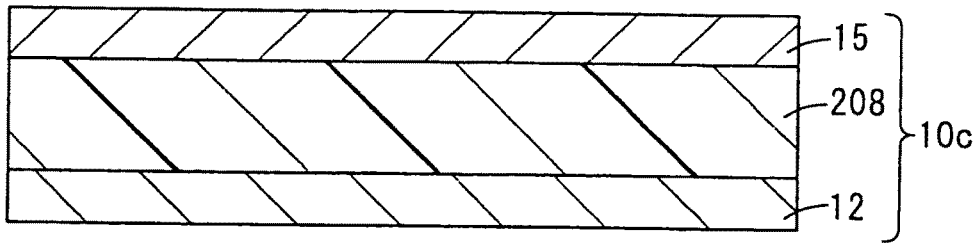
FIG. 44 is a cross-sectional view showing a sheet member 10*c* according to still another embodiment of the invention.

FIG. 42 is a cross-sectional view showing a sheet member 10*a* according to still another embodiment of the invention. As shown in FIG. 42, the sheet member 10*a* may have the configuration in which the first storage layer 14, the pattern layer 15, the second storage layer 13, the reflection area forming layer 12, and the attachment layer 11 are overlaid in this order from the electromagnetic wave incident side. The configuration of the first storage layer 14, the pattern layer 15, the second storage layer 13, the reflection area forming layer 12, and the attachment layer 11 is similar to that described above. Also with this sort of configuration, a similar effect can be obtained. In the embodiment in FIG. 42, constituent elements corresponding to those in FIG. 1 are denoted by the same numerals. In this embodiment, the first and the second storage layers 14 and 13 may be similar storage layers. The layers may be the same storage layer, or may be different storage layers. The storage layers are not limited to the first and the second layers, and there is no limitation on the number of layers overlaid. The storage layers may be dielectric layers, may be magnetic layers, or may be a combination thereof. As shown in FIG. 44 below, the storage layer also may be a single layer.

Figure 43:
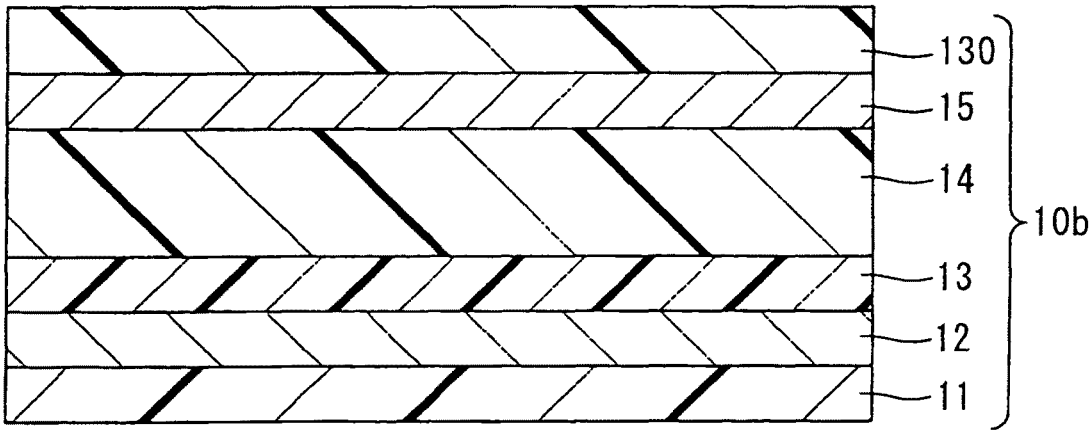
FIG. 43 is a cross-sectional view showing a sheet member 10*b* according to still another embodiment of the invention.

FIG. 43 is a cross-sectional view showing a sheet member 10*b* according to still another embodiment of the invention. As shown in FIG. 43, the sheet member 10*b* may have the configuration in which a storage layer at the first order (for example, a third storage layer 130), the pattern layer 15, a storage layer at the second order (for example, the first storage layer 14), a storage layer at the third order (for example, the second storage layer 13), the reflection area forming layer 12, and the attachment layer 11 are overlaid in this order. As in the case of the first and the second storage layers 14 and 13, the third storage layer 130 is a storage layer, and may be a dielectric member or may be a magnetic member. The pattern layer 15, the first storage layer 14, the second storage layer 13, the reflection area forming layer 12, and the attachment layer 11 are similar to those in the foregoing embodiments. In the embodiment in FIG. 43, constituent elements corresponding to those in FIG. 1 are denoted by the same numerals. In this embodiment, the first and the second storage layers 14 and 13 and the third storage layer 130 may be similar storage layers. The layers may be the same storage layer, or may be different storage layers.

FIG. 44 is a cross-sectional view showing a sheet member 10*c* according to still another embodiment of the invention. As shown in FIG. 44, the sheet member 10*c* may have the configuration in which the pattern layer 15, a storage layer 208, the reflection area forming layer 12 are overlaid in this order from the electromagnetic wave incident side. The configuration of the pattern layer 15 and the reflection area forming layer 12 is similar to that described above. Furthermore, as described above, the storage layer 208 is a layer made of a non-conductive dielectric layer and/or magnetic layer. Also with this sort of configuration, a similar effect can be obtained. In the embodiment in FIG. 44, constituent elements corresponding to those in FIG. 1 are denoted by the same numerals. In this embodiment, the storage layer 208 is realized as the storage layers 14 and 13 or the like described above.

Furthermore, in the configuration of the foregoing embodiments, each of the storage layers 14, 13, 20, and 208 may be multiple layers. In the configuration of the embodiments, the layers 12 to 16, 20, and 208 may be overlaid via an adhesive layer and a support member (PET film, etc.). In this sort of configuration, either one of a dielectric material and a magnetic material may be mixed to an adhesive layer disposed between the layers, in order to obtain a storage effect. In particular, a region in the vicinity of the reflection area forming layer 12 has an intensive magnetic field, and thus it is effective to dispose a layer made of a magnetic material or a layer to which a magnetic material is mixed.

As another embodiment of the invention, the sheet member may not include the reflection area forming layer 12 in the foregoing embodiments, and this sort of sheet member not including the reflection area forming layer 12 may be disposed on a face of the communication jamming member 57 having electromagnetic wave blocking properties at a surface portion of the second storage layer 13 or the storage layer 208 on the side (the lower side in FIGS. 1, 42, 43, and 44) that is opposite to the electromagnetic wave incident side (the upper side in FIGS. 1, 42, 43, and 44). The configuration of the communication jamming member 57 may be similar to that of, for example, the reflection area forming layer 12, and may be realized as, for example, a metal plate or the like. In this case, an effect similar to that in a case where the reflection area forming layer 12 is disposed is obtained.

Although the invention was described mainly in the application as a wireless tag. However, the invention can be added to or integrally formed with an antenna member, and an effect of improving communication can be obtained by eliminating the influence of a communication jamming member to the extent possible, regardless of the application as a tag, a reader, a reader/writer, as long as the apparatus is a data carrier apparatus that is used for wireless communication.

Hereinafter, the configuration of examples and comparative examples and results obtained by evaluating the performance will be described. Although specific examples of the invention are described, the invention is not limited to this.

Table 1 lists the configuration and evaluation results of Examples 1 to 6 and Comparative Examples 1 and 2. Table 1 shows presence or absence of the sheet member, the pattern shape, the thickness of the sheet member, and whether or not communication is possible (communicable or not).

TABLE 1

| | Presence or absence of sheet member | Pattern shape | Sheet thickness (mm) | Communicable or not |
|---|---|---|---|---|
| Ex. 1 | Present | FIG. 19 | 3.0 | Able |
| Ex. 2 | Present | FIG. 28 | 3.0 | Able |
| Ex. 3 | Present | FIG. 25 | 3.0 | Able |

TABLE 1-continued

| | Presence or absence of sheet member | Pattern shape | Sheet thickness (mm) | Communicable or not |
|---|---|---|---|---|
| Ex. 4 | Present | FIG. 3 | 3.0 | Able |
| Ex. 5 | Present | FIG. 3 | 2.7 | Able |
| Ex. 6 | Present | FIG. 3 | 2.1 | Able |
| Com. Ex. 1 | Absent | — | — | Disable |
| Com. Ex. 2 | Absent | — | 2.0 | Disable |

Able: Communication distance 5 cm or longer
Disable: Communication distance 5 cm or shorter Table 2 lists the configuration of the first and the second storage layers 14 and 13 in Examples 1 to 6. The first storage layer 14 is set to a storage layer, and the second storage layer 13 is set to a dielectric layer. Table 2 shows the thickness of the first and the second storage layers 14 and 13, the real number part $\in'$ and the imaginary number part $\in''$ of the complex relative dielectric constant, and the real number part $\mu'$ and the imaginary number part $\mu''$ of the complex relative magnetic permeability.

TABLE 2

| Ex. | Related figure (Pattern shape) | Layer name | Thickness | Material | $\epsilon'$ | $\epsilon''$ | $\mu'$ | $\mu''$ |
|---|---|---|---|---|---|---|---|---|
| 1 | FIG. 19 | First storage layer | 0.5 mm | SBS | 13.6 | 1.3 | 1.4 | 0.5 |
| | | Second storage layer | 2.3 mm | SBS | 3.5 | 0.0 | 1.0 | 0.0 |
| 2 | FIG. 28 | First storage layer | 0.3 mm | PVC | 21.6 | 1.0 | 1.2 | 0.3 |
| | | Second storage layer | 1.8 mm | PVC | 4.0 | 0.1 | 1.0 | 0.0 |
| 3 | FIG. 25 | First storage layer | 0.5 mm | SBS | 15.6 | 0.6 | 1.3 | 0.5 |
| | | Second storage layer | 2.0 mm | SBS | 4.6 | 0.1 | 1.0 | 0.0 |
| 4 | FIG. 3 | First storage layer | 1.0 mm | SBS | 12.3 | 0.7 | 1.3 | 0.5 |
| | | Second storage layer | 1.75 mm | SBS | 4.6 | 0.1 | 1.0 | 0.0 |
| 5 | FIG. 3 | First storage layer | 0.5 mm | SBS | 15.6 | 0.6 | 1.3 | 0.5 |
| | | Second storage layer | 2.0 mm | SBS | 4.6 | 0.1 | 1.0 | 0.0 |
| 6 | FIG. 3 | Second storage layer | 0.4 mm | PVC | 25.8 | 1.3 | 1.2 | 0.3 |
| | | Second storage layer | 1.7 mm | PVC | 3.5 | 0.0 | 1.0 | 0.0 |

Figure 45:
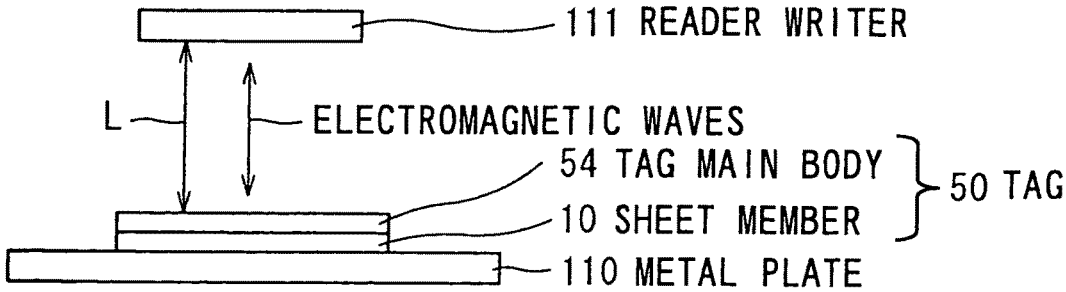
FIG. 45 is a schematic view showing the manner of a communication test.
Figure 46:
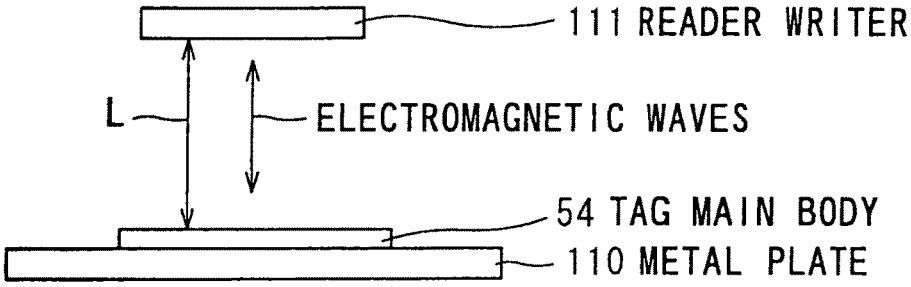
FIG. 46 is a schematic view showing the manner of a communication test.

As a performance evaluation, a communication test between a reader writer 111 and a tag was performed. FIGS. 45 and 46 are schematic views showing the manner of the communication test. In examples, the tag 50 having the sheet member 10 was attached to a surface on one side in the thickness direction of a metal plate 110 that was a plate made of stainless steel. In comparative examples, the tag main body 54 was directly attached to a surface on one side in the thickness direction of the same metal plate 110. One surface of the metal plate 110 was selected to be sufficiently larger than a surface on one side in the thickness direction of the tag 50 and the tag main body 54, and to be a square in which one side was 150 mm. The tag 50 or the tag main body 54 was attached to the center portion on one surface of the metal plate 110. In the communication test, in a case where communication was possible, 'Able' was shown in the field indicating whether or not communication is possible in Table 1, and in a case where communication was impossible, 'Disable' was shown in the field indicating whether or not communication is possible in Table 1.

Wireless communication was performed using the reader writer 111 facing the tag main body 54, and a test was performed to check whether or not communication was possible. A distance L between the reader writer 111 and the tag main body 54 was set to the minimum distance (minimum distance required) L that is required for wireless communication between the tag main body 54 and the reader writer 111 in actual use. The frequency of electromagnetic waves used for wireless communication is in a 2.4 GHz band. Furthermore, air is interposed between the reader writer 111 and the tag main body 54.

Example 1

As the pattern layer 15 and the reflection area forming layer 12, aluminum-evaporated polyethylene terephthalate (polyethylene terephthalate: abbreviated to PET) having a thickness of 100 μm was used. The layer thickness of the aluminum layer in the pattern layer 15 and the reflection area forming layer 12 is 100 μm. The pattern layer 15 was produced by evaporating aluminum on PET to form an aluminum layer, and etching this aluminum layer to form a pattern shape shown in FIG. 19. The first storage layer 14 was produced using a method in which 100 parts by weight of SBS (styrene/butadiene/styrene copolymer) resin, 35 parts by weight of carbon black as a dielectric material, 205 parts by weight of ferrite as a magnetic material, and a dispersant (no magnetic member was used) were mixed, kneaded, and formed into a sheet having a thickness of 1 mm by extrusion molding. The second storage layer 13 was produced as a sheet having a thickness of 1.75 mm in which red phosphorus and magnesium hydroxide were kneaded with SBS for providing flame resistance. The attachment layer 11 had a thickness of 0.15 mm, and was made of an acrylic copolymer resin. The pattern layer 15, the first storage layer 14, the second storage layer 13, and the reflection area forming layer 12 were overlaid via an adhesive in this order, and the attachment layer 11 was overlaid on the reflection area forming layer 12. The layers were cut into 20 mm×80 mm pieces, and thus sheet member 10 in the shape of a rectangular solid having a total thickness of 3 mm was produced. When the x direction of the conductive pattern portions 22 of the pattern layer 15 is set to the longer-side direction, and the y direction is set to the shorter-side direction, the rectangular pattern shapes 31*a* are arranged in the longer-side direction so that each of the centroids matches the center in shorter-side direction, and part of the radial pattern shapes 30*a* is arranged around the rectangular pattern shapes 31*a*. The produced sheet member 10 and the tag main body 54 were attached together to produce the tag 50.

Regarding the conductive pattern portions 22 of the pattern layer 15, a1*x*=a1*y*=2.5 mm, a2*x*=a2*y*=16 mm, c1*x*=c1*y*=1.0 mm, c2*x*=c2*y*=1.0 mm, b1*x*=b1*y*=12.5 mm, and c1*x*=c1*y*=1.0 mm.

Example 2

As the pattern layer 15 and the reflection area forming layer 12, aluminum-evaporated polyethylene terephthalate (PET) having a thickness of 100 μm was used. The layer thickness of the aluminum layer in the pattern layer 15 and the reflection area forming layer 12 is 0.05 μm. The pattern layer 15 was produced by evaporating aluminum on PET to form an aluminum layer, and etching this aluminum layer to form a pattern shape shown in FIG. 28. The first storage layer 14 was produced using a method in which 100 parts by weight of PVC (KANEKA CORPORATION, KS1700) resin, 80 parts by weight of DOP [dioctyl phthalate (phthalic acid di-2-ethylhexyl) 1,2-benzenedicarboxylic acid bis(2-ethylhexyl) ester], 43 parts by weight of graphite as a dielectric material, 125 parts by weight of ferrite as a magnetic material, and calcium carbonate were mixed, kneaded, and formed into a sheet having a thickness of 0.3 mm by extrusion molding. The second storage layer 13 was produced as a sheet having a thickness of 1.8 mm in which red phosphorus and magnesium hydroxide were kneaded with SBS for providing flame resistance. The attachment layer 11 had a thickness of 0.15 mm, and was made of an acrylic copolymer resin. The pattern layer 15, the first storage layer 14, the second storage layer 13, and the reflection area forming layer 12 were overlaid via an adhesive in this order, and the attachment layer 11 was overlaid on the reflection area forming layer 12. The layers were cut into 20 mm×80 mm pieces, and thus sheet member 10 in the shape of a rectangular solid having a total thickness of 2.1 mm was produced.

Regarding the conductive pattern portions 22 of the pattern layer 15, b1*x*=b1*y*=21.0 mm, R2*a*=7.0 mm, R2*b*=4.0 mm, and d1*x*=d1*y*=1.5 mm. When the x direction of the conductive pattern portions 22 of the pattern layer 15 is set to the longer-side direction, and the y direction is set to the shorter-side direction, the rectangular pattern shapes 31*a* are arranged in the longer-side direction so that each of the centroids matches the center in shorter-side direction.

Example 3

The pattern layer 15 was formed into a pattern shape shown in FIG. 22, and other procedures in the method were the same as those in Example 1.

Regarding the conductive pattern portions 22 of the pattern layer 15, b1*x*=b1*y*=21.0 mm, and d1*x*=d1*y*=1.5 mm. When the x direction of the conductive pattern portions 22 of the pattern layer 15 is set to the longer-side direction, and the y direction is set to the shorter-side direction, the rectangular pattern shapes 31*a* are arranged in the longer-side direction so that each of the centroids matches the center in shorter-side direction.

Example 4

The pattern layer 15 was formed into a pattern shape shown in FIG. 3, and other procedures in the method were the same as those in Example 1.

Regarding the conductive pattern portions 22 of the pattern layer 15, a1*x*=a1*y*=1.0 mm, a2*x*=a2*y*=17.5 mm, a3*x*=a3*y*=7.5 mm, c1*x*=c1*y*=1.5 mm, c2*x*=c2*y*=7.0 mm, b1*x*=b1*y*=20.5 mm, c1*x*=c1*y*=1.5 mm, R1=7.5 mm, and R2=7.0 mm. When the x direction of the conductive pattern portions 22 of the pattern layer 15 is set to the longer-side direction, and the y direction is set to the shorter-side direction, the rectangular pattern shapes 31*a* are arranged in the longer-side direction so that each of the centroids matches the center in shorter-side direction, and part of the radial pattern shapes 30*a* is arranged around the rectangular pattern shapes 31*a*.

Example 5

As the pattern layer 15 and the reflection area forming layer 12, aluminum-evaporated polyethylene terephthalate (PET) having a thickness of 100 μm was used. The layer thickness of the aluminum layer in the pattern layer 15 and the reflection area forming layer 12 is 0.05 μm. The pattern layer 15 was produced by evaporating aluminum on PET to form an aluminum layer, and etching this aluminum layer to form a pattern shape shown in FIG. 3. The first storage layer 14 was produced using a method in which 100 parts by weight of SBS resin, 55 parts by weight of graphite as a dielectric material, 213 parts by weight of ferrite as a magnetic material, and a dispersant were mixed, kneaded, and formed into a sheet having a thickness of 0.5 mm by extrusion molding. The second storage layer 13 was produced as a sheet having a thickness of 2.0 mm in which red phosphorus and magnesium hydroxide were kneaded with SBS for providing flame resistance. The attachment layer 11 had a thickness of 0.15 mm, and was made of an acrylic copolymer resin. The pattern layer 15, the first storage layer 14, the second storage layer 13, and the reflection area forming layer 12 were overlaid via an adhesive in this order, and the attachment layer 11 was overlaid on the reflection area forming layer 12. The layers were cut into 20 mm×80 mm pieces, and thus sheet member 10 in the shape of a rectangular solid having a total thickness of 2.7 mm was produced.

The size of the conductive pattern portions 22 of the pattern layer 15 is similar to that in Example 4.

Example 6

As the pattern layer 15 and the reflection area forming layer 12, aluminum-evaporated polyethylene terephthalate (PET) having a thickness of 100 μm was used. The layer thickness of the aluminum layer in the pattern layer 15 and the reflection area forming layer 12 is 0.05 μm. The pattern layer 15 was produced by evaporating aluminum on PET to form an aluminum layer, and etching this aluminum layer to form a pattern shape shown in FIG. 3. The first storage layer 14 was produced using a method in which 100 parts by weight of PVC resin, 80 parts by weight of DOP, 48 parts by weight of graphite as a dielectric material, 130 parts by weight of ferrite as a magnetic material, and calcium carbonate as a filler were mixed, kneaded, and formed into a sheet having a thickness of 0.4 mm by extrusion molding. The second storage layer 13 was produced as a sheet having a thickness of 1.7 mm in which red phosphorus and magnesium hydroxide were kneaded with SBS for providing flame resistance. The attachment layer 11 had a thickness of 0.15 mm, and was made of an acrylic copolymer resin. The pattern layer 15, the first storage layer 14, the second storage layer 13, and the reflection area forming layer 12 were overlaid via an adhesive in this order, and the attachment layer 11 was overlaid on the reflection area forming layer 12. The layers were cut into 20 mm×80 mm pieces, and thus sheet member 10 in the shape of a rectangular solid having a total thickness of 2.1 mm was produced.

The size of the conductive pattern portions 22 of the pattern layer 15 is similar to that in Example 4.

Comparative Example 1

A communication test was performed in a state where the tag main body 54 as in Examples 1 to 6 was directly attached to the metal plate 110.

As seen from the test result shown in Table 1, communication was not possible between the tag main body 54 and the reader writer 111 in the comparative examples, but communication between the tag 50 and the reader writer 111 was possible in all of Examples 1 to 7. In Examples 1 to 7, it was possible to suitably perform wireless communication even in the vicinity of the metal plate 110 that is the communication jamming member 57, and to suppress a decrease in the communication distance when the tag was attached to the metal plate 110.

Comparative Example 2

A communication test was performed in a state where a magnetic sheet made of rubber ferrite (2 mm thickness) cut into a 20 mm×80 mm piece was interposed between the tag main body 54 and the metal plate 110. The effect of improving communication was low, and was clearly inferior to that of the sheet member 10 of the invention.

Example 7

The pattern shape is substantially the same as that shown in FIGS. 40 and 41, the radial pattern portions 30 and the substantially rectangular patterns 31 have different curvatures, and the gap c1 between the two pattern portions 30 and 31 is continuously changed. The size of the conductive pattern portions 22 was set so that a1$x$=a1$y$=1.0 mm, a2$x$=a2$y$=20.0 mm, b1$x$=b1$y$=25 mm, c2$x$=c2$y$=7.0 mm, and c1=0.5 mm or more and 2.5 mm or less. In the substantially triangular portion 22 in the radial pattern portion 30, the radius of curvature R1 was set to 6.5 mm. In the substantially rectangular patterns 31, the radius of curvature R2 of the corners was set to 10.5 mm. The gap c1 between the radial pattern portion 30 and the substantially rectangular pattern 31 is continuously changed so that the gap becomes larger at the middle portion than the end portions in a direction in which the gap between the pattern portions 30 and 31 extends.

AS the first storage layer 14, a plasticizer, a dispersant, calcium carbonate, and the like were added to 100 (phr) of chlorinated polyethylene (Showa Denko K.K., ELASLEN301NA) and 800 (phr) of carbonyliron (EW-1 manufactured by BASF). As the second storage layer 13, a plasticizer, adispersant, and the like were added to 100 (phr) of chlorinated polyethylene that is the same as that used in the first storage layer 14 and 16 (phr) of graphite. The configuration was applied in which the pattern layer 15 (aluminum-evaporated PET film), the first storage layer 14 (2.1 mm), the second storage layer 13 (2.5 mm), and the reflection area forming layer (aluminum-evaporated PET film) were overlaid. The material constants in a 950 MHz band were set so that, in the first storage layer 14, $\in'$=19.0, $\in''$=0.90 (tan $\delta\in$=0.047), $\mu'$=5.33, and $\mu''$=1.43 (tan $\delta\mu$=0.268), and in the second storage layer 13, $\in'$=7.9, $\in''$=0.13 (tan $\delta\in$=0.017), $\mu'$=1, and $\mu''$=0, in order to suppress the loss. As the sheet member 10, a sheet for a UHF band having a thickness of approximately 4.6 mm was used.

Figure 47:
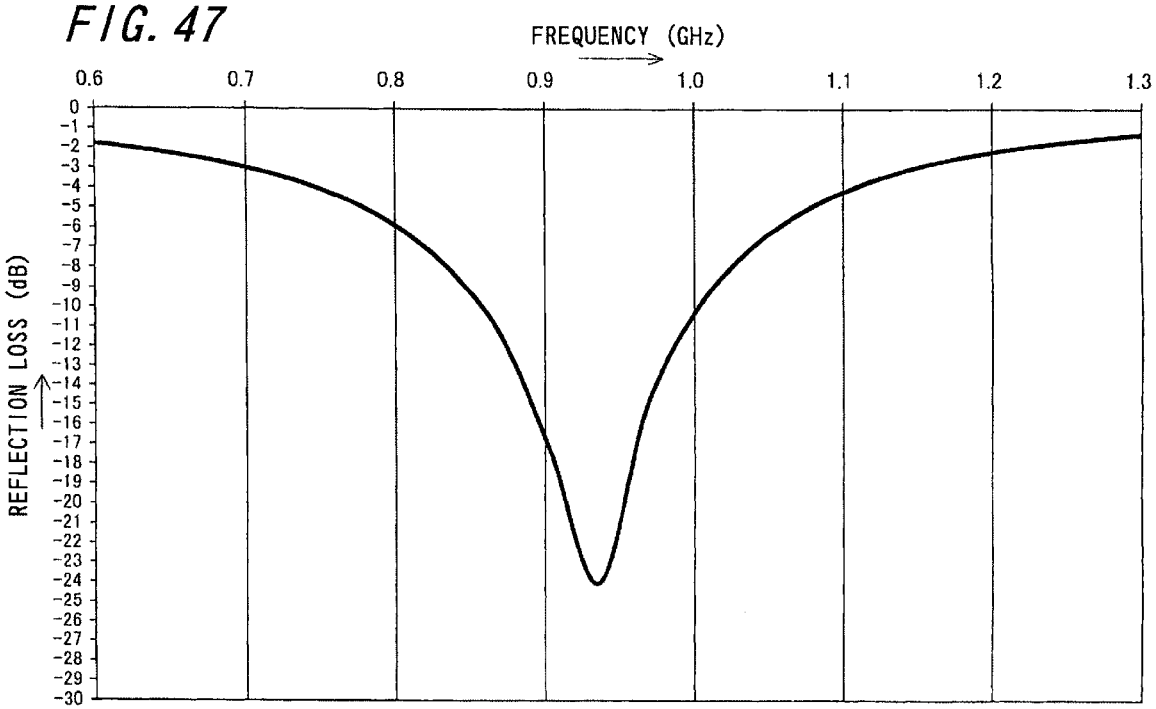
FIG. 47 is a graph showing a calculation result obtained with a simulation of the reflection loss of the sheet member 10 in Example 7.

FIG. 47 is a graph showing a calculation result obtained with a simulation of the reflection loss of the sheet member 10 in Example 7. In FIG. 47, the horizontal axis represents the frequency, and the vertical axis represents the reflection loss. The reflection loss amount in the invention is calculated using a computer simulation as described above. The pattern structure of this example was set so that, as described above, the radius of curvature of the corners was changed between the adjacent conductive pattern portions 22 and the gap between the conductive pattern portions 22 was continuously changed, and thus the resonance (frequency and Q) was adjusted.

The sheet member 10 of Example 7 was cut into a piece having a size that was slightly larger than the tag main body 54 so that the tag main body 54 was disposed on the radial pattern portion 30, a middle-range tag for an UHF band (ALIEN2004, 89 mm×19 mm) manufactured by ALIEN was overlaid on the sheet member 10, and a reading test was performed using a reader (ALR-7610-75L, linear polarization) manufactured by ALIEN. In a case where the middle-range tag was evaluated in a free space, the communication distance was 2800 mm. Table 3 shows the results (results obtained by measuring the communication distance) of the reading test. Table 3 also shows results obtained as Comparative Examples 3 and 4 by performing a similar reading test in which foamed polystyrene, which is a foam, was used instead of the sheet member 10. Table 3 shows the thickness of the sheet member 10 (sheet thickness), the communication distance, and the ratio of communication distance with respect to a free space. In this reading test, an aluminum plate was used as a communication jamming member, and the sheet member 10 or a foam was attached to the aluminum plate. Accordingly, the sheet thickness is the same as the distance (gap size) from the aluminum plate to the tag main body 54.

TABLE 3

| Configuration | Ex. 7 | Com. Ex. 3 Foamed polystyrene | Com. Ex. 4 Foamed polystyrene |
|---|---|---|---|
| Sheet thickness (gap size) (mm) | 5.1 | 5 | 10 |
| Communication distance (mm) | 2130 | 590 | 960 |
| Ratio of communication distance with respect to free space (%) | 76 | 21 | 35 |

In a case where Comparative the sheet member 10 having a thickness of approximately 5 mm of Example 7 was used, the communication distance was 2130 mm, that is, the communication distance that was approximately 76% of that in the case of a free space was obtained. In a case where a reading test was performed using a foam for comparison, the communication distance was 21% of that in the case of a free space. Thus, it was clear that the sheet member 10 of the invention has a significant effect of improving communication distance.

Example 8

Figure 48:
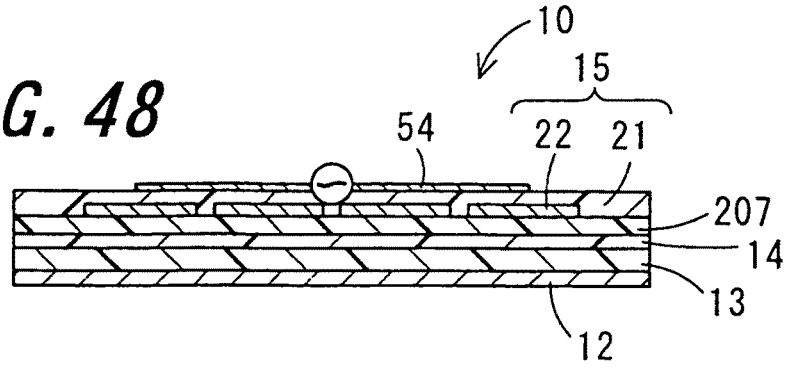
FIG. 48 is a cross-sectional view showing the sheet member 10 of Example 8.
Figure 49:
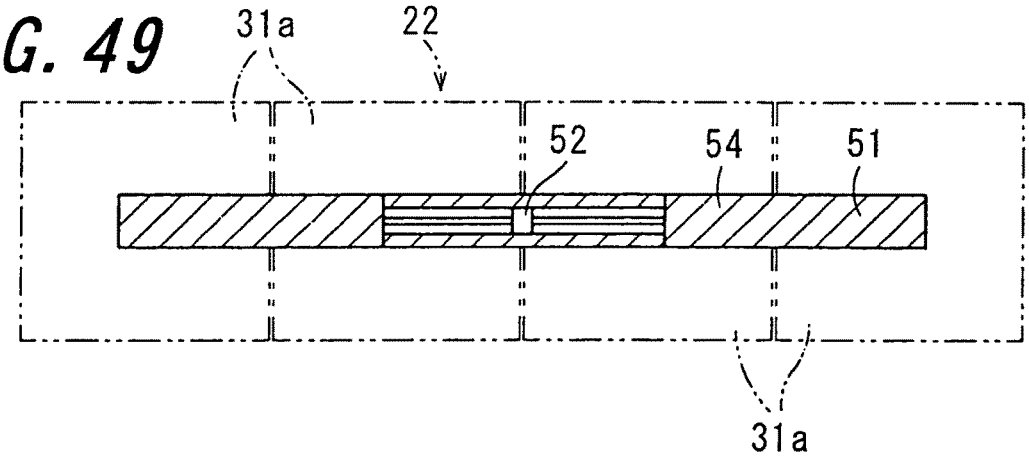
FIG. 49 is a plan view showing the tag main body 54 that is attached to the sheet member 10 of Example 8.
Figure 50:
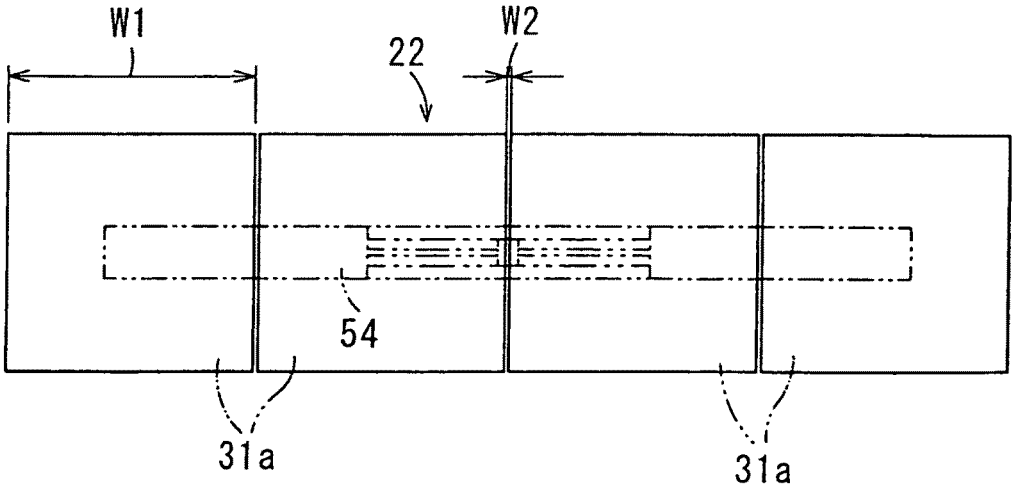
FIG. 50 is a plan view showing the pattern layer 15 constituting the sheet member 10 of Example 8.
Figure 51:
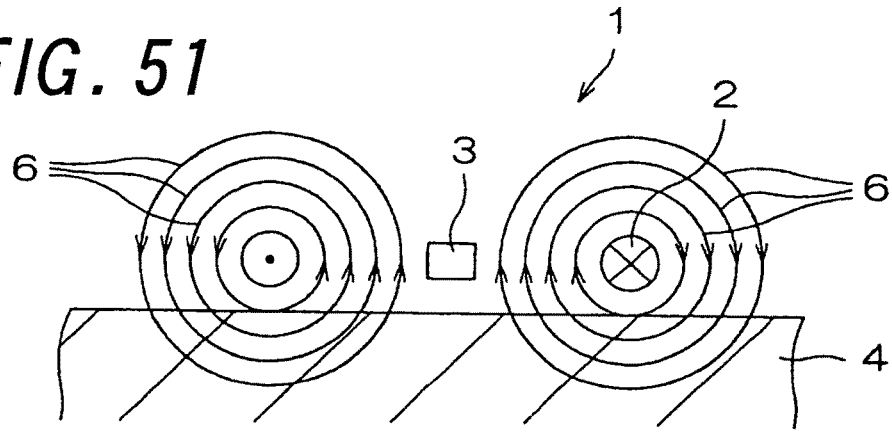
FIG. 51 shows the case of wireless communication using an electromagnetic induction system typically used for a 13.56 MHz band.
Figure 52:
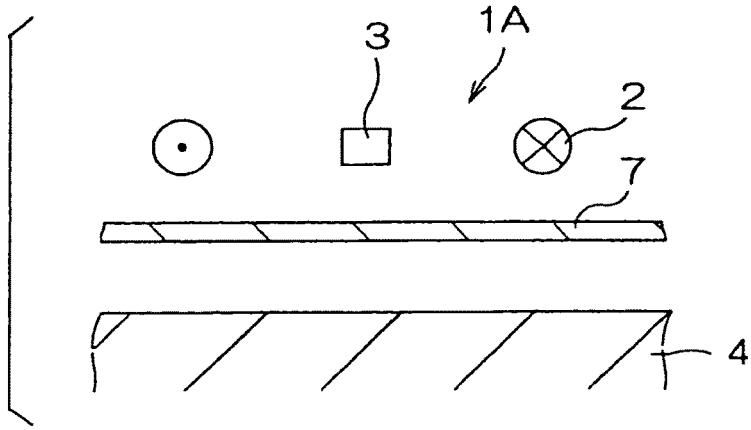
FIG. 52 is a simplified cross-sectional view showing a tag 1A according to another conventional technique.

FIG. 48 is a cross-sectional view showing the sheet member 10 of Example 8. FIG. 49 is a plan view showing the tag main body 54 that is attached to the sheet member 10 of Example 8. FIG. 50 is a plan view showing the pattern layer 15 constituting the sheet member 10 of Example 8. FIG. 48 shows a state in which the tag main body 54 is attached. The sheet member 10 of Example 8 has a configuration in which the reflection area forming layer 12, the second storage layer 13, the first storage layer 14, the film layer/adhesive layer 207, and the pattern layer 15 are overlaid in this order. The pattern layer 15 includes the conductive pattern portions 22 and the spacer (base) 21. The reflection area forming layer 12 and the pattern layer 15 are made of an aluminum-evaporated PET film. The pattern layer 15 is disposed so that the conductive pattern portions 22 oppose the film layer/adhesive layer 207. It should be noted that the film layer/adhesive layer, the spacer (base), and the like are also the storage layers in the invention.

In this example, the conductive pattern portions 22 had the pattern shape shown in FIG. 25, and were cut into a piece having a size in which four rectangular pattern shapes 31*a* in the shape of a square with a side length W1=45 mm were arranged with a gap W2=1 mm interposed therebetween. With the configuration shown in FIGS. 48 to 50, an effect of improving metal-compatible communication was calculated for the tag main body 54 attached to the sheet member 10. The thickness including the experimentally produced tag main body 54 and the sheet member 10 was approximately 3 mm, that is, the thickness was made smaller. The experimentally produced tag main body 54 is substantially in the shape of a rectangle (length 147 mm, width 10 mm) as shown in FIG. 49, and is a UHF band tag in which the impedance of the tag chip functioning as the IC 52 is set to 30-j250 (Ω) in a 950 MHz band. The tag main body 54 is disposed to be overlaid at the center portion of the conductive pattern portions 22 including four rectangular pattern shapes 31*a* so that the longer-side direction matches the direction in which the four rectangular pattern shapes 31*a* are arranged.

Table 4 shows the material constants of materials constituting the sheet member 10 of Example 8. Table 4 shows the layer thickness, the real number part ∈' of the complex relative dielectric constant, the dielectric loss tan δ (∈), the real number part μ' of the complex relative magnetic permeability, the magnetic loss tan δ (μ), and the electrical conductivity σ of the spacer (base) 21, the film layer/adhesive layer 207, the first storage layer 14, and the second storage layer 13.

TABLE 4

| Layer name | Thickness (mm) | ∈' | tanδ (∈) | μ' | tanδ (μ) | Electrical conductivity σ |
|---|---|---|---|---|---|---|
| Spacer (base) | 1 | 3 | 0.01 | 1 | 0 | 0 |
| Film layer/ Adhesive layer | 0.15 | 3 | 0.01 | 1 | 0 | 0 |
| First storage layer | 0.5 | 15.1 | 0.049 | 4.55 | 0.24 | 0.039 |
| Second storage layer | 1.5 | 3 | 0.01 | 1 | 0 | 0 |

Table 5 shows results obtained by evaluating the antenna properties of the tag main body 54 in a case where the sheet member 10 of Example 8 was used. Table 5 shows the measured reflection coefficient S11, the real part of the real number part Z11 of impedance, the imaginary part of the imaginary number part Z11 of impedance, and the absolute gain in electromagnetic waves in a 950 MHz band, and relative comparison with a case in which the tag main body 54 was used in a free space. As the relative comparison with a case in which the tag main body 54 was used in a free space, the electricity supply to the antenna element 51, the radiation from the antenna element 51, the total, and the presumed communication distance are shown. In Table 5, 'electricity supply' represents the degree of matching from a chip to an antenna element. It is indicated that, as the value is larger, matching is established more suitably. The comparison is shown taking a free space as 1. Furthermore, 'radiation' represents the radiated power in a case where electric power of the same size is supplied from the chip to the antenna element after establishing matching. Also, the comparison is shown taking a free space as 1. Furthermore, 'total' represents the radiated power in a case where electric power of the same size is supplied from the chip to the antenna element without establishing matching. Also, the comparison is shown taking a free space as 1. The comparison of 'total' represents comparison of the antenna properties. Table 5 also shows, as a comparative example, the antenna properties in a case where the tag main body 54 is disposed so as to be spaced away from the communication jamming member 57 by 3.15 mm.

Formula (3) represents a basic presumption formula for the presumed communication distance.

$$\text{Communication distance [m]} = \sqrt{\frac{\text{Transmission power } EIRP[W] \times \text{Tag antenna gain [Antilog]} \times \text{Polarization loss [Antilog]}}{(4\pi)^2 \times \text{Tag minimum required power [W]}}} \times \text{Wavelength [m]} \quad (3)$$

The distance was presumed based on the conditions that the transmission power of the tag is constant, the polarization loss is not taken into consideration, and the distance is proportional to the square root (√) of the antenna gain (antilogarithm) of the tag. Furthermore, the antenna gain was taken to be similar to the actual gain (gain including matching loss and material loss).

TABLE 5

| | 950 MHz | | | | Comparison with free space | | | |
|---|---|---|---|---|---|---|---|---|
| | S11 (dB) | Real part of Z11 | Imaginary part of Z11 | Absolute gain (dBi) | Electricity supply | Radiation | total | Presumed communication distance |
| Free space | −11.827 | 24.309 | 236.863 | 2.290 | 1.000 | 1.000 | 1.000 | 1.000 |
| Gap (3.15 mm) | −0.0750078 | 32.016 | −219.603 | 7.052 | 0.018 | 2.994 | 0.055 | 0.234 |
| Ex. 8 | −11.0416 | 19.2147 | 258.976 | −3.532 | 0.986 | 0.262 | 0.258 | 0.508 |

As a result, as shown in Table 5, the presumed communication distance in a case where the sheet member 10 of the example is used is 51% of that in the case of a free space, and the distance in the comparative example in which a space corresponding to a thickness (3.15 mm) is provided from the communication jamming member 57 is approximately 23% of that in the case of a free space, that is, the sheet member 10 of the example exhibited the communication distance that is twice or more than that in the comparative example. Thus, the possibility has been found that the sheet member 10 of the example can be used as a metal-compatible thin antenna member for a UHF band.

Table 6 shows the radiation efficiency of the experimentally produced tag main body 54. Here, radiation efficiency $\eta=10^{(gain-directional\ gain)/10}$. Directional gain is a gain not including metal loss or the like. Gain (usually, simple indication 'gain' refers to this gain) can be regarded as 'so-called true gain' including loss. When the radiation resistance of the antenna is taken as Rrad, and the loss resistance is taken as Rloss, radiation efficiency η=Rrad/(Rrad+Rloss). Rrad corresponds to the resistance of the input impedance of a no-loss antenna. In the tag main body 54 used in Example 8, the directional gain was 7.44 dBi, the gain (absolute gain) was −3.53 dBi, and the radiation efficiency was approximately 8%.

TABLE 6

| Directional gain (dBi) | Absolute gain (dBi) | Radiation efficiency |
|---|---|---|
| 7.440 | −3.532 | 7.99% |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

INDUSTRIAL APPLICABILITY

According to the invention, the sheet member for improving communication is disposed between the antenna element and the communication jamming member, and the pattern layer is disposed in the vicinity of the antenna element in an electrically insulated state. Thus, electromagnetic coupling is formed between the conductive pattern portion and the antenna element, electromagnetic energy is transferred from the conductive pattern portion to the antenna element, and electromagnetic energy at the resonance frequency is supplied from the conductive pattern portion to the antenna element. Accordingly, wireless communication can be suitably performed even in the vicinity of a communication jamming member, and sufficient communication distance can be secured.

Furthermore, when the antenna element is disposed in the vicinity of a communication jamming member, the storage layer that collects energy of electromagnetic waves used for wireless communication is disposed between the antenna element and the communication jamming member. Thus, conduction can be prevented, and reactance (L) components and capacitance (C) components can be increased. Furthermore, due to the real number part ∈' of the complex relative dielectric constant and/or the real number part μ' of the complex relative magnetic permeability, the propagation path of electromagnetic waves that have entered the sheet member can be bent. Moreover, due to a wavelength shortening effect, the sheet member can be made smaller.

Furthermore, according to the invention, the reflection area forming layer forms a reflection area. Thus, even in a small and thin sheet member, the phase of reflected waves from the reflection area can be adjusted, and thus an area having high electric field intensity due to interference between reflected waves from the reflection area and arriving electromagnetic waves can be set on the surface of the sheet member and/or in the vicinity of the antenna element. Furthermore, when the antenna element is disposed in the vicinity of a communication jamming member, a decrease in the input impedance of the antenna element caused by the communication jamming member can be suppressed, and thus wireless communication can be suitably performed even in the vicinity of a communication jamming member.

Furthermore, in a case where the reflection area forming layer is disposed, communication conditions of the antenna element can be prevented from being changed according to the material (material quality) of each communication jamming member, and thus the communication conditions using the antenna element can be stabilized in any environment.

Furthermore, according to the invention, with the pattern layer, electromagnetic waves corresponding to the size of each of the conductive pattern portions can be received to cause resonance. Depending on how the size of the conductive pattern portions is determined, electric power obtained by the antenna element from electromagnetic waves used for wireless communication can be increased.

Furthermore, according to the invention, a plurality of types of conductive pattern portions in which at least one of size and shape is different therebetween have respectively different resonance frequencies, and thus the pattern layer can receive electromagnetic waves at a plurality frequencies. Furthermore, the electric power obtained by the antenna element from electromagnetic waves used for wireless communication can be reliably increased.

Furthermore, according to the invention, the pattern layer in which the conductive pattern portion continuously disposed in a wide range is formed can increase the gain over frequencies in a wide band. Thus, the sheet member provided therewith can receive electromagnetic waves at frequencies in a wide band or a plurality of frequency bands. Furthermore, the electric power obtained by the antenna element from electromagnetic waves used for wireless communication can be reliably increased.

Furthermore, according to the invention, the conductive pattern portion that receives electromagnetic waves has a substantially polygonal outer shape that is basically in the shape of a polygon, and at least one corner is curved. Thus, an excellent sheet member for improving communication can be realized in which a peak value of the gain is high, and shift of the frequency at which the gain has a peak value according to the direction in which electromagnetic waves are polarized is small.

Furthermore, according to the invention, since the conductive pattern portions having different radiuses of curvature of the corners are formed, the frequency band of electromagnetic waves that are to be received (hereinafter, may be referred to as a 'reception band') can be changed without lowering a peak value of the gain, compared with a case in which only conductive pattern portions having the same radius of curvature of the corners are formed.

Furthermore, according to the invention, the gain can be increased compared with a case in which the gap between two adjacent conductive pattern portions is constant.

Furthermore, according to the invention, wireless communication can be suitably performed using electromagnetic waves having a frequency of 300 MHz or higher and 300 GHz or lower.

Furthermore, according to the invention, the thickness of the sheet member for enabling wireless communication to be suitably performed using electromagnetic waves at a frequency in the range of 300 MHz or higher and 300 GHz or lower can be made as small as possible, and thus the sheet member can be made thinner.

Furthermore, according to the invention, the thickness of the sheet member for enabling wireless communication to be suitably performed using electromagnetic waves at a frequency included in a high MHz band can be made as small as possible, and thus the sheet member can be made thinner.

Furthermore, according to the invention, the thickness of the sheet member for enabling wireless communication to be suitably performed using electromagnetic waves at a frequency included in a 2.4 GHz band can be made as small as possible, and thus the sheet member can be made thinner.

Furthermore, according to the invention, the storage layer is made of a material in which one or a plurality of materials selected from the group consisting of ferrite, iron alloy, and iron particles are contained as the magnetic material in an amount blended of 1 part by weight or more and 1500 parts by weight or less, with respect to 100 parts by weight of an organic polymer. Thus, a sheet member achieving the above-described effect can be suitably realized.

Furthermore, according to the invention, the sheet member can be flame-resistant. Thus, the sheet member can be suitably used also for the application where flame resistance is required.

Furthermore, according to the invention, at least one surface portion is glutinous or adhesive. Thus, the sheet member can be attached to other articles. Accordingly, the sheet member can be easily used.

Furthermore, according to the invention, an antenna device can be realized that comprises the sheet member and that can be suitably used for wireless communication in a state where the antenna device is disposed in the vicinity of a communication jamming member.

Furthermore, according to the invention, an electronic information transmitting apparatus can be realized that can suitably perform wireless communication even in a case where the electronic information transmitting apparatus is disposed in the vicinity of a communication jamming member.

The invention claimed is:

1. A sheet member for improving communication used when performing wireless communication using an antenna element in a vicinity of a member configured to jam communication having a portion made of a conductive material, the sheet member being between the antenna element and the member, and comprising:

a pattern layer including a conductive pattern portion, the pattern layer configured to resonate with electromagnetic waves, to store electromagnetic energy, to electromagnetically couple with the antenna element, and to transfer the stored electromagnetic energy to the antenna element; and a storage layer between the pattern layer and the member, the storage layer being a low loss material and at least one of a non-conductive dielectric layer and magnetic layer, the storage layer configured to propagate the electromagnetic waves with low loss and to store energy of the electromagnetic waves, wherein the low loss material has a loss tangent $\in''/\in'$ that is 0.25 or below and a magnetic loss tangent $\mu''/\mu'$ that is 0.3846 or below, $\in'$ and $\in''$ being real and imaginary parts of a complex relative dielectric constant of the low loss material, respectively, and $\mu'$ and $\mu''$ being real and imaginary parts of a complex relative magnetic permeability of the low loss material, respectively.

2. The sheet member for improving communication of claim 1, wherein the sheet member for improving communication is attached to a tag having the antenna element in an RFID system.

3. The sheet member for improving communication of claim 1, wherein the antenna element is an electric field-type antenna.

4. The sheet member for improving communication of claim 1, wherein a reflection area forming layer configured to form a reflection area reflecting the electromagnetic waves is disposed so that the storage layer is between the reflection area forming layer and the pattern layer, and the reflection area forming layer is separated from the pattern layer by a distance at which the electrical length from the pattern layer is $((2n-1)/4)\lambda$ (n is a positive integer) when the wavelength of the electromagnetic waves is taken as $\lambda$.

5. The sheet member for improving communication of claim 1, wherein the pattern layer includes a plurality of conductive pattern portions that are electrically insulated from each other.

6. The sheet member for improving communication of claim 5, wherein the pattern layer includes a plurality of types of conductive pattern portions in which at least one of size and shape is different therebetween.

7. The sheet member for improving communication of claim 1, wherein the pattern layer includes a conductive pattern portion that continuously extends over the sheet member.

8. The sheet member for improving communication of claim 1, wherein the conductive pattern portion has a substantially polygonal outer shape in which at least one corner is curved.

9. The sheet member for improving communication of claim 8, wherein the pattern layer includes a plurality of conductive pattern portions, and the conductive pattern portions have a combination of different radiuses of curvature of corners.

10. The sheet member for improving communication of claim 1, wherein the pattern layer includes a plurality of conductive pattern portions, and a gap between two adjacent conductive pattern portions varies depending on the position.

11. The sheet member for improving communication of claim 1, wherein a frequency of the electromagnetic waves is included in the range of at least 300 MHz and not greater than 300 GHz.

12. The sheet member for improving communication of claim 11, wherein a total thickness of the sheet member is not greater than 50 mm.

13. The sheet member for improving communication of claim 11, wherein the frequency of the electromagnetic waves is included in any one of frequency bands in the range of at least 860 MHz band and less than 1,000 MHz band, and a total thickness of the sheet member is not greater than 15 mm.

14. The sheet member for improving communication of claim 11, wherein the frequency of the electromagnetic waves is included in a 2.4 GHz band, and a total thickness of the sheet member is not greater than 8 mm.

15. The sheet member for improving communication of claim 1, wherein the storage layer is a single layer of an organic polymer including one or more particles selected from the group consisting of ferrite, iron alloy, and iron particles in an amount blended of at least 1 part by weight and not greater than 1500 parts by weight, with respect to 100 parts by weight of the organic polymer.

16. The sheet member for improving communication of claim 1, wherein the sheet member for improving communication is flame-resistant.

17. The sheet member for improving communication of claim 1, wherein at least one surface portion is at least one of glutinous and adhesive.

18. An antenna device, comprising:

an antenna element that has a resonance frequency matched to a frequency used for wireless communication; and the sheet member for improving communication of claim 1.

19. An electronic information transmitting apparatus comprising the antenna device of claim 18.

20. A method of improving communication, comprising:

when performing wireless communication using an antenna element in a vicinity of a member configured to jam communication having a portion made of a conductive material, providing a sheet member for improving communication including a pattern layer that includes a conductive pattern portion, the conductive pattern portion resonating with electromagnetic waves, storing electromagnetic energy, forming electromagnetic coupling with the antenna element, and transferring the stored electromagnetic energy to the antenna element; and a storage layer being a low loss material and at least one of a non-conductive dielectric layer and magnetic layer, the storage layer configured to propagate the electromagnetic waves with low loss and to store energy of the electromagnetic waves, and disposing the sheet member between the antenna element and the member so that the storage layer is between the pattern layer and the member, wherein the low loss material has a loss tangent $\in''/\in'$ that is 0.25 or below and a magnetic loss tangent $\mu''/\mu'$ that is 0.3846 or below, $\in'$ and $\in''$ being real and imaginary parts of a complex relative dielectric constant of the low loss material, respectively, and $\mu'$ and $\mu''$ being real and imaginary parts of a complex relative magnetic permeability of the low loss material, respectively.

* * * * *